US008288314B2

(12) United States Patent
Yokozawa et al.

(10) Patent No.: US 8,288,314 B2
(45) Date of Patent: Oct. 16, 2012

(54) HEAT-SENSITIVE TRANSFER SHEET

(75) Inventors: Akito Yokozawa, Minami-ashigara (JP); Junichiro Hosokawa, Minami-ashigara (JP); Naotsugu Muro, Minami-ashigara (JP); Hisato Nagase, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 465 days.

(21) Appl. No.: 12/570,511

(22) Filed: Sep. 30, 2009

(65) Prior Publication Data

US 2010/0084082 A1 Apr. 8, 2010

(30) Foreign Application Priority Data

Sep. 30, 2008 (JP) ..... 2008-254802
Sep. 30, 2008 (JP) ..... 2008-254804
Sep. 30, 2008 (JP) ..... 2008-254805

(51) Int. Cl.
*B41M 5/035* (2006.01)
*B41M 5/382* (2006.01)

(52) U.S. Cl. ..... 503/227; 8/471; 428/32.66

(58) Field of Classification Search ..... None
See application file for complete search history.

(56) References Cited

U.S. PATENT DOCUMENTS 5,270,285 A 12/1993 Ito et al.
7,122,504 B2 * 10/2006 Watanabe et al. ..... 503/227

FOREIGN PATENT DOCUMENTS

| | | | |
|---|---|---|---|
| EP | 0577051 | A1 | 1/1994 |
| EP | 0705713 | A1 | 4/1996 |
| EP | 0820875 | A1 | 1/1998 |
| EP | 2030800 | A1 | 3/2009 |
| JP | 62-227787 | A | 10/1987 |
| JP | 6-19033 | B2 | 3/1994 |
| JP | 8-90942 | A | 4/1996 |
| JP | 8-90945 | A | 4/1996 |
| JP | 359622 | B2 | 9/2004 |
| JP | 3596922 | B2 | 9/2004 |
| JP | 2006-306016 | A | 11/2006 |
| JP | 2007-98696 | A | 4/2007 |
| JP | 2007-190909 | A | 8/2007 |
| JP | 2010-83004 | A | 4/2010 |

* cited by examiner

*Primary Examiner* — Bruce H Hess
(74) *Attorney, Agent, or Firm* — Sughrue Mion, PLLC

(57) ABSTRACT

A heat-sensitive transfer sheet, containing:
a base film;
a dye layer; and
a heat-resistant lubricating layer containing talc particles;
wherein, when a projected area corresponding to each of the talc particles in the heat-resistant lubricating layer is obtained from an electron beam image that is obtained by irradiating electron beams accelerated at 20 kV from a side of the heat-resistant lubricating layer of the heat-sensitive transfer sheet using a scanning electronic microscope, an average projected area of talc particles each having the projected area of 10 square μm or more is 80 square μm or less, and a variation coefficient that is obtained by dividing a standard deviation of the projected areas of talc particles each having the projected area of 10 square μm or more by the average projected area is 0.8 or less.

18 Claims, 1 Drawing Sheet

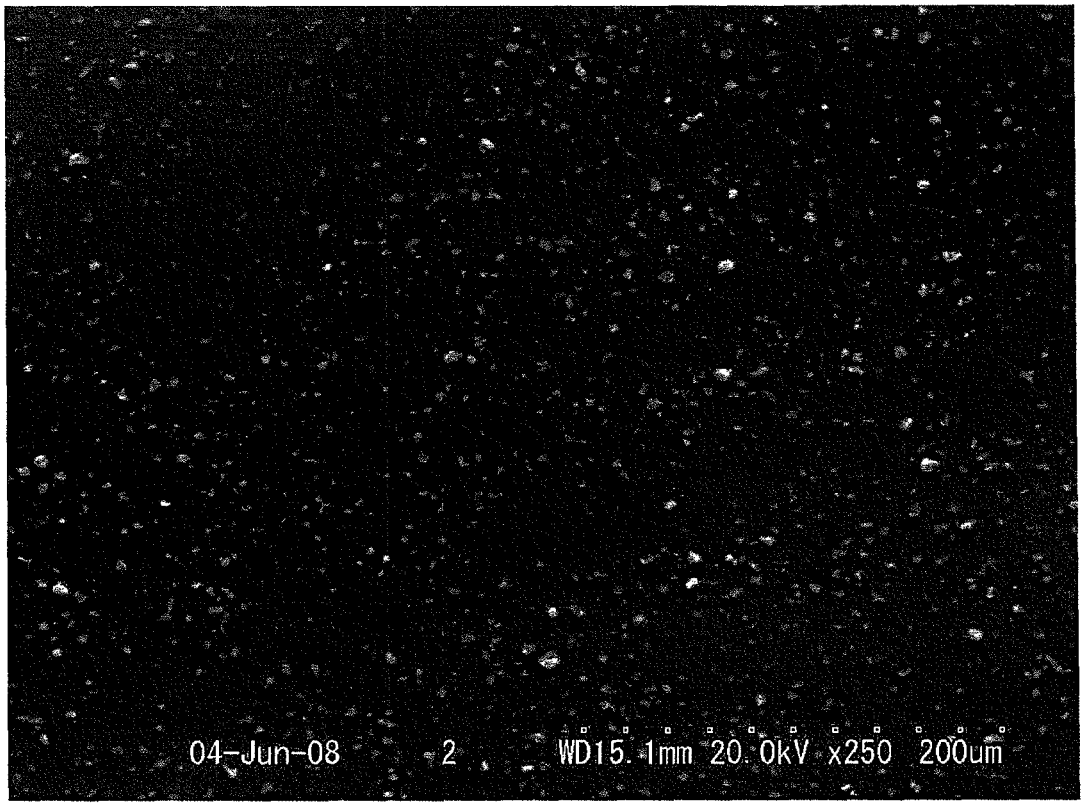
04-Jun-08 2 WD15.1mm 20.0kV x250 200um

HEAT-SENSITIVE TRANSFER SHEET

FIELD OF THE INVENTION

The present invention relates to a heat-sensitive transfer sheet.

BACKGROUND OF THE INVENTION

Various heat transfer recording methods have been known so far. Among these methods, dye diffusion transfer recording systems attract attention as a process that can produce a color hard copy having an image quality closest to that of silver halide photography. Moreover, this system has advantages over silver halide photography: it is a dry system, it enables direct visualization from digital data, it makes reproduction simple, and the like.

Among these methods, in a dye diffusion type thermal transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated, for example, by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

Recently, various printers allowing higher-speed printing have been developed and commercialized increasingly in the field of the dye-diffusion transfer recording systems. The high-speed printing is a performance desirable for shortening the time of the user waiting for printing in photo shop.

In order to prevent a thermal printer head from causing fusion of heat-sensitive transfer sheet, and to provide with a lubricating property or the like, a heat-resistant lubricating layer is disposed on the side of the heat-sensitive transfer sheet that contacts the thermal printer head. The fusion may cause a running trouble that is called sticking at the time of printing, and moreover the heat-sensitive transfer sheet may be cut off due to the fusion. Further, when the lubricating property is insufficient, an image with blur (print cockle) may be formed at the portion where cockle appears due to change in shape such as the cockle that is caused by stretch of the heat-sensitive transfer sheet at the time of printing. The thermal printer head gets to contact the heat-sensitive transfer sheet at higher temperature and higher speed owing to high speed printing than normal printing. Therefore, further improvement of properties on the heat-resistant lubricating layer has been required.

For example, JP-A-8-90942 ("JP-A" means unexamined published Japanese patent application) discloses that the sticking can be removed by containing talc having specific shot type abrasion degree in the heat-resistant lubricating layer. JP-A-8-90945 discloses that the sticking and print cockle can be removed by containing talc having impurities in a specific content defined by X-ray diffraction intensity in the heat-resistant lubricating layer.

Ordinarily, heat-sensitive transfer sheets are stored as such a product form that the heat-sensitive transfer sheet is prepared by coating a dye layer on or above a base film, followed by drying, and then once stored as a roll form (also referred to as "broad roll"), and subsequently the heat-sensitive transfer sheet is taken out from the roll and cut into a sheet having a desired width (also referred to as "product roll"), and then rewound in a roll form which is then set in a printer. As a result, the heat-resistant lubricating layer and the dye layer contact each other during storage of the broad roll, so that the dye involuntarily transfers to the heat-resistant lubricating layer. In addition, when the broad roll is processed to a product roll and stored over time, the dye again involuntarily transfers from the heat-resistant lubricating layer to the surface of a protective layer or the surface of the dye layer. Therefore, when printing is carried out under that condition, there are occurred troubles in which the involuntarily transferred dye gets to transfer on a print. Especially, when the transferred dye is a yellow dye, if the yellow dye is transferred eventually on a print, the white background of the print is turned yellow resulting in so-called stains. This is a serious defect that causes quality deterioration of the color hard copy (photography).

Further, the heat-sensitive transfer sheet capable of providing with a high transfer density at time of printing is required. The dye having a high transfer density has also a high spectral absorption, and is likely to be transferred to the heat-resistant lubricating layer. Therefore, it is required to combine improvement of transfer density at the time of printing with suppression of dye transfer to the heat-resistant lubricating layer.

Meanwhile, the heat-resistant lubricating layer containing talc is described in JP-A-8-90942. The yellow dye having a 5-pyrazolone skeleton is described in JP-B-6-19033 ("JP-B" means examined Japanese patent publication). However, the heat-sensitive transfer sheets described therein are not necessarily satisfied to address the problem in that improvement in transfer density at the time of printing is combined with suppression of dye transfer to the heat-resistant lubricating layer. Therefore, it is earnestly required to address to this problem.

Further, various methods of obtaining a high quality image have been proposed in the past. For example, specific pyrazolotriazole-series azomethine dyes are proposed as the dye (see Japanese Patent No. 3596922).

Meanwhile, it is known to dispose a heat-resistant lubricating layer containing talc on the side of the heat-sensitive transfer sheet that contacts a thermal printer head of the printer in order to prevent the thermal printer head of the printer and the heat-sensitive transfer sheet from burning, and to provide with a lubricating property between the thermal printer head of the printer and the heat-sensitive transfer sheet (see JP-A-8-90942).

However, these heat-sensitive transfer sheets are not necessarily enough to solve the problems that newly arise after further studies on the ink sheet. Thus, further improvement in transfer property of high density and fastness of dye has been required.

SUMMARY OF THE INVENTION

The present invention resides in a heat-sensitive transfer sheet, comprising:

a base film;

a dye layer containing a heat-transferable dye and a resin formed on one side of the base film; and a heat-resistant lubricating layer containing talc particles as one kind of inorganic particle and a resin formed on the other side of the base film;

wherein, when a projected area corresponding to each of the talc particles in the heat-resistant lubricating layer is obtained from an electron beam image that is obtained by irradiating electron beams accelerated at 20 kV from a side of the heat-resistant lubricating layer of the heat-sensitive transfer sheet using a scanning electronic microscope, an average projected area of talc particles each having the projected area of 10 square μm or more is 80 square μm or less, and a variation coefficient that is obtained by dividing a standard deviation of the projected areas of talc particles each having the projected area of 10 square μm or more by the average projected area is 0.80 or less.

Further, the present invention resides in a method of forming an image, comprising the steps of superposing a heat-sensitive transfer sheet on a heat-sensitive transfer image-receiving sheet, and applying thermal energy from a side of a heat-resistant lubricating layer described below of the heat-sensitive transfer sheet in accordance with an image signal, to form an image, wherein the heat-sensitive transfer sheet comprises a base film, a dye layer containing a heat-transferable dye and a resin formed on one side of the base film, and a heat-resistant lubricating layer containing talc particles as one kind of inorganic particle and a resin formed on the other side of the base film, wherein the heat-sensitive transfer image-receiving sheet comprise a support, and a heat insulation layer containing latex hollow polymer particles and a receptor layer containing a latex polymer on the support, wherein, in the superposing step, said dye layer of the heat-sensitive transfer sheet is contact with the receptor layer of the heat-sensitive transfer image receiving sheet, and wherein, when a projected area corresponding to each of the talc particles in the heat-resistant lubricating layer is obtained from an electron beam image that is obtained by irradiating electron beams accelerated at 20 kV from a side of the heat-resistant lubricating layer of the heat-sensitive transfer sheet using a scanning electronic microscope, an average projected area of talc particles each having the projected area of 10 square μm or more is 80 square μm or less, and a variation coefficient that is obtained by dividing a standard deviation of the projected areas of talc particles each having the projected area of 10 square μm or more by the average projected area is 0.80 or less.

Other and further features and advantages of the invention will appear more fully from the following description.

BRIEF DESCRIPTION OF THE DRAWINGS

FIG. 1 shows a scanning electron microscope photograph (SEM image) of talc in the heat-resistant lubricating layer.

DETAILED DESCRIPTION OF THE INVENTION

The study on improvement in properties of the heat-resistant lubricating layer at the time of high-speed printing was carried out using a heat-resistant lubricating layer containing talc. As a result, it was found that a stretch was particularly large for the heat-sensitive transfer sheet of from a first sheet to a fifth sheet under the conditions that printing was resumed in 10 minutes or more of suspension (waiting time) of the printer after once printing was finished. It has been found that these previous heat-sensitive transfer sheets are insufficient as a technique whereby a print cockle is removed, and a point-like or streaky image defect arises in a low density region of the print.

When many images are continuously printed in accordance with orders of image reproduction from ordinary customers, occurrence of image defects is limited to from a first print to about a fifth print of the heat-sensitive transfer sheet. However, in the case of self-service by which ordinary customers carry out print by themselves at a shop, printing is quiet often resumed after the printer is waited for 10 minutes or more. For this reason, it is required to improve stretch of the heat-sensitive transfer sheet in order to take advantage of high-speed printing even when a printer is restarted after suspension (waiting time) of the printer. Further, the print density range in which an image defect arises corresponds to densities of women's faces in the snapshots or the like, and therefore is the density range in which absence of image defect is most desired. Accordingly, further improvement of the heat-sensitive transfer sheet with respect to the above point of view has been required.

Further considering mass productivity in producing a heat-sensitive transfer sheet, it is necessary to use a dye-coating liquid with the lapse of time ranging from several hours to several days after preparation of the dye-coating liquid. The present inventors have discovered occurrence of a problem in that, with respect to some kinds of sublimation dyes, when the heat-sensitive transfer sheet that is produced by coating a dye containing-coating liquid that has been left over long period of time (for example, 24 hours or more) is compared to the heat-sensitive transfer sheet that is produced by coating the same coating liquid as the above except for no lapse of time, a probability of generation of jamming (paper jam) in printing using a printer remarkably increase thereby deteriorating a property of passing-through equipment. Further, it has been required to address this jamming problem as well as in combination with transfer of high density and improvement in fastness of dye.

According to the present invention, there is provided the following means:

(1-1) A heat-sensitive transfer sheet, comprising:

a base film;

a dye layer containing a heat-transferable dye and a resin formed on one side of the base film; and a heat-resistant lubricating layer containing talc particles as one kind of inorganic particle and a resin formed on the other side of the base film;

wherein, when a projected area corresponding to each of the talc particles in the heat-resistant lubricating layer is obtained from an electron beam image that is obtained by irradiating electron beams accelerated at 20 kV from a side of the heat-resistant lubricating layer of the heat-sensitive transfer sheet using a scanning electronic microscope, an average projected area of talc particles each having the projected area of 10 square μm or more is 80 square μm or less, and a variation coefficient that is obtained by dividing a standard deviation of the projected areas of talc particles each having the projected area of 10 squarer or more by the average projected area is 0.80 or less.

(1-2) The heat-sensitive transfer sheet as described in the above item (1-1), wherein the average projected area of talc particles each having the projected area of 10 square μm or more is 40 square μm or less, and the variation coefficient that is obtained by dividing a standard deviation of the projected areas of talc particles each having the projected area of 10 square μm or more by the average projected area is 0.60 or less.

(1-3) The heat-sensitive transfer sheet as described in the above item (1-1) or (1-2), wherein the number of talc particles having the projected area of 100 square μm or more in the heat-resistant lubricating layer is 1 or less per unit area 200, 000 square μm of the heat-resistant lubricating layer.

(1-4) The heat-sensitive transfer sheet as described in any one of the above items (1-1) to (1-3), wherein the heat-resistant lubricating layer comprises at least one kind of inorganic particle other than the talc particles, and wherein the inorganic particle has Mohs hardness of from 3 to 6, an average sphere-equivalent diameter of the particle is from 0.3 μm to 5 μm, and the ratio of the longest width of the particle to the average sphere-equivalent diameter of the particle is from 1.5 to 50.

(1-5) The heat-sensitive transfer sheet as described in any one of the above items (1-1) to (1-4), wherein the heat-resistant lubricating layer further comprises a compound represented by formula (P):

$$\{(R^{1a}O)(R^{2a}O)P(=O)O\}_m M \qquad \text{Formula (P)}$$

wherein $R^{1a}$ represents a substituted or unsubstituted aliphatic group or a substituted or unsubstituted aryl group; $R^{2a}$ represents a hydrogen atom, a metal ion, a substituted or unsubstituted aliphatic group, or a substituted or unsubstituted aryl group; M represents a hydrogen atom, a metal ion, or an ammonium ion; and m has the same valence as that of M and represents a number of from 1 to 6.

(1-6) The heat-sensitive transfer sheet as described in the above item (1-5), wherein when the content of the compound represented by formula (P) contained in the heat-resistant lubricating layer is 100 parts by mass, the content of the talc particles contained in the heat-resistant lubricating layer is 30 parts by mass or more.

(1-7) The heat-sensitive transfer sheet as described in any one of the above items (1-1) to (1-6), wherein the heat-resistant lubricating layer further comprises a multivalent metal salt of an alkyl carboxylic acid.

(1-8) The heat-sensitive transfer sheet as described in any one of the above items (1-1) to (1-7), wherein the base film further comprises an easy adhesion layer on or above at least one surface thereof.

(1-9) The heat-sensitive transfer sheet as described in any one of the above items (1-1) to (1-8), wherein the resin of the heat-resistant lubricating layer has two or more hydroxyl groups at the end of polymer chain of the resin (namely, the end of a polymer chain of the resin in the longitudinal direction) or in a polymer structure of the resin.

(1-10) The heat-sensitive transfer sheet described in the above item (1-9), wherein the resin is a polyacrylpolyol resin.

(1-11) The heat-sensitive transfer sheet as described in the above item (1-9) or (1-10), wherein the resin of the heat-resistant lubricating layer is a cross-linked resin (preferably a resin cross-linked with a polyisocyanate-series crosslinking agent).

(1-12) The heat-sensitive transfer sheet as described in the above item (1-11), wherein a crosslinking reaction of the resin is carried out in the temperature range of 40° C. to 53° C. and for a period of 1 day to 20 days.

(1-13) The heat-sensitive transfer sheet described in any one of the above items (1-1) to (1-12), which is used in combination with a heat-sensitive transfer image-receiving sheet having a support, and a heat insulation layer containing latex hollow polymer particles and a receptor layer containing a latex polymer disposed on or above the support.

(1-14) A method of forming an image, comprising the steps of:

superposing a heat-sensitive transfer sheet on a heat-sensitive transfer image-receiving sheet, and applying thermal energy from a side of a heat-resistant lubricating layer described below of the heat-sensitive transfer sheet in accordance with an image signal, to form an image, wherein the heat-sensitive transfer sheet comprises a base film, a dye layer containing a heat-transferable dye and a resin formed on one side of the base film, and a heat-resistant lubricating layer containing talc particles as one kind of inorganic particle and a resin formed on the other side of the base film, wherein the heat-sensitive transfer image-receiving sheet comprise a support, and a heat insulation layer containing latex hollow polymer particles and a receptor layer containing a latex polymer on the support, wherein, in the superposing step, said dye layer of the heat-sensitive transfer sheet is contact with the receptor layer of the heat-sensitive transfer image receiving sheet, and wherein, when a projected area corresponding to each of the talc particles in the heat-resistant lubricating layer is obtained from an electron beam image that is obtained by irradiating electron beams accelerated at 20 kV from a side of the heat-resistant lubricating layer of the heat-sensitive transfer sheet using a scanning electronic microscope, an average projected area of talc particles each having the projected area of 10 square μm or more is 80 square μm or less, and a variation coefficient that is obtained by dividing a standard deviation of the projected areas of talc particles each having the projected area of 10 square μm or more by the average projected area is 0.80 or less.

(2-1) A heat-sensitive transfer sheet, comprising:

a base film;

a dye layer containing a yellow dye and a resin formed on one side of the base film; and a heat-resistant lubricating layer containing talc particles as one kind of inorganic particle and a resin formed on the other side of the base film;

wherein at least one kind of the yellow dye is a dye represented by formula (1), wherein, when a projected area corresponding to each of the talc particles in the heat-resistant lubricating layer is obtained from an electron beam image that is obtained by irradiating electron beams accelerated at 20 kV from a side of the heat-resistant lubricating layer of the heat-sensitive transfer sheet using a scanning electronic microscope, an average projected area of talc particles each having the projected area of 10 square μm or more is 80 square μM or less, and a variation coefficient that is obtained by dividing a standard deviation of the projected areas of talc particles each having the projected area of 10 square μm or more by the average projected area is 0.80 or less:

Formula (1)

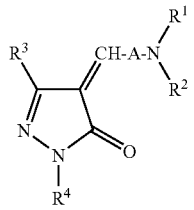

wherein A represents a substituted or unsubstituted arylene group; $R^1$ and $R^2$ each independently represent a hydrogen atom, a substituted or unsubstituted alkyl group, a substituted or unsubstituted alkenyl group or a substituted or unsubstituted aryl group; $R^3$ represents a hydrogen atom, a substituted or unsubstituted alkyl group, a substituted or unsubstituted aryl group, a substituted or unsubstituted amino group, a substituted or unsubstituted alkoxy group, a substituted or unsubstituted aryloxy group, a substituted or unsubstituted alkoxycarbonyl group, a substituted or unsubstituted aryloxycarbonyl group, or a substituted or unsubstituted carbamoyl group; and $R^4$ represents a substituted or unsubstituted alkyl group or a substituted or unsubstituted aryl group.

(2-2) The heat-sensitive transfer sheet as described in the above item (2-1), wherein the average projected area of talc particles each having the projected area of 10 square μm or more is 40 square μm or less, and the variation coefficient that is obtained by dividing a standard deviation of the projected areas of talc particles each having the projected area of 10 square μm or more by the average projected area is 0.60 or less.

(2-3) The heat-sensitive transfer sheet as described in the above item (2-1) or (2-2), wherein the number of talc particles having the projected area of 100 square μm or more in the heat-resistant lubricating layer is 1 or less per unit area 200,000 square μm of the heat-resistant lubricating layer.

(2-4) The heat-sensitive transfer sheet as described in any one of the above items (2-1) to (2-3), wherein the heat-resistant lubricating layer comprises at least one kind of inorganic particle other than the talc particles, and wherein the inorganic particle has Mohs hardness of from 3 to 6, an average sphere-equivalent diameter of the particle is from 0.3 μm to 5 μm, and the ratio of the longest width of the particle to the average sphere-equivalent diameter of the particle is from 1.5 to 50.

(2-5) The heat-sensitive transfer sheet as described in any one of the above items (2-1) to (2-4), wherein the heat-resistant lubricating layer further comprises a compound represented by formula (P):

$$\{(R^{1a}O)(R^{2a}O)P(=O)O\}_m M \qquad \text{Formula (P)}$$

wherein $R^{1a}$ represents a substituted or unsubstituted aliphatic group or a substituted or unsubstituted aryl group; $R^{2a}$ represents a hydrogen atom, a metal ion, a substituted or unsubstituted aliphatic group, or a substituted or unsubstituted aryl group; M represents a hydrogen atom, a metal ion, or an ammonium ion; and m has the same valence as that of M and represents a number of from 1 to 6.

(2-6) The heat-sensitive transfer sheet as described in the above item (2-5), wherein when the content of the compound represented by formula (P) contained in the heat-resistant lubricating layer is 100 parts by mass, the content of the talc particles contained in the heat-resistant lubricating layer is 30 parts by mass or more.

(2-7) The heat-sensitive transfer sheet as described in any one of the above items (2-1) to (2-6), wherein the heat-resistant lubricating layer further comprises a multivalent metal salt of an alkyl carboxylic acid.

(2-8) The heat-sensitive transfer sheet as described in any one of the above items (2-1) to (2-7), wherein the base film further comprises an easy adhesion layer on or above at least one surface thereof.

(2-9) The heat-sensitive transfer sheet as described in any one of the above items (2-1) to (2-8), wherein the resin of the heat-resistant lubricating layer has two or more hydroxyl groups at the end of polymer chain of the resin or in a polymer structure of the resin.

(2-10) The heat-sensitive transfer sheet described in the above item (2-9), wherein the resin is a polyacrylpolyol resin.

(2-11) The heat-sensitive transfer sheet as described in the above item (2-9) or (2-10), wherein the resin of the heat-resistant lubricating layer is a cross-linked resin.

(2-12) The heat-sensitive transfer sheet as described in the above item (2-11), wherein a crosslinking reaction of the resin is carried out in the temperature range of 40° C. to 53° C. and for a period of 1 day to 20 days.

(2-13) The heat-sensitive transfer sheet described in any one of the above items (2-1) to (2-12), which is used in combination with a heat-sensitive transfer image-receiving sheet having a support, and a heat insulation layer containing latex hollow polymer particles and a receptor layer containing a latex polymer disposed on or above the support.

(2-14) A method of forming an image, comprising the steps of:

superposing a heat-sensitive transfer sheet on a heat-sensitive transfer image-receiving sheet, and applying thermal energy from a side of a heat-resistant lubricating layer described below of the heat-sensitive transfer sheet in accordance with an image signal, to form an image, wherein the heat-sensitive transfer sheet comprises a base film, a dye layer containing a yellow dye and a resin formed on one side of the base film, and a heat-resistant lubricating layer containing talc particles as one kind of inorganic particle and a resin formed on the other side of the base film, wherein at least one kind of the yellow dye is a dye represented by the above-described formula (1), wherein the heat-sensitive transfer image-receiving sheet comprise a support, and a heat insulation layer containing latex hollow polymer particles and a receptor layer containing a latex polymer on the support, wherein, in the superposing step, said dye layer of the heat-sensitive transfer sheet is contact with the receptor layer of the heat-sensitive transfer image receiving sheet, and wherein, when a projected area corresponding to each of the talc particles in the heat-resistant lubricating layer is obtained from an electron beam image that is obtained by irradiating electron beams accelerated at 20 kV from a side of the heat-resistant lubricating layer of the heat-sensitive transfer sheet using a scanning electronic microscope, an average projected area of talc particles each having the projected area of 10 square μm or more is 80 square μm or less, and a variation coefficient that is obtained by dividing a standard deviation of the projected areas of talc particles each having the projected area of 10 square μm or more by the average projected area is 0.80 or less.

(3-1) A heat-sensitive transfer sheet, comprising:

a base film;

a dye layer containing a magenta dye and a resin formed on one side of the base film; and a heat-resistant lubricating layer containing talc particles as one kind of inorganic particle and a resin formed on the other side of the base film;

wherein at least one kind of the magenta dye is a dye represented by formula (2), wherein, when a projected area corresponding to each of the talc particles in the heat-resistant lubricating layer is obtained from an electron beam image that is obtained by irradiating electron beams accelerated at 20 kV from a side of the heat-resistant lubricating layer of the heat-sensitive transfer sheet using a scanning electronic microscope, an average projected area of talc particles each having the projected area of 10 square μm or more is 80 square μm or less, and a variation coefficient that is obtained by dividing a standard deviation of the projected areas of talc particles each having the projected area of 10 square μm or more by the average projected area is 0.80 or less:

Formula (2)

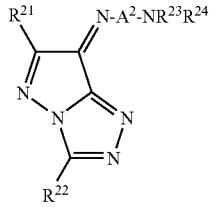

wherein $A^2$ represents a substituted or unsubstituted arylene group or a substituted or unsubstituted divalent pyridine ring group; and $R^{21}$, $R^{22}$, $R^{23}$ and $R^{24}$ each independently represent a substituted or unsubstituted alkyl group, a substituted or unsubstituted alkenyl group or a substituted or unsubstituted aryl group.

(3-2) The heat-sensitive transfer sheet as described in the above item (3-1), wherein the average projected area of talc particles each having the projected area of 10 square μm or more is 40 square μm or less, and the variation coefficient that is obtained by dividing a standard deviation of the projected areas of talc particles each having the projected area of 10 square μm or more by the average projected area is 0.60 or less.

(3-3) The heat-sensitive transfer sheet as described in the above item (3-1) or (3-2), wherein the number of talc particles having the projected area of 100 square μm or more in the heat-resistant lubricating layer is 1 or less per unit area 200,000 square μm of the heat-resistant lubricating layer.

(3-4) The heat-sensitive transfer sheet as described in any one of the above items (3-1) to (3-3), wherein the heat-resistant lubricating layer comprises at least one kind of inorganic particle other than the talc particles, and wherein the inorganic particle has Mohs hardness of from 3 to 6, an average sphere-equivalent diameter of the particle is from 0.3 μm to 5 μm, and the ratio of the longest width of the particle to the average sphere-equivalent diameter of the particle is from 1.5 to 50.

(3-5) The heat-sensitive transfer sheet as described in any one of the above items (3-1) to (3-4), wherein the heat-resistant lubricating layer further comprises a compound represented by formula (P):

$$\{(R^{1a}O)(R^{2a}O)P(=O)O\}_m M \qquad \text{Formula (P)}$$

wherein $R^{1a}$ represents a substituted or unsubstituted aliphatic group or a substituted or unsubstituted aryl group; $R^{2a}$ represents a hydrogen atom, a metal ion, a substituted or unsubstituted aliphatic group, or a substituted or unsubstituted aryl group; M represents a hydrogen atom, a metal ion, or an ammonium ion; and m has the same valence as that of M and represents a number of from 1 to 6.

(3-6) The heat-sensitive transfer sheet as described in the above item (3-5), wherein when the content of the compound represented by formula (P) contained in the heat-resistant lubricating layer is 100 parts by mass, the content of the talc particles contained in the heat-resistant lubricating layer is 30 parts by mass or more.

(3-7) The heat-sensitive transfer sheet as described in any one of the above items (3-1) to (3-6), wherein the heat-resistant lubricating layer further comprises a multivalent metal salt of an alkyl carboxylic acid.

(3-8) The heat-sensitive transfer sheet as described in any one of the above items (3-1) to (3-7), wherein the base film further comprises an easy adhesion layer on or above at least one surface thereof.

(3-9) The heat-sensitive transfer sheet as described in any one of the above items (3-1) to (3-8), wherein the resin of the heat-resistant lubricating layer has two or more hydroxyl groups at the end of polymer chain of the resin or in a polymer structure of the resin.

(3-10) The heat-sensitive transfer sheet described in the above item (3-9), wherein the resin is a polyacrylpolyol resin.

(3-11) The heat-sensitive transfer sheet as described in the above item (3-9) or (3-10), wherein the resin of the heat-resistant lubricating layer is a cross-linked resin.

(3-12) The heat-sensitive transfer sheet as described in the above item (3-11), wherein a crosslinking reaction of the resin is carried out in the temperature range of 40° C. to 53° C. and for a period of 1 day to 20 days.

(3-13) The heat-sensitive transfer sheet described in any one of the above items (3-1) to (3-12), which is used in combination with a heat-sensitive transfer image-receiving sheet having a support, and a heat insulation layer containing latex hollow polymer particles and a receptor layer containing a latex polymer disposed on or above the support.

(3-14) A method of forming an image, comprising the steps of:

superposing a heat-sensitive transfer sheet on a heat-sensitive transfer image-receiving sheet, and applying thermal energy from a side of a heat-resistant lubricating layer described below of the heat-sensitive transfer sheet in accordance with an image signal, to form an image, wherein the heat-sensitive transfer sheet comprises a base film, a dye layer containing a magenta dye and a resin formed on one side of the base film, and a heat-resistant lubricating layer containing talc particles as one kind of inorganic particle and a resin formed on the other side of the base film, wherein at least one kind of the magenta dye is a dye represented by the above-described formula (2), wherein the heat-sensitive transfer image-receiving sheet comprise a support, and a heat insulation layer containing latex hollow polymer particles and a receptor layer containing a latex polymer on the support, wherein, in the superposing step, said dye layer of the heat-sensitive transfer sheet is contact with the receptor layer of the heat-sensitive transfer image receiving sheet, and wherein, when a projected area corresponding to each of the talc particles in the heat-resistant lubricating layer is obtained from an electron beam image that is obtained by irradiating electron beams accelerated at 20 kV from a side of the heat-resistant lubricating layer of the heat-sensitive transfer sheet using a scanning electronic microscope, an average projected area of talc particles each having the projected area of 10 square μm or more is 80 square μm or less, and a variation coefficient that is obtained by dividing a standard deviation of the projected areas of talc particles each having the projected area of 10 square μm or more by the average projected area is 0.80 or less.

Hereinafter, a first embodiment of the present invention means to include the heat-sensitive transfer sheets described in the above items (1-1) to (1-13), the method of forming an image described in the above item (1-14).

A second embodiment of the present invention means to include the heat-sensitive transfer sheets described in (2-1) to (2-13), the method of forming an image described in (2-14).

A third embodiment of the present invention means to include the heat-sensitive transfer sheets described in (3-1) to (3-13), the method of forming an image described in (3-14).

Herein, the present invention means to include all of the above first, second and third embodiments, unless otherwise specified.

The present invention will be explained in detail below.

1) Heat-sensitive Transfer Sheet (Structure of Heat-sensitive Transfer Sheet (Ink Sheet))

The ink sheet is used to transfer a colorant (dye) from the ink sheet to a heat-sensitive transfer image-receiving sheet in the following manner: when a thermally transferred image is formed, the ink sheet is put onto the heat-sensitive transfer image-receiving sheet and then the sheets are heated from the ink sheet side thereof by means of a thermal printer head or the like. The ink sheet of the present invention has a base film, a dye layer (heat-transferable layer) formed over one surface of the base film and containing a heat-transferable dye and a resin, and a heat-resistant lubricating layer formed over the other surface of the base film and containing an inorganic particle and a resin. An easily-adhesive layer (primer layer) may be formed between the base film and the dye layer or between the base film and the heat-resistant lubricating layer.

(Heat-resistant Lubricating Layer)

In the present invention, the heat-resistant lubricating layer contains talc particles as the inorganic particle.

(Talc)

In the present invention, the talc is a magnesium hydrous silicate mineral. A theoretical composition of the talc is $Mg_3Si_4O_{10}(OH)_2$. The talc has, as a unit structure, a three-layer structure in which a magnesium-containing layer is sandwiched between two layers each having a layer structure of silicate salt. On account that a bond between silicate salt layers in the unit structure is weak, the talc has a cleaving property whereby the talc is soft (Mohs hardness 1) and has a lubricating property. The talc does not decompose at a temperature of about 900° C. and is inactive with respect to most chemicals. Therefore, the talc is a thermally and chemically stable material. With respect to the talc, there are two crystal systems of monoclinic system and triclinic system. In the present invention, either one of these crystal systems may be used. Further, a mixture of these crystal systems may be used.

Incorporation of the talc in the heat-resistant lubricating layer rarely occurs scratch of a thermal printer head because of softness of the talc. Further, the lubricating property of the talc suppresses stretch of the heat-sensitive transfer sheet, which results in less generation of wrinkles on the print. Further, the talc is thermally and chemically stable. Accordingly, the use of talc is advantageous in that adverse effects of fusion and corrosion on the thermal printer head are small. In the present invention, the content of the talc contained in the heat-resistant lubricating layer is preferably 0.1% by mass or more, more preferably from 0.2% by mass to 20% by mass, further preferably from 0.4% by mass to 10% by mass, and most preferably from 0.8% by mass to 5% by mass, relative to the total amount of the heat-resistant lubricating layer.

In the present invention, the talc can be contained in the heat-resistant lubricating layer by coating, on a base film, a heat-resistant lubricating layer-coating liquid in which a powder of raw material talc has been previously dispersed. Ordinarily, materials originated from natural minerals are used as the raw material talc. However, this raw material contains impurities because of natural products. The talc used in the present invention means hydrous magnesium silicate mineral that is free of impurity contained in the raw material talc. As is different from the interior portion of talc, the talc may have various adsorbed materials or substituents such as a hydroxyl group or the like on the surface thereof. For this reason, actual elemental composition of talc may be a little different from the theoretical one. However, such surface-modified talc is defined as being within the category of the talc that is used in the present invention. Criterion of the talc is carried out comparing a diffraction peak of the sample obtained by elemental analysis and X-ray diffraction measurement, to the diffraction peak of known talc.

Examples of the talc as a raw material are shown below. However, the present invention is not limited to these.

As the talc, commercially available powdered talc originated from natural mineral may be used. Examples of the commercially available powdered talc include MICRO ACE series and SG series manufactured by Nippon Talc Co., Ltd.; HI-Filler Series manufactured by MATSUMURASANGYO Co., Ltd.; PS series manufactured by Fukuoka Talc Co., Ltd.; JET series manufactured by Asada Milling Co., Ltd.; High toron series manufactured by TAKEHARA KAGAKU KOGYO Co., Ltd.; and MV series manufactured by Nihon Mistron Co., Ltd. (each trade name). In the present invention, an average sphere-equivalent particle size of the talc particles contained in the raw material talc is preferably from 0.5 μm to 10 μm, more preferably from 0.8 μm to 5 μm, and most preferably from 1 μm to 4 μm. The average sphere-equivalent particle size of the raw talc may be obtained according to laser diffraction scattering method. The spatial distribution of the diffractive scattered light intensities obtained by radiating light to the particles is varied in accordance with the sizes of the particles. Thus, the particle size distribution is obtained by measuring the above-described space distribution of diffraction scattered light intensity and analyzing the same. Further, the average sphere-equivalent diameter particle size can be obtained from calculation based on the space distribution. Such a technique has been established as the laser diffractive scattering method. A device used for the measurement may be a commercially available product, such as SALD series (trade name) manufactured by Shimadzu Corporation or LA series (trade name) manufactured by Horiba, Ltd.

The raw material talc is produced via steps including natural mineral beneficiation (concentration), pulverization, classification, and the like. The raw material talc is a powder a major of which has a tabular shape. A ratio of the thickness of the tabular particle to the area of the tabular plane varies in each particle, so that a projected area of the tabular plane of the talc particle in the heat-resistant lubricating layer cannot be defined in terms of the average particle size of the raw material talc. In the present invention, the projected area is defined in terms of a projected area of the talc in the heat-resistant lubricating layer. This matter will be described below.

JP-A-8-90942 discloses to use raw material talc having shot-type abrasion degree within a certain range. Further, JP-A-8-90945 discloses to use raw material talc having such X-ray diffraction properties that a ratio of impurities to the talc in terms of diffraction peak intensity is within a certain range. Since the raw material talc is originated from natural compounds, there are various kinds of raw material talc different from each other in terms of the kind and quantity of impurities. For this reason, there is raw material talc having various hardness and abrasion degree. In the present invention, the lower amount of impurities in the raw material talc is more preferable. When hard particles other than the talc are used together with the talc in the heat-resistant lubricating layer, hard particles having high purity are preferably used.

As for the impurities in the raw material talc, it is preferable that there are few impurities capable of forming hard impurities. Specifically, the content of Ca is preferably 0.5% by mass (hereinafter, also abbreviated simply to "%") or less, and more preferably 0.1% or less. The content of Al is preferably 0.6% or less, and more preferably 0.2% or less. The content of Fe is preferably 1.0% or less, more preferably 0.2% or less, and most preferably 0.05% or less. Further, since there is a possibility that dispersion properties might be affected by moisture when a dispersion liquid for the heat-resistant lubricating layer is produced, the less content of moisture is more preferable. Specifically, the content of moisture is preferably 0.5% or less, and more preferably 0.2% or less. Where the content of impurities in the raw material talc is defined in terms of a ratio (Y/X) of the largest peak intensity (Y) of X-ray diffraction originated from impurities to the largest peak intensity (X) of X-ray diffraction originated from talc, the ratio (Y/X) is preferably 0.40 or less, more preferably 0.20 or less, and most preferably 0.10 or less.

The larger quantity of hard raw material talc, the larger abrasion degree the raw material talc has. There are various methods of measuring abrasion degree. For example, the shot-type abrasion degree may be measured as follows.

(Measuring Method of Shot-Type Abrasion Degree)

1. Are placed 5 g of a raw material talc to be measured and 45 ml of water in a 100 ml glass vessel and stirred.
2. Are placed 6 pieces of preliminarily weighed scatter shot (lead: diameter 4 mm) in the vessel and a lid is put on the vessel.
3. The vessel containing the above-described content is stirred at 114 rpm for 5.5 hours using a stirring machine (Mix Rotar VMR-5 (trade name) manufactured by AS ONE Corporation).
4. The shot is taken out from the vessel after stirring, and then the shot is sufficiently washed with water, and then moisture attached on the shot is removed, and then the shot is weighed again.
5. A value (difference) obtained by subtracting the mass of shot measured after stirring from the mass of shot measured before stirring is calculated. This value is defined as the shot-type abrasion degree.

The larger shot-type abrasion degree indicates the more abrasion amount of the shot, in other words, the shot is more likely to become won.

It is preferable that hard impurities contained in the raw material talc are few, and therefore it is preferable that the shot-type abrasion degree of the raw material talc is small. For example, the shot-type abrasion degree is preferable 40 mg or less, more preferable 20 mg or less, and most preferably 10 mg or less.

Next, a method of producing a coating liquid for the heat-resistant lubricating layer is described.

The coating liquid for the heat-resistant lubricating layer is a liquid containing insoluble solid particles such as the talc particles. Accordingly, it is possible to use a production technique for pigment dispersion that is used in the paint industry.

Generally, the production steps can be classified roughly into a dissolution step and a dispersion step. The dissolution step is a step of preparing a solution of constituents that are dissolved in a solvent for a coating liquid out of all constituents of the heat-resistant lubricating layer. Generally, a step of dissolving a resin in an organic solvent is included in the dissolution step. The dispersion step is a step of mixing and dispersing the constituent-dissolved solution with other solid powder constituents, such as the raw material talc, of the heat-resistant lubricating layer that do not dissolve in the medium of the coating liquid. The solid powder constituents are generally secondary aggregated powder. Accordingly, the dispersion step generally includes (1) a step of wetting the surface of the powder with the constituent-dissolved solution, (2) a step of unstiffening or pulverizing agglomerate powder to primary particles, and (3) a step of stabilizing the dispersed particles. In the step (1), it is important that the surface of the powder is likely to get wet with the constituent-dissolved solution. Further, because air on the surface of the powder is replaced by the constituent-dissolved solution, high pressure or high shear force (shear stress) is preferable as a dispersion condition. In the step (2), high shear force as a dispersion condition is necessary to unstiffen agglomerate of the powder. In the step (3), various additives may be added in order to prevent dispersed particles from reaggregate in the liquid, or in order to prevent dispersed particles from reaggregate even under the condition that a solvent has gone by drying after coating of a coating liquid. Ordinarily, the steps of (1) to (3) proceed simultaneously with each other in the same dispersing device. It is also preferable to add a step of preliminarily conducting the step (1) (premixing). Further, when a resin is cured with a crosslinking agent to form the heat-resistant lubricating layer, a coating may be generally carried out using a coating liquid prepared by the method in which crosslinking agent is added to the dispersion containing a resin previously added.

As a dispersing device that is used for the dispersion, known devices may be used. For example, the 3 roll mill is a dispersing device in which dispersion is performed using both shear force and enforced pressure that effect at contact points among rolls having a different rotation speed from each other. Further, the sand mill and the beads mill are dispersing devices in which dispersion is performed using both impact force and shear stress that are obtained by agitating media such as glass beads or zirconia beads in a container. Because agitation of the media in the beads mill is carried out using gravity, there is a limitation to both impact force and shear stress. In contrast, attritor is a product that is improved so that strong impact force and shear stress can be obtained by forcibly agitating media by means of bracket that rotates media. As a small scale dispersing device, in addition to the above, there are a paint shaker in which a small-volume container is shaken to mix the content; a planetary beads mill (or roll mill) that is improved so that strong impact force and shear stress can be obtained by forcibly agitating media by means of rotation (spin) and revolution of a container at the same time, with respect to the limitation of impact force and shear stress; and the like.

More detailed explanation is described in "Toryo no Ryudo to Ganryo Bunsan (Fluidity of Paint and Pigment Dispersion)", published by Kyoritsu shuppan Co, Ltd., 1992; "Toryo to Toso, Zohoban (Paint and Coating, Enlarged Edition)", published by POWERSHA Inc., 1994; "Nyuka/Bunsan no Riron to Jisai Riron Hen (Theory and Practice of Emulsification and Dispersion, a chapter of theory)", published by Tokushukagaku Kogyo K.K., 1997; and "Insatsu Inku Nyumon Kaiteiban (Introductory Print Ink Revised Edition)", published by Insatsugakkai Shuppanbu, Ltd., 2002.

The heat-resistant lubricating layer can be formed by coating the coating liquid by a known method such as gravure coating, roll coating, blade coating or wire bar coating. The film thickness of the heat-resistant lubricating layer is preferably from 0.1 to 2.5 μm, more preferably from 0.4 to 1.5 μm. The coating amount is preferably from 0.1 to 3.0 g, and more preferably from 0.5 to 2.0 g per square meter.

As described above, it is seen that pulverization of primary particles of the raw material talc is caused by applying high-shear force in the course of dispersion. The talc has an advantage in that the talc does not substantially scratch a thermal printer head because of its softness. On the other hand, the talc is likely to be pulverized in the course of dispersion. As for the pulverization of raw material talc in the course of dispersion, the raw material talc not only cleaves along the cleavage plane, but also cleavage occurs in the direction of splitting both ends of the tabular plane that provide the highest shear stress. Further, talc particles after dispersion may flocculate again in a dispersion liquid, or at the time of the coating or drying. Therefore, there are great variations of the shape of the talc particles in the heat-resistant lubricating layer after the coating.

As described above, the size and shape of talc particles in the heat-resistant lubricating layer do not correspond to those of raw material talc particles. Further, the conditions of pulverized talc vary greatly according to compositions of the dispersion, production scale, and dispersing machines. Therefore, it is difficult to determine the production condition in a single uniform way. For this reason, in the present invention, the dispersion of projected area of the talc particles in the heat-resistant lubricating layer is defined by a scanning electron microscope measurement as described below.

Next, a method for measuring a projected area of the talc particles in the heat-resistant lubricating layer is described below.

Measurement of Electron Beam Image (SEM image) using Scanning Electron Microscope (SEM)

(Preparation of Sample for Measurement)

When an electron beam is radiated to a sample so that the sample is electrified, the electron beam is fluctuated by an electric field generated by the electrification and further the electric current value of the electron beam is varied. Thus, a precise measurement cannot be attained. In order to prevent such electrification, the sample surface is generally covered with an electroconductive thin film. The electroconductive thin film is preferably a coating formed by sputtering carbon (C) into a thickness of 20 to 35 nm.

(Electron Beam Irradiation and Measurement of SEM Image)

As for the electron beam to be irradiated, it is preferable that 20 kV of electron accelerating voltage is applied and the beam radius converges as much as possible to secure resolution. However, there is nothing wrong with the measurement, as long as a beam radius for an ordinary measurement of SEM is used. The electron accelerating voltage applied in SEM surface observation is ordinarily around 2 kV. In contrast, 20 kV is applied in the present invention. When 2 kV of electron accelerating voltage is applied, secondary electrons discharged from a neighbor of the surface to be observed dominantly contribute to a formation of the SEM Image. However, as the electron accelerating voltage increases, contribution of reflection electrons gradually becomes greater. The secondary electron has an advantage in that it is easy to observe irregularity on the surface. However, the secondary electron has a fault in that it is difficult for the secondary electron to distinguish a contrast image corresponding to the talc particles in the heat-resistant lubricating layer from a contrast image corresponding to the irregularity on the surface of the heat-resistant lubricating layer. Since the reflection electron is a reflection matter of an incident electron. Therefore, the larger the atomic number is, the greater the reflection electron intensity is. Since Si and Mg are each a constitutional element of the talc and have each a relatively larger atomic number among organic materials in the heat-resistant lubricating layer, a more clean-cut talc image may be obtained by the reflection electron than the secondary electron. For this reason, the electron accelerating voltage is increased greater than ordinary acceleration voltage for the SEM measurement in order to increase contribution of the reflection electron. On the other hand, as the electron accelerating voltage increases, the depth in which incident electrons invade becomes greater and resultantly scattering of the reflection electron also becomes greater. For this reason, 20 kV has been chosen as the electron accelerating voltage by which a talc image can be observed most easily.

Generally, the SEM measurement is performed by tilting an observing face in one direction to the incident electron beam. Accordingly, the thus-obtained SEM image is not an image observed from directly above, but is reduced in size by percentage of sin(Θ) in the direction tilted relative to the angle (Θ) between the incident electron beam and the observing face. Specifically, when the angle (Θ) is 90°, namely right angle (incoming beam is not declined), sin(Θ) is 1.0 which means that the SEM image is not reduced in size. In contrast, when the angle (Θ) is 30° (incoming beam is declined), sin (Θ) is 0.5 which means that the SEM image is reduced by 0.5 times in size in the tipped direction. Since the projected area of talc particles in the heat-resistant lubricating layer according to the definition of the present invention is obtained by measuring the particles directly from the above with respect to the surface of the heat-resistant lubricating layer, correction is necessary for the SEM image obtained by measuring the particles at a tilt. Where the angle (Θ) is 30°, correction can be made by increasing the length in the tilted direction by 2.0 times that is a reciprocal of 0.5 times as a reduction percentage. With respect to other inclination, correction can be made in the same manner as the above. The projected area corresponding to each of the talc particles in the heat-resistant lubricating layer is obtained with respect to the SEM image measured in the manner as described above. When the talc particles in the heat-resistant lubricating layer overlap on each other, or clump together, so that they are observed as a single talc image, these are evaluated as a single talc particle and a single projected area corresponding to the single talc particle is obtained.

(Discrimination Method where Talc and Inorganic Particles Other than the Talc Coexist)

In the present invention, when inorganic particles other than the talc particles are present in the heat-resistant lubricating layer, the talc particles are discriminated from other particles according to the following method.

(Discrimination by Characteristic X-Ray Measurement)

Discrimination is performed by Characteristic X-ray measurement using an instrument having a scanning electron microscope (the aforementioned SEM) equipped with an energy-dispersive X-ray spectral apparatus (abbreviated to "SEM-EDX", or "SEM-EDS"). It is possible to perform the characteristic X-ray measurement in the same viewing field as a SEM image by using the above-described instrument. Specifically, first, prospective places for candidate talc particles are specified by characteristic X-ray measurement. Next, scanning measurement is performed through the same region using the EDX (energy-dispersive X-ray spectral apparatus) to carry out mapping by characteristic X-ray. The elemental mapping by the EDX is a method of mapping by measuring characteristic X-ray within a short period of time in each place while scanning electron beam in the same manner as the SEM measurement. Further, characteristic X-ray intensity ratio of each element can be obtained by fixing the measuring place and measuring characteristic X-ray intensity originated from each element. This ratio is correlated with the composition, and may be used for discrimination.

Example 1

The Case Where Talc and Muscovite (White Mica) Coexist

The muscovite has cleavage properties and is tabular particles which are similar to the shape of talc particles. However, the composition of muscovite is $KAl_2[AlSi_3]O_{10}]$. In the place of talc, according to the above-described elemental mapping the characteristic X-ray of Mg is detected, whereas characteristic X-ray of K or Al is not detected. In contrast, in the place of muscovite, the characteristic X-ray of Mg is not detected, but characteristic X-ray of K and A1 is detected. Accordingly, they may be definitely discriminated from each other.

Example 2

The Case Where Talc and Forsterite that is One Kind of Olivine Coexist

The composition of forsterite is $Mg_2SiO_4$, which is similar to talc in terms of constitutional elements. However, they are different in constituent ratio of Mg and Si from each other. In this case, with respect to the heat-resistant lubricating layer containing known talc, a characteristic X-ray of Mg and Si is preliminarily measured at the place of the talc particles, and a characteristic X-ray intensity ratio of Mg to Si of the talc is preliminarily calculated. A test sample is measured in the same manner as the above. The talc or not is determined by comparing a characteristic X-ray intensity ratio of Mg to Si of the test sample to the preliminarily calculated characteristic X-ray intensity ratio of Mg to Si of the talc.

Such preparation is described in more detail in, for example, "Kiki Bunseki no Ziten (Dictionary of Instrumental Analysis)", edited by Japan Society for Analytical Chemistry, published by Asakura Shoten, 2005; "Hyoumen Bunseki Gizyutsu Sensyo (Surface Analyzing Technique Selected-Book) Electronic Probe/Microanalyzer" edited by the Surface Science Society of Japan and published by Maruzen Co., Ltd., 1998; and "EMPA Electron Probe Microanalyzer" written by Shiro Kinouchi and published by Gijutusyoin, 2001.

(Projected Area Corresponding to Each Talc Particle in Heat-Resistant Lubricating Layer)

In the present invention, with respect to each projected area that corresponds to each talc particle in the heat-resistant lubricating layer and that is obtained according to the above-described method, both number and specific projected area of talc particles having the projected area of 10 square μm or more are obtained. Ordinarily, with respect to the 400,000 square μm region of the heat-resistant lubricating layer (for example, 0.5 mm×0.8 mm square), a projected area corresponding to each talc particle is obtained. Ordinary, projected areas of 200 or more of talc particles are obtained. Further, an average projected area, a standard deviation, and a variation coefficient are calculated according to the following equations.

$$\text{(Average projected area)}=\text{(Sum of projected areas)}/\text{(Total number)} \quad \text{Equation (1)}$$

$$\text{(Standard deviation)}=\{\text{Sum of [(Projected area of each particle)}-\text{(Average projected area)}]^2/\text{(Total number)}\}^{0.5} \quad \text{Equation (2)}$$

$$\text{(Variation coefficient)}=\text{(Standard deviation)}/\text{(Average projected area)} \quad \text{Equation (3)}$$

In the present invention, the average projected area of talc particles having the projected area of 10 square μm or more is 80 square μm or less, preferably 60 square μm or less, and most preferably 40 square μm or less. Since the average projected area is an average of projected areas each having 10 square μm or more, the average projected area is necessarily 10 square μm or more.

The variation coefficient indicates that the smaller the value, the more uniform the distribution of projected areas corresponding to talc particles is. In the present invention, the variation coefficient is preferably 0.80 or less, and more preferably 0.60 or less.

Further, the number of talc particles having the projected area of 100 square μm or more is preferably 3 or less, and most preferably 1 or less, per 200,000 square μm of the heat-resistant lubricating layer. When the number of talc particles having the projected area of 100 square μm or more is a few, it is preferable to obtain the number in a wider region of the heat-resistant lubricating layer (for example, 1 million square μm, 1.0 mm×1.0 mm square) in order to enhance precision of the number.

In the present invention, as described above, only by controlling the average projected area to 80 square μm or less and controlling the variation coefficient to 0.80 or less in combination, it is possible to achieve such excellent effects that a stretch of the heat-sensitive transfer sheet at the initial period of printing is suppressed even in a high-speed printing, so that the print cockle can be removed, and point-like or streak-like image defects of the print in the low density region can be suppressed.

FIG. 1 is an actual electron micrograph (SEM image) of the heat-resistant lubricating layer that was obtained at the acceleration voltage of 20 kV using a high-resolution field-emission scanning electron microscope S-4700 (trade name, manufactured by Hitachi Corporation). Measurement was performed at 30° in terms of the inclination angle between incident electron beam and the observing face in the vertical direction of the electron micrograph (SEM image). FIG. 1 is an area of 400 μm×500 μm.

In the electron micrograph (SEM image) of FIG. 1, a portion which looks white compared to a surrounding area is the portion originated from the talc. It has been confirmed previously by the above-described SEM-EDX measurement that the portion that looks white is talc.

Here, the electron micrograph (SEM image) of FIG. 1 shows talc particles in the heat-resistant lubricating layer according to the present invention. It is seen from the project area corresponding to each talc particle in the electron micrograph that the number of talc particles having the project areas of 10 square μm or more is about 100; the average project area of talc particles having the project area of 10 square μm or more is 25 square μm; the variation coefficient of the project areas of talc particles each having the projected area of 10 square μm or more is 0.50; and there is no talc particle having the project area of 100 square μm or more.

In the present invention, the heat-resistant lubricating layer may contain other additives such as some other lubricant, a plasticizer, a stabilizer, a bulking agent, and a filler for removing a material adhering to a head.

Examples of the inorganic particles other than the talc include fluorides such as calcium fluoride, barium fluoride, and graphite fluoride; sulfides such as molybdenum disulfide, tungsten disulfide, and ferric sulfide; oxides such as silica, colloidal silica, lead oxide, alumina, and molybdenum oxide; and other inorganic materials such as graphite, mica, boron nitride, magnesium oxide (magnesia), magnesium hydroxide (brucite), magnesium carbonate (magnecite), magnesium calcium carbonate (dolomite), and clays (for example, kaolin, acid clay). Among these inorganic particles, magnesium oxide, magnesium hydroxide, magnesium carbonate, magnesium calcium carbonate, and kaolin are preferable; magnesium oxide, magnesium carbonate, and magnesium calcium carbonate are more preferable; and magnesium oxide is most preferable. The content of the inorganic particles other than the talc in the heat-resistant lubricating layer is preferably from 0.01% by mass to 50% by mass, more preferably from 0.05% by mass to 30% by mass, and most preferably from 0.1% by mass to 20% by mass relative to the total amount of the heat-resistant lubricating layer.

The size (average sphere-equivalent diameter) of the inorganic particles other than the talc is preferably from 0.1 μm to 50 μm, and more preferably from 0.5 μm to 10 μm. As for the shape thereof, any shape such as amorphous shape, sphere, cube, needle, and tabular shape may be used. Among these, needle or tabular particles are preferably used. Above all, it is more preferable embodiment to use the talc together with inorganic particles other than the talc, wherein the inorganic particles have Mohs hardness of from 3 to 6; an average particle size thereof is from 0.3 μm to 5 μm; and a ratio of the longest width of each particle to its sphere-equivalent diameter is from 1.5 to 50 in terms of average value.

Examples of organic materials that may be used together with the talc include organic resins such as fluorine resins, and silicone resins; silicone oil; higher fatty acid alcohol; organopolysiloxane; organic carboxylic acids; phosphates having a OH group; polyvalent metal salts of an alkyl carboxylic acid (for example, zinc stearate, lithium stearate); ammonium salts or metal salts of a phosphate (for example, stearylzinc phosphate); various waxes such as polyethylene wax, and paraffin wax; and surfactants such as anionic surfactants, cationic surfactants, amphoteric surfactants, nonionic surfactants, and fluorine-containing surfactants. Among these organic materials, silicone resins, organopolysiloxane, phosphates having a OH group, polyvalent metal salts of an alkyl carboxylic acid, and ammonium salts or metal salts of a phosphate that each show an effect such as suppression of sticking, and improvement of lubricating properties, are preferably used together with the talc. Especially, phosphates having a OH group, polyvalent metal salts of an alkyl carboxylic acid, or ammonium salts and metal salts of a phosphate are preferable.

As the phosphate having a —OH group, and the ammonium salts or metal salts of a phosphate, a compound represented by the following formula (P) is preferable.

$$\{(R^{1a}O)(R^{2a}O)P(=O)O\}_m M \qquad \text{Formula (P)}$$

In Formula (P), $R^{1a}$ represents a substituted or unsubstituted aliphatic group or a substituted or unsubstituted aryl group; $R^{2a}$ represents a hydrogen atom, a metal ion, a substituted or unsubstituted aliphatic group, or a substituted or unsubstituted aryl group; M represents a hydrogen atom, a metal ion, or an ammonium ion; and m has the same valence as that of M and represents a number of from 1 to 6.

Examples of the substituent with which the aliphatic group or the aryl group may be substituted include an aliphatic group (for example, an alkyl group, an alkenyl group, an alkynyl group, a cycloalkyl group, a cycloalkenyl group, a cycloalkynyl group), an aryl group (for example, a phenyl group, a naphthyl group), a heterocyclic group, a halogen atom, a hydroxyl group, an alkoxy group, an alkenoxy group, a cycloalkoxy group, a cycloalkenoxy group, an aryloxy group, a heterocyclic oxy group, a mercapto group, an alkylthio group, an alkenylthio group, an arylthio group, an amino group, an alkylamino group, an aryl amino group, a heterocyclic amino group, an acylamino group, a sulfonamide group, an imido group, a cyano group, a nitro group, a carboxyl group, a sulfo group, a carbamoyl group, and a sulfamoyl group.

Examples of the aliphatic group for $R^{1a}$ or $R^{2a}$ include an alkyl group, an alkenyl group, an alkynyl group, a cycloalkyl group, and a cycloalkenyl group. Examples of the aryl group for $R^{1a}$ or $R^{2a}$ include a phenyl group, and a naphthyl group. These substituents may be substituted with these substituents.

$R^{1a}$ is preferably an aliphatic group; more preferably an alkyl group and an alkenyl group are preferable. $R^{2a}$ is preferably a hydrogen atom, or an aliphatic group; and more preferably a hydrogen atom, an alkyl group or an alkenyl group. Further, these aliphatic group, alkyl group and alkenyl group may be substituted with any one of the above-recited substituents.

When $R^{1a}$ and $R^{2a}$ each are an aliphatic group, $R^{1a}$ and $R^{2a}$ are preferably the following group.

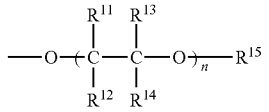

$R^{11}$ to $R^{14}$ each independently represent a hydrogen atom, or a substituent. Examples of the substituent include those groups that the aliphatic group and the aryl group for $R^{1a}$ and $R^{2a}$ in the above-described formula (P) may have. $R^{11}$ to $R^{14}$ are preferably a hydrogen atom, or an alkyl group; especially preferably a hydrogen atom. n represents the number of 0 to 20, and more preferably 1 to 8. $R^{15}$ represents an aliphatic group, or an aryl group.

The aliphatic group for $R^{15}$ is preferably an alkyl group, or an alkenyl group. The number of carbon atoms in these groups is preferably from 6 to 20, and more preferably from 12 to 18. $R^{15}$ may have a substituent. Examples of the substituent include those groups that the aliphatic group and the aryl group for $R^{1a}$ and $R^{2a}$ in the above-described formula (P) may have. The substituent is preferably an substituted aliphatic group.

Examples of the aryl group for $R^{15}$ include a phenyl group and a naphthyl group. The aryl group may have a substituent. Examples of the substituent include those groups that the aliphatic group and the aryl group for $R^{1a}$ and $R^{2a}$ in the above-described formula (P) may have. The substituent is preferably an alkyl group. The number of carbon atoms in the alkyl group in this case is preferably from 6 to 20, and more preferably from 12 to 18.

$R^{15}$ is preferably an aliphatic group, and more preferably a stearyl group or an oleyl group.

Further, an aliphatic group in which n is 0 is also preferable.

M represents a hydrogen atom, a metal ion, or an ammonium ion. The metal ion for M may be a monovalent metal ion, or a polyvalent metal ion. As the monovalent metal ion, alkali metal ions are preferable; lithium, sodium and potassium ions are more preferable; and sodium ion is most preferable. The polyvalent metal ion may be any kinds of polyvalent metal ions excluding alkali metal ions. Examples of the polyvalent metal ion include a magnesium ion, a calcium ion, a zinc ion, a cupper ion, a lead ion, an aluminum ion, an iron ion, a cobalt ion, a chromium ion, and a manganese ion. Among these ions, a magnesium ion, a calcium ion, a zinc ion, and an aluminum ion are preferable; and a zinc ion is most preferable.

As the ammonium ion, those ions represented by the following formula are preferable.

$$^{+}N(R^{A1})(R^{A2})(R^{A3})(R^{A4})$$

In the formula, $R^{A1}$ to $R^{A4}$ each independently represent a hydrogen atom, a substituted or unsubstituted alkyl group, or a substituted or unsubstituted aryl group. Examples of the substituent on the substituted alkyl group and the substituted aryl group include those groups that the aliphatic group and the aryl group for $R^{1a}$ and $R^{2a}$ in the above-described formula (P) may have. Among these substituents, a hydroxyl group and a phenyl group are preferable. Further, any two or three groups of $R^{A1}$ to $R^{A4}$ may combine with each other to form a ring (e.g., pyrrolidine ring, piperidine ring, morpholine ring, piperazine ring, indoline ring, quinuclidine ring, pyridine ring).

$R^{A1}$ to $R^{A4}$ is preferably a hydrogen atom, or a substituted or unsubstituted alkyl group.

As the ammonium ion, $NH_4^+$, $NH(CH_2CH_2OH)_3^+$, $NH_3(CH_2CH_2OH)^+$, morpholinium, $N(CH_2CH_2OH)_4^+$, and $NH_3(C_4H_9)^+$ are preferable; $NH_4^+$, $NH_3(CH_2CH_{20}H)^+$, and morpholinium are more preferable.

When $R^{2a}$ represents a metal ion, examples of the metal ion for $R^{2a}$ include those exemplified for M as described above.

$R^{1A}$ is preferably an alkyl group having 12 to 18 carbon atoms. $R^{2a}$ is preferably a hydrogen atom, a metal ion or an alkyl group having 12 to 18 carbon atoms. One kind of the compound represented by formula (P) may be used. Alternatively, two or more kinds of compounds represented by formula (P) may be used. It is preferable that two or more kinds of compounds represented by formula (P) are used.

Among the compound represented by formula (P), many compounds in which M is a hydrogen atom are commercially available. Examples thereof include NIKKOL DLP-10, NIKKOL DOP-8NV, NIKKOL DDP-2, NIKKOL DDP-4, NIKKOL DDP-6, NIKKOL DDP-8, and NIKKOL DDP-10, (trade names, manufactured by Nikko Chemicals Co., Ltd.); PLYSURF AL, PLYSURF A208F, PLYSURF A208N, PLYSURF A217E, and PLYSURF A219B (trade name, manufactured by DAI-ICHI KOGYO SEIYAKYU Co., Ltd.); Phosphanol RB410, Phosphanol RB710, Phosphanol GF199, Phosphanol LP700, and Phosphanol LB400 (trade name, manufactured by TOHO Chemical Industry Co., LTD.); and Phoslex A-8, Phoslex A-18, and Phoslex A-18D (trade name, manufactured by Sakai Chemical Industry Co., Ltd.). Other examples include dilauryl phosphate, dioleyl phosphate, distearyl phosphate, and di(polyoxyethylene dodecyl phenyl ether) phosphate.

Many compounds in which M is a metal ion are also commercially available. Examples of these commercial products include PLYSURF M208B, and PLYSURF M208F (trade name, manufactured by DAI-ICHI KOGYO SEIYAKU Co., Ltd.); Phosphanol RD720, Phosphanol GF185, Phosphanol GF215, Phosphanol RS710M, and Phosphanol SC6103 (trade name, manufactured by TOHO Chemical Industry Co., LTD.); and LBT-1830, LBT-1830 purified product, LBT-2230, LBT-1813, and LBT-1820 (trade name, manufactured by Sakai Chemical Industry Co., Ltd.). Other examples include zinc dilauryl phosphate, zinc dioleyl phosphate, zinc distearyl phosphate, sodium di(polyoxyethylene nonyl ether) phosphate, sodium di(polyoxyethylene dodecyl phenyl ether) phosphate, sodium di(polyoxyethylene decyl phenyl ether) phosphate, sodium di(polyoxyethylene nonyl ether) phosphate, and potassium di(polyoxyethylene decyl phenyl ether) phosphate.

The total coating amount of the compound represented by formula (P) is preferably from 1% by mass to 25% by mass, and more preferably from 2% by mass to 15% by mass, of the total coating amount of the heat-resistant lubricating layer. The compound represented by formula (P) is preferably solid at a normal temperature.

When the compound represented by formula (P) has low solubility with respect to the coating liquid of the heat-resistant lubricating layer, or does not dissolve in the coating liquid, it is preferable to preliminarily grind the compound to fine powder in order to accelerate dispersion of the compound to the coating liquid of the heat-resistant lubricating layer, or to stabilize the compound in the coating liquid. The particle size of the powder is preferably from 0.1 μm to 100 μm, and more preferably from 1 μm to 30 μm.

In the present invention, the content of the talc in the heat-resistant lubricating layer is preferably 30 parts by mass or more, further preferably 40 parts by mass or more, and still further preferably 50 parts by mass or more, relative to 100 parts by mass of total content of the compound represented by formula (P). The upper limit of the talc content is preferably 1000 parts by mass or less, further preferably 500 parts by mass or less, and still further preferably 400 parts by mass or less.

With respect to the polyvalent metal salt of an alkyl carboxylic acid, the number of carbon atoms in the alkyl carboxylic acid is preferably from 8 to 25, more preferably from 12 to 21, and further preferably from 14 to 20. Examples of the alkyl carboxylic acid include octanoic acid, lauric acid, myristic acid, palmitic acid, stearic acid, and behenic acid. Examples of the polyvalent metal include alkali earth metals and transition metals that are divalent or trivalent metals with specific examples including calcium, magnesium, barium, strontium, cadmium, aluminum, zinc, cupper, and iron. Among these metals, zinc is preferable. Examples of the polyvalent metal salt of an alkyl carboxylic acid include zinc laurate, zinc myristate, zinc palmitate, zinc stearate, zinc behenate, calcium stearate, magnesium myristate, barium stearate, aluminum stearate, and cupper stearate. Among these metal salts, zinc stearate is preferable. These metal salts may be commercially available, or easily synthesized from the corresponding carboxylic acids.

The polyvalent metal salt of an alkyl carboxylic acid is used in an amount of preferably 0.1 parts by mass to 50 parts by mass, and more preferably from 0.5 parts by mass to 10 parts by mass, relative to 100 parts by mass of the resin (binder resin) in the heat-resistant lubricating layer.

The amount of organic material other than these resins contained in the heat-resistant lubricating layer varies in the kind of the additives. The amount is preferably from 0.001% by mass to 50% by mass, and more preferably from 0.01% by mass to 20% by mass, relative to the total amount of the heat-resistant lubricating layer.

The heat-resistant lubricating layer contains a resin. The resin may be a known resin having high heat-resistance. Examples thereof include cellulose resins such as ethylcellulose, hydroxycellulose, hydroxypropylcellulose, methylcellulose, cellulose acetate, cellulose acetate butyrate, cellulose acetate propionate, and nitrocellulose; vinyl-series resins such as polyvinyl alcohol, polyvinyl acetate, polyvinyl butyral, polyvinyl acetal, polyvinyl acetoacetal resin, vinyl chloride-vinyl acetal copolymer and polyvinyl pyrrolidone; (meth)acrylic resins such as methyl polymethacrylate, ethyl polyacrylate, polyacrylamide, and acrylonitrile-styrene copolymer; and natural or synthetic resins such as polyamide resin, polyimide resin, polyamideimide resin, polyvinyl toluene resin, coumarone indene resin, polyester-series resin, polyurethane resin, polyether resin, polybutadiene resin, polycarbonate resin, chlorinated polyolefin resin, fluorine-contained resin, epoxy resin, phenol resin, silicone resin, silicone-modified or fluorine-modified urethane. These may be used alone or in a mixture form.

The resin may be crosslinked by radiating ultraviolet rays or an electron beam thereto in order to make the heat resistance of the resin high. A crosslinking agent may be used to crosslink the resin by aid of heating. At this time, a catalyst may be added thereto. Examples of the crosslinking agent include isocyanate based agents (such as polyisocyanate, and a cyclic trimer of polyisocyanate), and metal-containing agents (such as titanium tetrabutyrate, zirconium tetrabutyrate, and aluminum triisopropionate). Among these, the polyisocyanate-series crosslinking agent is preferable. Examples of the resin with which a crosslinking agent is caused to react include polyvinyl acetal, polyvinyl butyral, polyester polyol, alkyd polyol, and silicone compounds containing, in its side chain, an amino group.

It is known that the heat-resistant lubricating layer is formed by coating and then the layer is put under the high-temperature environment or both high-temperature and high-humidity environment whereby the reaction between the resin and the crosslinking agent is promoted. In the present invention, it is preferable to select conditions for not breaking out a localized structure of the phosphate or the salt thereof represented by formula (P) that is contained in the heat-resistant lubricating layer. Under the conditions, an appropriate combination of the resin and the crosslinking agent may be selected in order to promote the crosslinking reaction sufficiently. Under conditions of 60° C. and a low humidity, preferred is a combination of a resin and a crosslinking agent capable of promoting the crosslinking reaction sufficiently within one day.

As the resin, those having two or more hydroxyl groups at the end of polymer chain or in the polymer structure of the resin are preferable. Herein, the wording "having two or more hydroxyl groups at the end of polymer chain or in the polymer structure of the resin" means that the resin has two or more hydroxyl groups at the end of a polymer chain in the longitudinal direction or in the polymer structure of the resin excluding the end of a polymer chain. Examples of the resin include polyacrylpolyol, polyesterpolyol, and polyetherpolyol. Further, in the present invention, the term "polyacrylpolyol" include polymethacrylpolyol. In the present invention, among these resins, such polyacrylpolyol is preferable.

As the resin having two or more hydroxyl groups at the end of a polymer chain or in the polymer structure of the resin, commercially available resins may be used. Examples of the commercially available resins include TAKELAC (registered trademark) series manufactured by Mitsui Chemicals Inc.; THERMOLAC series manufactured by Soken Chemical & Engineering Co., Ltd.; HITALOID series manufactured by Hitachi Chemical Co., Ltd.; HARIACRON series Harima Chemicals Inc.; ACRYDIC series manufactured by DIC Corporation; and NIPPOLLAN series manufactured by Nippon Polyurethane Industries Co., Ltd.

The hydroxyl value of the resin having two or more hydroxyl groups at the end of a polymer chain or in the polymer structure of the resin is preferably from 5 to 300, and more preferably from 15 to 100, based on the solid content of the resin. The hydroxyl value means mg number of potassium hydroxide equivalent to a hydroxyl group present in 1 g of a sample, as prescribed in JIS K-1557-1. The acid value of such resin is preferably 20 or less, and more preferably from 0 to 10, based on the solid content of the resin. The acid value means mg number of potassium hydroxide necessary to neutralize a free acid present in 1 g of a sample, as prescribed in JIS K-1557-5.

When an isocyanate based crosslinking agent is used to attain the crosslinking, the advance of the crosslinking reaction can be inspected by detecting remaining isocyanate groups through IR spectral analysis. The wording "promote the crosslinking reaction sufficiently" means that the ratio of the intensity of the IR spectrum peak originating from the remaining isocyanate groups in the heat-resistant lubricating layer after the crosslinking reaction to the intensity of the IR spectrum peak originating from the remaining isocyanate groups in the heat-resistant lubricating layer immediately after being formed by coating and dried is 20% or less, preferably 10% or less, most preferably 5% or less.

In order to effectively achieve effects of the present invention, the temperature for accelerating a reaction between the resin and the crosslinking agent is preferably 65° C. or less, further preferably 55° C. or less, and most preferably from 40° C. to 53° C. Further, the time period of accelerating a reaction between the resin and the crosslinking agent is preferably from 12 hours to 40 days, further preferably from 18 hours to 30 days, and most preferably from 1 day to 20 days.

(Base Film)

The base film of the heat-sensitive transfer sheet in the present invention is not limited, so far as such the film has both a heat resistance and a mechanical strength necessary to the requirements for the film. Any of known materials can be used. Specific examples of preferable base films include thin papers such as a glassine paper, a condenser paper, and a paraffin paper; polyesters having high resistance to heat such as polyethyleneterephthalate, polyethylenenaphthalate, and polybuyleneterephthalate; stretched or unstretched films of plastics such as polyphenylene sulfide, polyetherketone, polyethersulfone, polypropylene, polycarbonate, cellulose acetate, polyethylene derivatives, poly(vinyl chloride), poly (vinylidene chloride), polystyrene, polyamide, polyimide, polymethylpentene, and ionomers; and laminates of these materials. Of these materials, polyester films are especially preferred; and stretched polyester films are further preferred. Further, polyester films that are produced by forming an easy adhesion layer on or above at least one surface of the base film, and then stretching the base film are especially preferable.

A thickness of the base film can be properly determined in accordance with the material of the base film so that the mechanical strength and the heat resistance become optimum. Specifically, it is preferred to use a support having a thickness of about 1 μm to about 30 μm, more preferably from about 1 μm to 20 μm, and further preferably from about 3 μm to about 10 μm.

(Treatment for Easy Adhesion)

The surface of the base film may be subjected to treatment for easy adhesion to improve wettability and an adhesive property of the coating liquid. Examples of the treatment include corona discharge treatment, flame treatment, ozone treatment, ultraviolet treatment, radial ray treatment, surface-roughening treatment, chemical agent treatment, vacuum plasma treatment, atmospheric plasma treatment, primer treatment, grafting treatment, and other known resin surface modifying treatments.

An easy adhesion layer (easily-adhesive layer) may be formed on the base film by coating. Examples of the resin used in the easily-adhesive layer include polyester-series resins, polyacrylate-series resins, polyvinyl acetate-series resins, vinyl-series resins such as polyvinyl chloride resin and polyvinyl alcohol resin, polyvinyl acetal-series resins such as polyvinyl acetoacetal and polyvinyl butyral, polyether-series resins, polyurethane-series resins, styrene acrylate-series resins, polyacrylamide-series resins, polyamide-series resins, polystyrene-series resins, polyethylene-series resins, polypropylene-series resins, and polyvinyl pyrrolidone-series resins.

When the base film used for the support is formed by melt extrusion, it is allowable to subject a non-stretched film to coating treatment followed by stretching treatment.

The above-mentioned treatments may be used in combination of two or more thereof.

As mentioned above, films that are produced by forming an easy adhesion layer on or above at least one surface of the base film, and then stretching the base film is preferable in the present invention. In the heat-sensitive transfer film of the present invention, it is preferable to dispose an easy adhesion layer (dye barrier layer) between a dye layer and a base film.

The dye layer containing a heat-transferable dye (hereinafter also referred to as heat transfer layer) can be formed by coating a coating liquid for the dye layer.

(Dye Layer)

In the dye layer in the present invention, preferably, dye layers in individual colors of yellow, magenta and cyan, and an optional dye layer in black are repeatedly coated onto a single base film in area order in such a manner that the colors are divided from each other. An example of the dye layer is an embodiment wherein dye layers in individual colors of yellow, magenta and cyan are coated onto a single base film along the long axial direction thereof in area order, correspondingly to the area of the recording surface of the heat-sensitive transfer image-receiving sheet, in such a manner that the colors are divided from each other. Another example thereof is an embodiment wherein not only the three layers but also a dye layer in black and/or a transferable protective layer (the transferable protective layer may be replaced with a transferable protective layer laminate described below) are coated in such a manner that these layers are divided from each other. This embodiment is also preferred.

In the case of adopting such an embodiment, it is preferred to give marks to the heat-sensitive transfer sheet in order to inform the printer about starting point of the individual colors. Such coating repeated in area order makes it possible that a single heat-sensitive transfer sheet is used to form an image on the basis of transfer of dyes and further laminate a protective layer on the image.

In the present invention, however, the manner in which the dye layer is formed is not limited to the above-mentioned manners. A sublimation heat-transferable ink layer and a heat-melt transferable ink layer may be together formed. A dye layer in a color other than yellow, magenta, cyan and black is formed, or other modifications may be made. The form of the heat-sensitive transfer sheet including the dye layer may be a longitudinal form, or a one-piece form. In particular, the heat-sensitive transfer sheet including the dye layer can be used when being stored in the state that the heat-sensitive transfer sheet before use overlaps from each other.

(Coating Liquid for Dye Layer)

The dye layer contains at least a sublimation type dye (also referred to as "dye") and a binder resin. It is a preferable embodiment of the present invention that the coating liquid may contain organic or inorganic finely divided powder, waxes, silicone resins, and fluorine-containing organic compounds, in accordance with necessity.

Each dye in the heat-sensitive transfer sheet of the present invention is preferably contained in an amount of 20 to 80 mass %, preferably in that of 30 to 70 mass % of the dye layer.

The coating of the dye layer is performed by an ordinary method such as roll coating, bar coating, gravure coating, or gravure reverse coating. The coating amount of the dye layer is preferably from 0.1 to 2.0 g/m$^2$, more preferably from 0.2 to 1.2 g/m$^2$ (the amount is a numerical value converted to the solid content in the layer; any coating amount in the following description is a numerical value converted to the solid content unless otherwise specified). The film thickness of the dye layer is preferably from 0.1 to 2.0 μm, more preferably from 0.2 to 1.2 μm.

The dye layer may have a mono-layered structure or a multi-layered structure. In the case of the multi-layered structure, the individual layers constituting the dye layer may be the same or different in composition.

(Dye)

The dye used in the present invention, preferably in the first embodiment of the present invention, is not limited, as long as it is able to diffuse by heat and able to be incorporated in a heat-sensitive transfer sheet, and able to transfer by heat from the heat-sensitive transfer sheet to an image-receiving sheet. As the dye used for the heat-sensitive transfer sheet, ordinarily used dyes or known dyes can be effectively used.

Preferable examples of the dye include diarylmethane-series dyes, triarylmethane-series dyes, thiazole-series dyes, methine-series dyes such as merocyanine; azomethine-series dyes typically exemplified by indooniline, acetophenoneazomethine, pyrazoloazomethine, imidazole azomethine, imidazo azomethine, and pyridone azomethine; xanthene-series dyes; oxazine-series dyes; cyanomethylene-series dyes typically exemplified by dicyanostyrene, and tricyanostyrene; thiazine-series dyes; azine-series dyes; acridine-series dyes; benzene azo-series dyes; azo-series dyes such as pyridone azo, thiophene azo, isothiazole azo, pyrrol azo, pyralazo, imidazole azo, thiadiazole azo, triazole azo, and disazo; spiropyran-series dyes; indolinospiropyran-series dyes; fluoran-series dyes; rhodaminelactam-series dyes; naphthoquinone-series dyes; anthraquinone-series dyes; and quinophthalon-series dyes.

Specific examples of the yellow dye that can be used in the present invention, preferably in the first embodiment of the present invention, include Disperse Yellow 231, Disperse Yellow 201 and Solvent Yellow 93. Specific examples of the magenta dye that can be used in the present invention, preferably in the first embodiment of the present invention, include Disperse Violet 26, Disperse Red 60, and Solvent Red 19. Specific examples of the cyan dye that can be used in the present invention, preferably in the first embodiment of the present invention, include Solvent Blue 63, Solvent Blue 36, Disperse Blue 354 and Disperse Blue 35. As a matter of course, it is also possible to use suitable dyes other than these dyes as exemplified above. Further, dyes each having a different hue from each other as described above may be arbitrarily combined together.

In the present invention, particularly in the second embodiment of the present invention, the transferable dye is a yellow dye represented by formula (1). Next, the dye represented by formula (1) is explained in detail.

Formula (1)

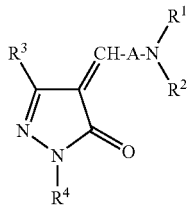

In formula (1), A represents a substituted or unsubstituted arylene group (the number of carbon atoms is preferably from 6 to 12; more preferably a phenylene group, for example, p-phenylene group); $R^1$ and $R^2$ each independently represent a hydrogen atom, a substituted or unsubstituted alkyl group (the number of carbon atoms is preferably from 1 to 10; for example, a methyl group, an ethyl group, a n-propyl group, an isopropyl group, a n-butyl group, a n-octyl group), a substituted or unsubstituted alkenyl group (the number of carbon atoms is preferably from 2 to 10; for example, a vinyl group, an allyl group, a 1-propenyl group), or a substituted or unsubstituted aryl group (the number of carbon atoms is preferably from 6 to 12; for example, a phenyl group, a naphthyl group); $R^3$ represents a hydrogen atom, a substituted or unsubstituted alkyl group (the number of carbon atoms is preferably from 1 to 10; for example, a methyl group, an ethyl group, a n-propyl group, an isopropyl group, a n-butyl group, a n-octyl group), a substituted or unsubstituted aryl group (the number of carbon atoms is preferably from 6 to 12; for example, a phenyl group, a naphthyl group), a substituted or unsubstituted amino group (the number of carbon atoms is preferably from 0 to 12; for example, an amino group, an alkylamino group, an anilino group, an acylamino group, a sulfonamido group, an ureido group, an urethane group), a substituted or unsubstituted alkoxy group (the number of carbon atoms is preferably from 1 to 10; for example, a methoxy group, an ethoxy group, a n-propyloxy group, an isopropyloxy group, a n-butoxy group, a n-octyloxy group), a substituted or unsubstituted aryloxy group (the number of carbon atoms is preferably from 6 to 12; for example, a phenoxy group), a substituted or unsubstituted alkoxycarbonyl group (the number of carbon atoms is preferably from 2 to 11; for example, a methoxycarbonyl group, an ethoxycarbonyl group, a n-propoxycarbonyl group, an isopropoxycarbonyl group, a n-butoxycarbonyl group, a n-octyloxycarbonyl group), a substituted or unsubstituted aryloxycarbonyl group (the number of carbon atoms is preferably from 7 to 13; for example, a phenoxycarbonyl group), or a substituted or unsubstituted carbamoyl group (the number of carbon atoms is preferably from 1 to 13; for example, a carbamoyl group, a N-methylcarbamoyl group, a N-ethylcarbamoyl group, a N-phenylcarbamoyl group, a N,N-dimethylcarbamoyl group); and $R^4$ represents a substituted or unsubstituted alkyl group (the number of carbon atoms is preferably from 1 to 10; for example, a methyl group, an ethyl group, a n-propyl group, an isopropyl group, a n-butyl group, a n-octyl group), or a substituted or unsubstituted aryl group (the number of carbon atoms is preferably from 6 to 12; for example, a phenyl group).

Hereinafter, the substituents which the groups represented by A, $R^1$, $R^2$, $R^3$, and $R^4$ may have will be more specifically described.

Examples of such substituent are described below. Specific examples of each substituent as well as preferable groups of each substituent are described below.

The halogen atom that A, $R^1$, $R^2$, $R^3$, and $R^4$ may have includes a fluorine atom, a chlorine atom, a bromine atom, and an iodine atom. Of these, a chlorine atom and a bromine atom are preferable, a chlorine atom is particularly preferable.

The aliphatic group that A, $R^1$, $R^2$, $R^3$, and $R^4$ may have includes a linear, branched or cyclic aliphatic group. The term "cyclic aliphatic group" means a cyclic aliphatic group, such as a cycloalkyl group, a cycloalkenyl group, a cycloalkynyl group, a bicycloalkyl group and the like. The saturated aliphatic group includes an alkyl group, a cycloalkyl group and bicycloalkyl group and these groups may have a substituent. The number of carbon atoms of these groups is preferably from 1 to 30. Examples of the alkyl group include methyl, ethyl, n-propyl, isopropyl, t-butyl, n-octyl, eicosyl, 2-chloroethyl, 2-cyanoethyl, benzyl and 2-ethylhexyl. The cycloalkyl group includes a substituted or unsubstituted cycloalkyl group. The substituted or unsubstituted cycloalkyl group is preferably a cycloalkyl group having 3 to 30 carbon atoms. Examples of the cycloalkyl group include cyclohexyl, cyclopentyl and 4-n-dodecylcyclohexyl. The bicycloalkyl group includes a substituted or unsubstituted bicycloalkyl group having 5 to 30 carbon atoms, i.e., a monovalent group obtained by removing one hydrogen atom from a bicycloalkane having 5 to 30 carbon atoms. Examples of the bicycloalkyl group include bicyclo[1.2.2]heptan-2-yl or bicyclo[2.2.2]octan-3-yl, and a tricyclo or higher structure having three or more ring structures.

The unsaturated aliphatic group that A, $R^1$, $R^2$, $R^3$, and $R^4$ may have includes a linear, branched, or cyclic unsaturated aliphatic group. The unsaturated aliphatic group includes an alkenyl group, a cycloalkenyl group, a bicycloalkenyl group and an alkynyl group. The alkenyl group represents a substituted or unsubstituted alkenyl group. The alkenyl group preferably has 2 to 30 carbon atoms. Examples of the alkenyl group include vinyl, allyl, prenyl, geranyl, and oleyl. The cycloalkenyl group is preferably a substituted or unsubstituted cycloalkenyl group having 3 to 30 carbon atoms, i.e., a monovalent group obtained by removing one hydrogen atom from a cycloalkene having 3 to 30 carbon atoms. Examples of the cycloalkenyl group include 2-cyclopenten-1-yl and 2-cyclohexen-1-yl. The bicycloalkenyl group includes a substituted or unsubstituted bicycloalkenyl group, and preferably a substituted or unsubstituted bicycloalkenyl group having 5 to 30 carbon atoms, i.e., a monovalent group obtained by removing one hydrogen atom from a bicycloalkene having one double bond. Examples of the bicycloalkenyl group include bicyclo[2.2.1]hept-2-en-1-yl and a bicyclo[2.2.2]oct-2-en-4-yl. The alkynyl group is preferably a substituted or unsubstituted alkynyl group having 2 to 30 carbon atoms, e.g., ethynyl and propargyl.

The aryl group that A, $R^2$, $R^3$, and $R^4$ may have is preferably a substituted or unsubstituted aryl group having 6 to 30 carbon atoms, e.g., phenyl, p-tolyl, naphthyl, m-chlorophenyl, and o-hexadecanoylaminophenyl. The aryl group is more preferably a substituted or unsubstituted phenyl group.

The heterocyclic group that A, $R^1$, $R^2$, $R^3$, and $R^4$ may have, is a monovalent group obtained by removing one hydrogen atom from a substituted or unsubstituted, aromatic or nonaromatic heterocyclic compound, which may be condensed to another ring. The heterocyclic group is preferably a 5- or 6-membered heterocyclic group. The hetero atom(s) constituting the heterocyclic group is preferably an oxygen atom, a sulfur atom, or a nitrogen atom. The heterocyclic group is more preferably a 5- or 6-membered aromatic heterocyclic group having 3 to 30 carbon atoms. The hetero ring in the heterocyclic group are exemplified below: a pyridine ring, a pyrazine ring, a pyridazine ring, a pyrimidine ring, a triazine ring, a quinoline ring, an isoquinoline ring, a quinazoline ring, a cinnoline ring, a phthalazine ring, a quinoxaline ring, a pyrrole ring, an indole ring, a furan ring, a benzofuran ring, a thiophene ring, a benzothiophene ring, a pyrazole ring, an imidazole ring, a benzimidazole ring, a triazole ring, an oxazole ring, a benzoxazole ring, a thiazole ring, a benzothiazole ring, an isothiazole ring, a benzisothiazole ring, a thiadiazole ring, an isoxazole ring, a benzisoxazole ring, a pyrrolidine ring, a piperidine ring, a piperazine ring, an imidazolidine ring and a thiazoline ring.

The aliphatic oxy group (as a representative example, an alkoxy group) that A, $R^1$, $R^2$, $R^3$ and $R^4$ may have includes a substituted or unsubstituted aliphatic oxy group (as a representative example, alkoxy group). The substituted or unsubstituted aliphatic oxy group is preferably an aliphatic oxy group having 1 to 30 carbon atoms, e.g., methoxy, ethoxy, isopropoxy, n-octyloxy, methoxyethoxy, hydroxyethoxy, and 3-carboxypropoxy.

The aryloxy group that A, $R^1$, $R^2$, $R^3$, and $R^4$ may have is preferably a substituted or unsubstituted aryloxy group having 6 to 30 carbon atoms, e.g., phenoxy, 2-methylphenoxy, 4-t-butylphenoxy, 3-nitrophenoxy, and 2-tetradecanoylaminophenoxy. The aryloxy group is more preferably a phenoxy group which may have a substituent.

The acyloxy group that A, $R^1$, $R^2$, $R^3$, and $R^4$ may have is preferably a formyloxy group, a substituted or unsubstituted alkylcarbonyloxy group having 2 to 30 carbon atoms, or a substituted or unsubstituted arylcarbonyloxy group having 7 to 30 carbon atoms, e.g., formyloxy, acetyloxy, pivaloyloxy, stearoyloxy, benzoyloxy, and p-methoxyphenylcarbonyloxy.

The carbamoyloxy group that A, $R^1$, $R^2$, $R^3$, and $R^4$ may have is preferably a substituted or unsubstituted carbamoyloxy group having 1 to 30 carbon atoms, e.g., N,N-dimethylcarbamoyloxy, N,N-diethylcarbamoyloxy, morpholinocarbonyloxy, N,N-di-n-octylaminocarbonyloxy, and N-n-octylcarbamoyloxy.

The aliphatic oxy carbonyloxy group (as a representative example, an alkoxycarbonyloxy group) that A, $R^1$, $R^2$, $R^3$, and $R^4$ may have is preferably an aliphatic oxy carbonyloxy group having 2 to 30 carbon atoms. The aliphatic oxy carbonyloxy group may have a substituent(s). There can be exemplified methoxycarbonyloxy, ethoxycarbonyloxy, t-butoxycarbonyloxy, and n-octylcarbonyloxy.

The aryloxycarbonyloxy group that A, $R^1$, $R^2$, $R^3$, and $R^4$ may have is preferably a substituted or unsubstituted aryloxycarbonyloxy group having 7 to 30 carbon atoms, e.g., phenoxycarbonyloxy, p-methoxyphenoxycarbonyloxy, and p-n-hexadecyloxyphenoxycarbonyloxy. The aryloxycarbonyloxy group is more preferably a substituted or unsubstituted phenoxycarbonyloxy group.

The amino group that A, $R^1$, $R^2$, $R^3$, and $R^4$ may have includes an unsubstituted amino group, an aliphatic amino group (as a representative example, an alkylamino group), an arylamino group, and a heterocyclic amino group. The amino group is preferably a substituted or unsubstituted aliphatic amino group (as a representative example, alkylamino group) having 1 to 30 carbon atoms, or a substituted or unsubstituted arylamino group having 6 to 30 carbon atoms, e.g., amino, methylamino, dimethylamino, anilino, N-methyl-anilino, diphenylamino, hydroxyethylamino, carboxyethylamino, sulfoethylamino, 3,5-dicarboxyanilino, and 4-quinolylamino.

The acylamino group that A, $R^1$, $R^2$, $R^3$, and $R^4$ may have is preferably a formylamino group, a substituted or unsubstituted alkylcarbonylamino group having 2 to 30 carbon atoms, or a substituted or unsubstituted arylcarbonylamino group having 7 to 30 carbon atoms, e.g., formylamino, acetylamino, pivaloylamino, lauroylamino, benzoylamino, and 3,4,5-tri-n-octyloxyphenylcarbonylamino.

The aminocarbonylamino group that A, $R^1$, $R^2$, $R^3$, and $R^4$ may have is preferably a substituted or unsubstituted aminocarbonylamino group having 1 to 30 carbon atoms, e.g., carbamoylamino, N,N-dimethylaminocarbonylamino, N,N-diethylaminocarbonylamino, and morpholinocarbonylamino. In the aminocarbonylamino group, the term "amino" means that the amino moiety in this group has the same meaning as the above-described amino group. These are also applied to other groups.

The aliphatic oxy carbonylamino group (as a representative example, alkoxycarbonylamino group) that A, $R^1$, $R^2$, $R^3$, and $R^4$ may have is preferably a substituted or unsubstituted aliphatic oxy carbonylamino group having 2 to 30 carbon atoms, e.g., methoxycarbonylamino, ethoxycarbonylamino, t-butoxycarbonylamino, n-octadecyloxycarbonylamino, and N-methyl-methoxycarbonylamino.

The aryloxycarbonylamino group that A, $R^1$, $R^2$, $R^3$, and $R^4$ may have is preferably a substituted or unsubstituted aryloxycarbonylamino group having 7 to 30 carbon atoms, e.g., phenoxycarbonylamino, p-chlorophenoxycarbonylamino, and m-n-octyloxyphenoxycarbonylamino. The aryloxycarbonylamino group is more preferably substituted or unsubstituted phenoxycarbonylamino group.

The sulfamoylamino group that A, $R^1$, $R^2$, $R^3$, and $R^4$ may have is preferably a substituted or unsubstituted sulfamoylamino group having 0 to 30 carbon atoms, e.g., sulfamoylamino, N,N-dimethylaminosulfonylamino, and N-n-octylaminosulfonylamino.

The aliphatic- (as a representative example, alkyl-) or arylsulfonylamino group that A, $R^1$, $R^2$, $R^3$, and $R^4$ may have is preferably a substituted or unsubstituted aliphatic sulfonylamino group (as a representative example, alkylsulfonylamino group) having 1 to 30 carbon atoms, or a substituted or unsubstituted arylsulfonylamino group having 6 to 30 carbon atoms (preferably a substituted or unsubstituted phenylsulfonylamino group), e.g., methylsulfonylamino, butylsulfonylamino, phenylsulfonylamino, 2,3,5-trichlorophenylsulfonylamino, and p-methylphenylsulfonylamino.

The aliphatic thio group (as a representative example, alkylthio group) that A, $R^1$, $R^2$, $R^3$, and $R^4$ may have is preferably a substituted or unsubstituted alkylthio group having 1 to 30 carbon atoms, e.g., methylthio, ethylthio, and n-hexadecylthio.

The sulfamoyl group that A, $R^1$, $R^2$, $R^3$, and $R^4$ may have is preferably a substituted or unsubstituted sulfamoyl group having 0 to 30 carbon atoms, e.g., N-ethylsulfamoyl, N-(3-dodecyloxypropyl)sulfamoyl, N,N-dimethylsulfamoyl, N-acetylsulfamoyl, N-benzoylsulfamoly, and N—(N'-phenylcarbamoyl)sulfamoyl.

The aliphatic- (as a representative example, alkyl-) or arylsulfinyl group that A, $R^1$, $R^2$, $R^3$, and $R^4$ may have is preferably a substituted or unsubstituted aliphatic sulfinyl group having 1 to 30 carbon atoms, or a substituted or unsubstituted arylsulfinyl group (preferably a substituted or unsubstituted phenylsulfinyl group) having 6 to 30 carbon atoms, e.g., methylsulfinyl, ethylsulfinyl, phenylsulfinyl, and p-methylphenylsulfinyl group.

The aliphatic- (as a representative example, alkyl-) or arylsulfonyl group that A, $R^1$, $R^2$, $R^3$, and $R^4$ may have is preferably a substituted or unsubstituted aliphatic-sulfonyl group (as a representative example, alkylsulfonyl group) having 1 to 30 carbon atoms, or a substituted or unsubstituted arylsulfonyl group (preferably a substituted or unsubstituted phenylsulfonyl group) having 6 to 30 carbon atoms, e.g., methylsulfonyl, ethylsulfonyl, phenylsulfonyl, and p-toluenesulfonyl.

The acyl group that A, $R^1$, $R^2$, $R^3$, and $R^4$ may have is preferably a formyl group, a substituted or unsubstituted aliphatic carbonyl group (as a representative example, alkylcarbonyl group) having 2 to 30 carbon atoms, a substituted or unsubstituted arylcarbonyl group (preferably a substituted or unsubstituted phenylcarbonyl group) having 7 to 30 carbon atoms, or a substituted or unsubstituted heterocyclic carbonyl group having 4 to 30 carbon atoms and being bonded to said carbonyl group through a carbon atom, e.g., acetyl, pivaloyl, 2-chloroacetyl, stearoyl, benzoyl, p-n-octyloxyphenylcarbonyl, 2-pyridylcarbonyl, and 2-furylcarbonyl.

The aryloxycarbonyl group that A, $R^1$, $R^2$, $R^3$, and $R^4$ may have is preferably a substituted or unsubstituted aryloxycarbonyl group having 7 to 30 carbon atoms, e.g., phenoxycarbonyl, o-chlorophenoxycarbonyl, m-nitrophenoxycarbonyl, and p-t-butylphenoxycarbonyl. The aryloxycarbonyl group is more preferably a substituted or unsubstituted phenoxycarbonyl group.

The aliphatic oxycarbonyl group (as a representative example, alkoxycarbonyl group) that A, $R^1$, $R^2$, $R^3$, and $R^4$ may have is preferably an aliphatic oxycarbonyl group having 2 to 30 carbon atoms, e.g., methoxycarbonyl, ethoxycarbonyl, t-butoxycarbonyl, and n-octadecyloxycarbonyl. The aliphatic oxycarbonyl group may have a substituent(s).

The carbamoyl group that A, $R^1$, $R^2$, $R^3$, and $R^4$ may have is preferably a substituted or unsubstituted carbamoyl group having 1 to 30 carbon atoms, e.g., carbamoyl, N-methylcarbamoyl, N,N-dimethylcarbamoyl, N,N-di-n-octylcarbamoyl, and N-(methylsulfonyl)carbamoyl.

Examples of the aryl- or heterocyclic-azo group that A, $R^1$, $R^2$, $R^3$, and $R^4$ may have include phenylazo, 4-methoxyphenylazo, 4-pivaloylaminophenylazo, and 2-hydroxy-4-propanoylphenylazo.

Examples of the imido group that A, $R^1$, $R^2$, $R^3$, and $R^4$ may have include N-succinimido and N-phthalimido group.

In addition to these substituents, examples of the substituent that A, $R^1$, $R^2$, $R^3$, and $R^4$ may have include a hydroxyl, a cyano, a nitro, a sulfo group and a carboxyl group.

Each of these groups described as examples of the substituent that each A, $R^1$, $R^2$, $R^3$, and $R^4$ may have, further may have a substituent. Examples of the substituent include the above-mentioned substituents.

A represents a substituted or unsubstituted arylene group; preferably a substituted or unsubstituted phenylene group; more preferably a phenylene group substituted with a methyl group or a chlorine atom, or an unsubstituted phenylene group; and most preferably an unsubstituted phenylene group. Further, the phenylene group of A is preferably a p-phenylene group.

$R^1$ is preferably a substituted or unsubstituted alkyl group (preferably an alkyl group having 1 to 8 carbon atoms), an allyl group, or a substituted or unsubstituted aryl group (preferably an aryl group having 6 to 10 carbon atoms); more preferably a substituted or unsubstituted alkyl group (preferably an alkyl group having 1 to 6 carbon atoms), or an allyl group; further preferably a substituted or unsubstituted alkyl group (preferably an alkyl group having 1 to 4 carbon atoms); and most preferably an ethyl group.

$R^2$ is preferably a substituted or unsubstituted alkyl group (preferably an alkyl group having 1 to 8 carbon atoms), an allyl group, or a substituted or unsubstituted aryl group (preferably an aryl group having 6 to 10 carbon atoms); more preferably a substituted or unsubstituted alkyl group (preferably an alkyl group having 1 to 6 carbon atoms), or an allyl group; further preferably a substituted or unsubstituted alkyl group (preferably an alkyl group having 1 to 4 carbon atoms); and most preferably an ethyl group.

$R^3$ is preferably a substituted or unsubstituted amino group, or a substituted or unsubstituted alkoxy group; more preferably a dialkylamino group (preferably a dialkylamino group having 2 to 8 carbon atoms), an unsubstituted amino group, or an unsubstituted alkoxy group (preferably an unsubstituted alkoxy group having 1 to 6 carbon atoms); further preferably a dialkylamino group (preferably a dialkylamino group having 2 to 4 carbon atoms), or an unsubstituted alkoxy group (preferably an unsubstituted alkoxy group having 1 to 4 carbon atoms); furthermore preferably an unsubstituted alkoxy group (preferably an unsubstituted alkoxy group having 1 to 4 carbon atoms); and most preferably an ethoxy group.

$R^4$ is preferably a substituted or unsubstituted alkyl group having 1 to 8 carbon atoms, or a substituted or unsubstituted aryl group (preferably an aryl group having 6 to 10 carbon atoms); more preferably a substituted or unsubstituted alkyl group having 1 to 6 carbon atoms, or a substituted or unsubstituted aryl group (preferably an aryl group having 6 to 10 carbon atoms); further preferably a substituted or unsubstituted aryl group (preferably an aryl group having 6 to 10 carbon atoms); furthermore preferably an unsubstituted phenyl group; and most preferably an unsubstituted phenyl group.

The following is an explanation about a preferable combination of various substituents (atoms) that a dye represented by formula (1) may have (combination of A, $R^1$, $R^2$, $R^3$ and $R^4$): A preferred dye is a compound in which at least one of the substituents is the above-described preferable substituent. A more preferred dye is a compound in which many various substituents are the above-described preferable substituents. The most preferred dye is a compound in which all substituents are the above-described preferable substituents.

Examples of a preferred combination of A, $R^1$, $R^2$, $R^3$ and $R^4$ in the dye represented by formula (1) include combinations wherein A is a substituted or unsubstituted phenylene group; $R^1$ is a substituted or unsubstituted alkyl group having 1 to 8 carbon atoms, an allyl group, or a substituted or unsubstituted aryl group having 6 to 10 carbon atoms; $R^2$ is a substituted or unsubstituted alkyl group having 1 to 8 carbon atoms, an allyl group, or a substituted or unsubstituted aryl group having 6 to 10 carbon atoms; $R^3$ is a substituted or unsubstituted amino group, or a substituted or unsubstituted alkoxy group; and $R^4$ is a substituted or unsubstituted alkyl group having 1 to 8 carbon atoms, or a substituted or unsubstituted aryl group having 6 to 10 carbon atoms.

In more preferred combinations thereof, A is a substituted or unsubstituted phenylene group; $R^1$ is a substituted or unsubstituted alkyl group having 1 to 6 carbon atoms, an allyl group, or a substituted or unsubstituted phenyl group; $R^2$ is a substituted or unsubstituted alkyl group having 1 to 6 carbon atoms, an allyl group, or a substituted or unsubstituted phenyl group; $R^3$ is a substituted or unsubstituted amino group, or a substituted or unsubstituted alkoxy group; and $R^4$ is a substituted or unsubstituted alkyl group having 1 to 6 carbon atoms, or a substituted or unsubstituted phenyl group.

In most preferred combinations thereof, A is a substituted phenylene group substituted with a methyl group or a chlorine atom, or an unsubstituted phenylene group; $R^1$ is a substituted or unsubstituted alkyl group having 1 to 4 carbon atoms, or an allyl group; $R^2$ is a substituted or unsubstituted alkyl group having 1 to 4 carbon atoms, or an allyl group; $R^3$ is a substituted or unsubstituted amino group, or a substituted or unsubstituted alkoxy group; and $R^4$ is a substituted or unsubstituted phenyl group.

Among the dyes represented by formula (1), dyes that are not commercially available may be synthesized according to dehydration condensation reaction of a pyrazolone derivative and an aminobenzaldehyde as conventionally carried out.

Specific examples of the yellow dye represented by formula (1) are described below. However, the yellow dyes that can be used in the present invention, particularly in the second embodiment of the present invention, should not be construed as being limited to the below-described specific examples.

TABLE 1

Specific examples of yellow dyes represented by formula (1)

| No. | A | $R^1$ | $R^2$ | $R^3$ | $R^4$ |
|---|---|---|---|---|---|
| Y1 | 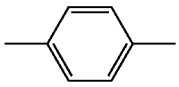 | n-Propyl | n-Propyl | Ethoxy | Phenyl |

TABLE 1-continued

Specific examples of yellow dyes represented by formula (1)

| No. | A | $R^1$ | $R^2$ | $R^3$ | $R^4$ |
|---|---|---|---|---|---|
| Y2 | 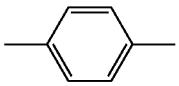 | n-Butyl | n-Butyl | Ethoxy | Phenyl |
| Y3 | 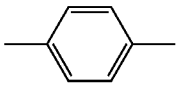 | Ethyl | Ethyl | Dimethyl-amino | Phenyl |
| Y4 | 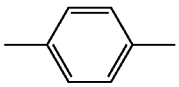 | Ethyl | Ethyl | Ethoxy | Phenyl |

The dye represented by formula (1) that can be used in the present invention, particularly in the second embodiment of the present invention, may be used together with other dyes. The dye that may be used together with the dye of formula (1) are not limited so long as the dye is able to diffuse by heat, and may be incorporated in the heat-sensitive transfer sheet, and further the dye transfers by heat from the heat-sensitive transfer sheet to the heat-sensitive image-receiving sheet. As such dyes, it is possible to use dyes that are conventionally used or known as dyes for the heat-sensitive transfer sheet.

Preferred examples of the dyes that may be used together with the yellow dye of formula (1) include those described as preferable dyes that can be particularly preferably used in the first embodiment of the present invention.

Specific examples of the dye that may be used together with the yellow dye of formula (1) include those described as specific examples of the dye that can be particularly preferably used in the first embodiment of the present invention. However, the present invention is not limited to these examples. Further, an arbitrary combination of dyes each having color hue as described above is also possible.

In the present invention, particularly in the third embodiment of the present invention, the transferable dye is a magenta dye represented by formula (2). Next, the dye represented by formula (2) is explained in detail.

Formula (2)

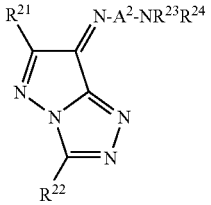

In formula (2), $A^2$ represents a substituted or unsubstituted arylene group (preferably a substituted or unsubstituted arylene group having 6 to 12 carbon atoms; more preferably a phenylene group, for example, a p-phenylene group), or a divalent substituted or unsubstituted pyridine ring group (preferably a pyridine ring group having 5 to 11 carbon atoms, such as a pyridine-2,5-diyl group); and $R^{21}$, $R^{22}$, $R^{23}$ and $R^{24}$ each independently represent a substituted or unsubstituted alkyl group (preferably a substituted or unsubstituted alkyl group having 1 to 10 carbon atoms, such as a methyl group, an ethyl group, a n-propyl group, an isopropyl group, a n-butyl group, a n-octyl group), a substituted or unsubstituted alkenyl group (preferably a substituted or unsubstituted alkenyl group having 2 to 10 carbon atoms, such as a vinyl group, an allyl group, a 1-propenyl group), or a substituted or unsubstituted aryl group (preferably a substituted or unsubstituted aryl group having 6 to 12 carbon atoms such as a phenyl group, a naphthyl group).

Hereinafter, the substituents which the groups represented by $A^2$, $R^{21}$, $R^{22}$, $R^{23}$, and $R^{24}$ may have will be more specifically described. Examples of the substituents which the groups represented by $A^2$, $R^{21}$, $R^{22}$, $R^{23}$, and $R^{24}$ may have are the same as those exemplified as the examples of the substituents which the groups represented by A, $R^1$, $R^2$, $R^3$, and $R^4$ in formula (1); and preferable ranges are also the same.

Each of these groups described as examples of the substituent that each $A^2$, $R^{21}$, $R^{22}$, $R^{23}$, and $R^{24}$ may have, further may have a substituent. Examples of the substituent include the above-mentioned substituents.

$A^2$ is preferably a substituted or unsubstituted divalent pyridine ring group, or an unsubstituted phenylene group (preferably p-phenylene group) (more preferably a substituted or unsubstituted divalent pyridine ring group); more preferably a substituted divalent pyridine ring group substituted with an alkyl group having 1 to 2 carbon atoms, or an unsubstituted phenylene group; further preferably a substituted divalent pyridine ring group substituted with an alkyl group having 1 to 2 carbon atoms; and particularly preferably a 6-methyl-pyridine-2,5-diyl group.

$R^{21}$ is preferably a substituted or unsubstituted alkyl group (preferably a substituted or unsubstituted alkyl group having 1 to 8 carbon atoms) or a substituted or unsubstituted aryl group (preferably a substituted or unsubstituted aryl group having 6 to 10 carbon atoms) (among these, a substituted or unsubstituted alkyl group having 1 to 8 carbon atoms is preferable); more preferably a substituted or unsubstituted alkyl group having 1 to 6 carbon atoms or a substituted or unsubstituted phenyl group; most preferably a substituted or unsubstituted alkyl group having 1 to 4 carbon atoms; and particularly preferably a t-butyl group.

$R^{22}$ is preferably a substituted or unsubstituted alkyl group (preferably a substituted or unsubstituted alkyl group having 1 to 8 carbon atoms) or a substituted or unsubstituted aryl group (preferably a substituted or unsubstituted aryl group having 6 to 10 carbon atoms) (among these, a substituted or unsubstituted aryl having 6 to 10 carbon atoms is preferable); more preferably a substituted or unsubstituted alkyl group having 1 to 6 carbon atoms or a substituted or unsubstituted phenyl group; further preferably a substituted or unsubstituted phenyl group; especially preferably a phenyl group substituted with an alkyl group; and most preferably a 3-methylphenyl group.

$R^{23}$ is preferably a substituted or unsubstituted alkyl group (preferably a substituted or unsubstituted alkyl group having 1 to 8 carbon atoms) or a substituted or unsubstituted aryl group (preferably a substituted or unsubstituted aryl group having 6 to 10 carbon atoms) (among these, a substituted or unsubstituted alkyl group having 1 to 8 carbon atoms is preferable); more preferably a substituted or unsubstituted alkyl group having 1 to 6 carbon atoms or a substituted or unsubstituted phenyl group; further preferably a substituted or unsubstituted alkyl group having 1 to 4 carbon atoms; and particularly preferably an ethyl group.

$R^{24}$ is preferably a substituted or unsubstituted alkyl group (preferably a substituted or unsubstituted alkyl group having 1 to 8 carbon atoms) or a substituted or unsubstituted aryl group (preferably a substituted or unsubstituted aryl group having 6 to 10 carbon atoms) (among these, a substituted or unsubstituted alkyl group having 1 to 8 carbon atoms is preferable); more preferably a substituted or unsubstituted alkyl group having 1 to 6 carbon atoms or a substituted or unsubstituted phenyl group; further preferably a substituted or unsubstituted alkyl group having 1 to 4 carbon atoms; and particularly preferably an ethyl group.

The following is an explanation about a preferable combination of various substituents (atoms) that a dye represented by formula (2) may have (combination of $A^2$, $R^{21}$, $R^{22}$, $R^{23}$ and $R^{24}$): A preferred compound is a compound in which at least one of the substituents is the above-described preferable substituent. A more preferred compound is a compound in which many various substituents are the above-described preferable substituents. The most preferred compound is a compound in which all substituents are the above-described preferable substituents.

Examples of a preferred combination of the dye represented by the formula (2) (combination of $A^2$, $R^{21}$, $R^{22}$, $R^{23}$ and $R^{24}$) include combinations wherein $A^2$ is a substituted or unsubstituted divalent pyridine ring group or an unsubstituted phenylene group, $R^{21}$ is a substituted or unsubstituted alkyl group having 1 to 8 carbon atoms or a substituted or unsubstituted aryl group having 6 to 10 carbon atoms, $R^{22}$ is a substituted or unsubstituted alkyl group having 1 to 8 carbon atoms or a substituted or unsubstituted aryl group having 6 to 10 carbon atoms, $R^{23}$ is a substituted or unsubstituted alkyl group having 1 to 8 carbon atoms, and $R^{24}$ is a substituted or unsubstituted alkyl group having 1 to 8 carbon atoms.

In more preferred combinations thereof, $A^2$ is a substituted or unsubstituted divalent pyridine ring group or an unsubstituted phenylene group, $R^{21}$ is a substituted or unsubstituted alkyl group having 1 to 6 carbon atoms, $R^{22}$ is a substituted or unsubstituted alkyl group having 1 to 6 carbon atoms, $R^{23}$ is a substituted or unsubstituted alkyl group having 1 to 6 carbon atoms, and $R^{24}$ is a substituted or unsubstituted alkyl group having 1 to 6 carbon atoms.

In most preferred combinations thereof, $A^2$ is a substituted or unsubstituted divalent pyridine ring group or an unsubstituted phenylene group, $R^{21}$ is a substituted or unsubstituted alkyl group having 1 to 4 carbon atoms, $R^{22}$ is a substituted or unsubstituted alkyl group having 1 to 4 carbon atoms, $R^{23}$ is a substituted or unsubstituted alkyl group having 1 to 4 carbon atoms, and $R^{24}$ is a substituted or unsubstituted alkyl group having 1 to 4 carbon atoms.

Specific examples of the magenta dye represented by formula (2) are described below. However, the magenta dyes that can be used in the present invention, particularly in the third embodiment of the present invention, should not be construed as being limited to the below-described specific examples.

TABLE 2

Specific examples of magenta dyes represented by formula (2)

| No. | $A^2$ | $A^{21}$ | $R^{22}$ | $R^{23}$ | $R^{24}$ |
|---|---|---|---|---|---|
| 1-1 | 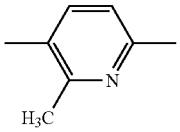 | t-Butyl | 3-Methylphenyl | n-Propyl | n-Propyl |
| 1-2 | 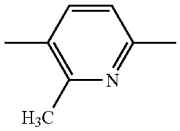 | Methyl | Phenyl | Ethyl | Methoxyethyl |
| 1-3 | 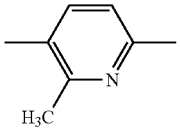 | t-Butyl | 3-Methylphenyl | Ethyl | Ethyl |
| 1-4 | 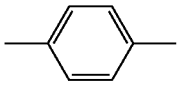 | 2-Chlorophenyl | Isopropyl | t-Butyl | Cyanoethyl |

Among these dyes represented by formula (2), dyes that are not commercially available may be synthesized according to the method described in JP-A-7-137455, or a method based on the method.

The dye represented by formula (2) that can be used in the present invention, particularly in the third embodiment of the present invention, may be used together with other dyes. The dyes that may be used with the dye of formula (2) are not limited so long as the dye is able to diffuse by heat, and may be incorporated in the heat-sensitive transfer sheet, and further the dye transfers by heat from the heat-sensitive transfer sheet to the heat-sensitive image-receiving sheet. As such dyes, it is possible to use dyes that are conventionally used or known as dyes for the heat-sensitive transfer sheet.

Preferred examples of the dyes that may be used together with the magenta dye of formula (2) include those described as preferable dyes that can be particularly preferably used in the first embodiment of the present invention.

Specific examples of the dye to be used together with the magenta dye of formula (2) include those described as specific examples of the dye that can be particularly preferably used in the first embodiment of the present invention. However, the present invention is not limited to these examples. Further, an arbitrary combination of dyes having each color hue as described above is also possible.

(Resin for Dye Layer)

In the heat-sensitive transfer sheet of the present invention, ordinarily the dye is coated on or above a base film in the state of dispersion in a polymer compound that is called a resin (also called a binder or a resin binder). As a resin binder that is contained in the dye layer, known materials may be used in the present invention. Examples thereof include acrylic resins such as polyacrylonitrile, polyacrylate, and polyacrylamide; polyvinyl acetal-series resins such as polyvinyl acetoacetal, and polyvinyl butyral; cellulose-series resins such as ethylcellulose, hydroxyethylcellulose, ethylhydroxycellulose, hydroxypropylcellulose, ethylhydroxyethylcellulose, methylcellulose, cellulose acetate, cellulose acetate butyrate, cellulose acetate propionate, cellulose nitrate, other modified cellulose resins, nitrocellulose, and ethylhydroxyethylcellulose; other resins such as polyurethane resin, polyimide resin, polyester resin, polycarbonate resin, phenoxy resin, phenol resin, and epoxy resin; and various elastomers. The dye layer may be made, of at least one resin selected from the above-mentioned group.

These may be used alone, or two or more thereof may be used in the form of a mixture or copolymer. These may be crosslinked with any of various crosslinking agents.

The resin in the present invention is preferably a cellulose-series resin or a polyvinyl acetal-series resin, more preferably a polyvinyl acetal-series resin. In the present invention, as the binder resin, polyvinyl acetoacetal-series resins and polyvinyl butyral resins are particular preferable.

The content ratio by mass of the dye to the resin in the dye layer may be any proportion, and preferably from 0.1 to 5.0, more preferably from 0.5 to 3.0, and further preferably from 0.9 to 2.0.

(Transferable Protective Layer Laminate)

In the present invention, a transferable protective layer laminate is preferably formed in area order onto the heat-sensitive transfer sheet. The transferable protective layer laminate is used for forming a protective layer composed of a transparent resin on a thermally transferred image by thermal transfer and thus covering and protecting the image, thereby to improve durability such as scratch resistance, light-fastness, and resistance to weather. This laminate is effective in the case where the transferred dye is insufficient in image durabilities such as light resistance, scratch resistance, and chemical resistance in the state that the dye is naked in the surface of an image-receiving sheet.

The transferable protective layer laminate can be formed by forming, onto a base film, a releasing layer, a protective layer and an adhesive layer in this order (i.e., in the layer-described order) successively. The protective layer may be formed by plural layers. In the case where the protective layer also has functions of other layers, the releasing layer and the adhesive layer can be omitted. It is also possible to use a base film on which an easy adhesive layer has already been formed.

(Transferable Protective Layer)

In the present invention, as a transferable protective layer-forming resin, preferred are resins that are excellent in scratch resistance, chemical resistance, transparency and hardness. Examples of the resin include polyester resins, acrylic resins, polystyrene resins, polyurethane resins, acrylic urethane resins, silicone-modified resins of the above-described resins, ultraviolet-shielding resins, mixtures of these resins, ionizing radiation-curable resins, and ultraviolet-curing resins. Particularly preferred are polyester resins and acrylic resins.

These resins may be crosslinked with any of various crosslinking agents.

(Transferable Protective Layer Resin)

As the acrylic resin, use can be made of polymers derived from at least one monomer selected from conventionally known acrylate monomers and methacrylate monomers. Other monomers than these acrylate-series monomers, such as styrene and acrylonitrile may be co-polymerized with said acrylic monomers. A preferred monomer is methyl methacrylate. It is preferred that methyl methacrylate is contained in terms of preparation mass ratio of 50 mass % or more in the polymer.

As the acrylic resin that can be used in the present invention preferably has a molecular weight of 20,000 or more and 100,000 or less.

As the polyester resin that can be used in the present invention, a saturated polyester resin known can be used. In the case where the above-described polyester resin is used, a preferable glass transition temperature ranges from 50° C. to 120° C., and a preferable molecular weight ranges from 2,000 to 40,000. A molecular weight ranging from 4,000 to 20,000 is more preferred, because so-called "foil-off" properties at the time of transfer of the protective layer are improved.

(Ultraviolet Absorbent)

In the present invention, an ultraviolet absorbent may be incorporated into the protective layer and/or the adhesive layer. The ultraviolet absorbent may be an inorganic ultraviolet absorbent or organic ultraviolet absorbent known in the prior art.

As the organic ultraviolet absorbents, use can be made of non-reactive ultraviolet absorbents such as salicylate-series, benzophenone-series, benzotriazole-series, triazine-series, substituted acrylonitrile-series, and hindered amine-series ultraviolet absorbents; and copolymers or graft polymers of thermoplastic resins (e.g., acrylic resins) obtained by introducing addition-polymerizable double bonds (originated from a vinyl group, an acryroyl group, a methacryroyl group, or the like) to the above-described non-reactive ultraviolet absorbents, or, alternatively by introducing thereto other types of groups such as an alcoholic hydroxyl group, an amino group, a carboxyl group, an epoxy group, and an isocyanate group. In addition, disclosed is a method of obtaining ultraviolet-shielding resins by the steps of dissolving ultraviolet absorbents in a monomer or oligomer of a resin, and then polymerizing the monomer or oligomer (JP-A-2006-21333). The thus-obtained ultraviolet-shielding resin may be used in the present invention. In this case, the ultraviolet absorbents may be non-reactive.

Of these ultraviolet absorbents, preferred are benzophenone-series, benzotriazole-series, and triazine-series ultraviolet absorbents. It is preferred that these ultraviolet absorbents are used in combination so as to cover an effective ultraviolet absorption wavelength region according to characteristic properties of the dye that is used for image formation. Besides, in the case of non-reactive ultraviolet absorbents, it is preferred to use a mixture of two or more kinds of ultraviolet absorbents each having a different structure from each other so as to prevent the ultraviolet absorbents from precipitating.

Examples of commercially available ultraviolet absorbents include TINUVIN-P (trade name, manufactured by Ciba-Geigy), JF-77 (trade name, manufactured by JOHOKU CHEMICAL CO., LTD.), SEESORB 701 (trade name, manufactured by SHIRAISHI CALCIUM KAISHA, LTD.), SUMISORB 200 (trade name, manufactured by Sumitomo Chemical Co., Ltd.), VIOSORB 520 (trade name, manufactured by KYODO CHEMICAL CO., LTD.), and ADKSTAB LA-32 (trade name, manufactured by ADEKA).

(Formation of Transferable Protective Layer)

The method for forming the protective layer, which depends on the kind of the resin to be used, may be the same method for forming the dye layer. The protective layer preferably has a thickness of 0.5 to 10 μm.

(Releasing Layer)

In a case where the transferable protective layer is not easily peeled from the base film at the time of thermal transferring, a releasing layer may be formed between the base film and the protective layer. Alternatively, a peeling layer may be formed between the transferable protective layer and the releasing layer. The releasing layer may be formed by applying a coating liquid by a method known in the prior art, such as gravure coating and gravure reverse coating, and then drying the coated liquid. The coating liquid contains at least one selected from, for example, waxes, silicone waxes, silicone resins, fluorine-containing resins, acrylic resins, polyvinyl alcohol resins, cellulose derivative resins, urethane-series resins, vinyl acetate-series resins, acrylic vinyl ether-series resins, maleic anhydride resins, and copolymers of these resins. Of these resins, preferred are: acrylic resins, such as resin obtained by homopolymerizing a (meth)acrylic monomer such as acrylic acid or methacrylic acid, or obtained by copolymerizing an acrylic or methacrylic monomer with a different monomer; or cellulose derivative resins. They are each excellent in adhesive property to the base film, and releasing ability from the protective layer.

These resins may be crosslinked with any of various crosslinking agents. Moreover, an ionizing radiation curable resin and an ultraviolet curable resin may also be used.

The releasing layer may be appropriately selected from a releasing layer which is transferred to a transferred-image-receiving member when the protective layer is thermally transferred, a releasing layer which remains on the base film side at that time, a releasing layer which is broken out by aggregation at that time, and other releasing layers. A preferred embodiment of the present invention is an embodiment wherein the releasing layer is non-transferable type and remains on the base film side at the time of the thermal transfer, and the interface between the releasing layer and the thermally transferable protective layer becomes a protective layer surface after the thermal transfer, since the embodiment is excellent in surface gloss, the transfer stability of the protective layer, and others. The method for forming the releasing layer may be a coating method known in the prior art. The releasing layer preferably has a thickness of about 0.5 to 5 μm in the state that the layer is dried.

(Adhesive Layer)

An adhesive layer may be formed, as the topmost layer of the protective layer laminate, on the topmost surface of the protective layer. This makes the adhesive property of the protective layer to a transferred-image-receiving member good.

2) Heat-Sensitive Transfer Image-Receiving Sheet

The heat-sensitive transfer image-receiving sheet (hereinafter also referred to simply as an image-receiving sheet) that can be used together with the heat-sensitive transfer sheet of the present invention in order to form a heat-sensitive transfer print will be described in detail hereinafter.

The heat-sensitive transfer image-receiving sheet has a support and at least one receiving layer containing a thermoplastic dye-receiving polymer formed thereon. The receiving layer may contain an ultraviolet absorbent, a releasing agent, a lubricant, an antioxidant, a preservative, a surfactant, and other additives. Between the support and the receiving layer may be formed an intermediate layer such as a heat insulating layer (porous layer), a gloss control layer, a white background adjusting layer, a charge control layer, an adhesive layer, or a primer layer. The heat-sensitive transfer image-receiving sheet preferably has at least one heat insulating layer between the support and the receiving layer.

The receiving layer and these interlayers are preferably formed by simultaneous multilayer coating, and a multiple number of these interlayers may be formed as needed.

A curling control layer, a writing layer, or a charge-control layer may be formed on the backside of the support. Each of these layers may be coated on the backside of the support by using a usual method such as a roll coating, a bar coating, a gravure coating, and a gravure reverse coating.

In the present invention, any heat-sensitive transfer image-receiving sheet can be used. From a viewpoint that effects of the present invention can be achieved effectively, a heat-sensitive transfer image-receiving sheet having, on or above the support, a heat insulating layer containing latex hollow polymer (particles), and a receiving layer containing latex polymer (particles), is especially preferable.

In the heat-sensitive transfer image-receiving sheet, it is preferable to use latex polymer capable of dyeing with a dye in a receiving layer. The latex polymer may be used alone or as a mixture of two or more latex particles.

The latex polymer is generally a dispersion of fine particles of thermoplastic resins in a water-soluble dispersion medium. Examples of the thermoplastic resins used for the latex polymer in the present invention include polycarbonates, polyesters, polyacrylates vinyl chloride copolymers, polyurethane, styrene/acrylonitrile copolymers, polycaprolactone and the like.

Among them, polycarbonates, polyesters, and vinyl chloride copolymers are preferable, and polyesters and vinyl chloride copolymers are particularly preferable.

The polyester polymers are obtained by condensation of a dicarboxylic acid component and a diol component. The polyester polymers may contain an aromatic ring and/or a saturated hydrocarbon ring. The polyester polymers may contain a water-soluble group to promote their dispersion.

Examples of the vinyl chloride copolymers include vinyl chloride/vinyl acetate copolymers, vinyl chloride/acrylate copolymers, vinyl chloride/methacrylate copolymers, vinyl chloride/vinyl acetate/acrylate copolymers, vinyl chloride/acrylate/ethylene copolymers and the like. As described above, it may be a binary copolymer or a ternary or higher copolymer, and the monomers may be distributed randomly or uniformly by block copolymerization.

The copolymer may contain auxiliary monomer components such as vinylalcohol derivatives, maleic acid derivatives, and vinyl ether derivatives. The copolymer preferably contain vinyl chloride components in an amount of 50 mass % or more, and auxiliary monomer components such as maleic acid derivative and vinyl ether derivative in an amount of 10 mass % or less.

The latex polymers may be used singly or as a mixture. The latex polymer may have a uniform structure or a core/shell structure, and in the latter case, the resins constituting the core and shell respectively may have different glass transition temperatures.

The glass transition temperature (Tg) of these latex polymers is preferably from 20° C. to 90° C., and more preferably from 25° C. to 80° C.

Commercially available acrylate latexes include Nipol LX814 (Tg: 25° C.) and Nipol LX857X2 (Tg: 43° C.) (all, trade names, manufactured by ZEON CORPORATION) and others.

Commercially available polyester latexes include Vylonal MD-1100 (Tg: 40° C.), Vylonal MD-1400 (Tg: 20° C.), Vylonal MD-1480 (Tg: 20° C.) and MD-1985 (Tg: 20° C.) (all, trade names, manufactured by Toyobo Co., Ltd.) and others.

Commercially available vinyl chloride copolymers include Vinybran 276 (Tg: 33° C.) and Vinybran 609 (Tg: 48° C.) produced by Nissin Chemical Industry Co., Ltd., Sumielite 1320 (Tg: 30° C.) and Sumielite 1210 (Tg: 20° C.) (all, trade names, manufactured by Sumika Chemtex Co., Ltd.) and others.

The addition amount of the latex polymer (latex polymer solid content) is preferably 50 to 98 mass %, more preferably 70 to 95 mass %, with respect to all polymers in the receiving layer. The average particle diameter of the latex polymer is preferably 1 to 50,000 nm, more preferably 5 to 1,000 nm.

The heat-sensitive transfer image-receiving sheet that can be used in the present invention preferably includes hollow polymer particles in the heat insulation layer.

The hollow polymer particles are polymer particles having independent voids inside of the particle and they are preferably used in aqueous dispersion state. Examples of the hollow polymer particles include (1) non-foaming type hollow polymer particles obtained in the following manner: water is contained inside of a capsule wall formed of a polystyrene, acrylic resin, or styrene/acrylic resin, and the like; and, after a coating liquid is applied and dried, the water in the particles is vaporized out of the particles, with the result that the inside of each particle forms a hollow; (2) foaming type microballoons obtained in the following manner: a low-boiling-point liquid such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling-point liquid inside of the particles, whereby the inside of each particle is made to be hollow; and (3) microballoons obtained by foaming the above (2) under heating in advance, to make hollow polymer particles.

As the hollow polymer particles, the non-foaming hollow polymer particles of the foregoing (1) are preferred. If necessary, use can be made of a mixture of two or more kinds of the polymer particles. Specific examples include Rohpake HP-1055, manufactured by Rohm and Haas Co.; SX866(B), manufactured by JSR Corporation; and Nippol MHS055, manufactured by ZEON CORPORATION (all of these product names are trade names).

The average particle diameter (particle size) of the hollow polymer particles is preferably 0.1 to 5.0 μm, more preferably 0.2 to 3.0 μm, and particularly preferably 0.4 to 1.4 μm.

The hollow ratio (percentage of void) of the hollow polymer particles is preferably in the range of 20% to 70%, and particularly preferably 30% to 60%.

The particle diameter of the hollow polymer particles is calculated after measurement of the equivalent-circle diameter of the periphery of the particles under a transmission electron microscope. The average particle diameter is determined by measuring the equivalent-circle diameter of the periphery of at least 300 hollow polymer particles observed under the transmission electron microscope and obtaining the average thereof.

As for the polymer properties of the hollow polymer particles, the glass transition temperature (Tg) is preferably 70° C. or higher and 200° C. or lower, more preferably 90° C. or higher and 180° C. or lower. The hollow polymer particles are particularly preferably latex hollow polymer particles.

The heat-sensitive transfer image-receiving sheet may contain a water-soluble polymer in the receiving layer and/or the heat insulation layer. Herein, the "water-soluble polymer" means a polymer which dissolves, in 100 g of water at 20° C., in an amount of preferably 0.05 g or more, more preferably 0.1 g or more, further preferably 0.5 g or more.

Examples of the water-soluble polymers for use in the heat-sensitive transfer image-receiving sheet include carrageenans, pectin, dextrin, gelatin, casein, carboxymethylcellulose, hydroxyethylcellulose, hydroxypropylcellulose, polyvinylpyrrolidone, polyvinylpyrrolidone copolymers, polyvinylalcohol, polyethylene glycol, polypropylene glycol, water-soluble polyesters, and the like. Among them, gelatin and polyvinylalcohol are preferable.

Gelatin having a molecular weight of 10,000 to 1,000,000 may be used elatin may contain an anion such as $C^-$ and $SO_4^{2-}$, or alternatively a cation such as $Fe^{2+}$, $Ca^{2+}$, $Mg^{2+}$, $Sn^{2+}$, and $Zn^{2+}$. Gelatin is preferably added as an aqueous solution.

To the gelatin above, may be added a known crosslinking agent such as aldehyde-type crosslinking agent, N-methylol-type crosslinking agent, vinylsulfone-type crosslinking agent, or chlorotriazine-type crosslinking agent. Among the crosslinking agents above, vinylsulfone-type agents and chlorotiazine-type crosslinking agents are preferable, and typical examples thereof include bisvinylsulfonylmethylether, N,N'-ethylene-bis(vinylsulfonylacetamido)ethane, and 4,6-dichloro-2-hydroxy-1,3,5-triazine or the sodium salt thereof.

As the polyvinyl alcohol, there can be used various kinds of polyvinyl alcohols such as complete saponification products thereof, partial saponification products thereof, and modified polyvinyl alcohols. With respect to these polyvinyl alcohols, those described in Koichi Nagano et al., "Poval", Kobunshi Kankokai, Inc. are useful. The viscosity of polyvinyl alcohol can be adjusted or stabilized by adding a trace amount of a solvent or an inorganic salt to an aqueous solution of polyvinyl alcohol, and use may be made of compounds described in the aforementioned reference "Poval", Koichi Nagano et al., published by Kobunshi Kankokai, pp. 144-154. For a typical example, a coated-surface quality can be improved by an addition of boric acid, and the addition of boric acid is preferable. The amount of boric acid to be added is preferably 0.01 to 40 mass %, with respect to polyvinyl alcohol.

Specific examples of the polyvinyl alcohols include completely saponificated polyvinyl alcohol such as PVA-105, PVA-110, PVA-117, and PVA-117H; partially saponificated polyvinyl alcohol such as PVA-203, PVA-205, PVA-210, and PVA-220; and modified polyvinyl alcohols such as C-118, HL-12E, KL-118, and MP-203 (all of these names are trade names, manufactured by KURARAY CO., LTD.).

The receiving layer of the heat-sensitive transfer image-receiving sheet may contain the polymer compound having fluorine atom-substituted aliphatic groups on its side chains. In such a case, it may contain a polymer compound identical with or different in kind from the polymer compound having fluorine atom-substituted aliphatic groups on its side chains contained in the heat-sensitive transfer sheet, and both cases are preferable embodiments of the present invention. It may also contain, as releasing agent, a known polyethylene wax, a solid wax such as amide wax, a silicone oil, a phosphate-series compound, a fluorine-series surfactant or a silicone-series surfactant.

The content of the polymer compound having fluorine atom-substituted aliphatic groups on the side chains is 0.01% to 20%, preferably 0.1% to 10% and more preferably 1% to 5%, with respect to the total solid content (mass) in the receiving layer.

3) Image-Forming Method (System)

Next, an image-forming method that can be conducted by using the heat-sensitive transfer sheet of the present invention will be described.

In the image-forming method (system) of the present invention, imaging is achieved by superposing a heat-sensitive transfer sheet on a heat-sensitive transfer image-receiving sheet so that a dye layer of the heat-sensitive transfer sheet is in contact with a receptor layer of the heat-sensitive transfer image-receiving sheet, and giving thermal energy in accordance with image signals given from a thermal head.

Specifically, an image-forming may be conducted in a similar manner as described in, for example, JP-A-2005-88545. In the present invention, a printing time is preferably less than 15 seconds, more preferably in the range of 3 to 12 seconds, and further preferably 3 to 7 seconds, from the viewpoint of shortening the time taken until a consumer gets a print.

In order to accomplish the above-described printing time, a line speed at the time of printing is preferably 1.0 msec/line or less, more preferably 0.75 msec/line or less, and most preferably 0.65 msec/line or less. Further, from the viewpoint of improvement in transfer efficiency as one of speeding-up conditions, the maximum ultimate temperature of the thermal printer head at the time of printing is preferably in the range of 180° C. or higher and 450° C. or lower, more preferably 200° C. or higher and 450° C. or lower, and furthermore preferably 350° C. or higher and 450° C. or lower.

The method of the present invention may be utilized for printers, copying machines and the like, which employ a heat-sensitive transfer recording system. As a means for providing heat energy in the thermal transfer, any of the conventionally known providing means may be used. For example, application of a heat energy of about 5 to 100 mJ/mm$^2$ by controlling recording time in a recording device such as a thermal printer (e.g., trade name: Video Printer VY-100, manufactured by Hitachi, Ltd.), sufficiently attains the expected result. Also, the heat-sensitive transfer image-receiving sheet that is used with the heat-sensitive transfer sheet of the present invention may be used in various applications enabling thermal transfer recording, such as heat-sensitive transfer image-receiving sheets in a form of thin sheets (cut sheets) or rolls; cards; and transmittable type manuscript-making sheets, by optionally selecting the type of support.

According to the present invention, it is possible to provide a heat-sensitive transfer sheet capable of providing an image with a reduced print cockle and a reduced image defect by decreasing stretch of the heat-sensitive transfer sheet in high speed printing.

Further, according to the present invention, it is possible to provide a heat-sensitive transfer sheet having achieved improvement of transfer density at the time of printing and suppress of dye transfer to the heat-resistant lubricating layer in combination.

Further, according to the present invention, it is possible to provide a heat-sensitive transfer sheet capable of providing with a high density and having excellent light fastness. Employing the heat-sensitive transfer sheet, occurrence of jamming at the time of printing is substantially prohibited even though a heat-sensitive transfer sheet is produced using a coating liquid stored over a long time, and as a result, it is possible to provide a heat-sensitive transfer sheet having excellent property of passing-through equipment and resultantly excellent mass productivity.

EXAMPLES

The present invention will be described in more detail based on the following examples, but the invention is not intended to be limited thereto. In the following Examples, the terms "part" and "%" are values by mass, unless they are indicated differently in particular.

Example 1-1

Production of Heat-sensitive Transfer Sheets

As a base film, was used a 4.5 μm thick polyester film on one surface of which an easy adhesion layer was previously formed. On the other surface of the polyester film, the below-described heat-resistant lubricating layer-coating liquid A1 was coated so that the solid coating amount would be 1.1 g/m$^2$ after drying. In the below-described heat-resistant lubricating layer-coating liquid, the ratio of reactive groups of polyisocyanate to those of the resin (—NCO/OH) was 1.1. Immediately after coating the film was dried at 100° C. for 1 minute in an oven, and continuously subjected to a heat treatment at 60° C. for 20 hours so that a crosslinking reaction between the isocyanate and a polyol could be conducted to cure the heat-resistant lubricating layer. After the heat treatment, the presence of unreacted isocyanate group was checked by IR measurement and confirmed that the reaction had been completed.

Coating liquids, which will be detailed later, were used to form, onto the easily-adhesive layer coated surface of the thus-formed polyester film, individual heat-sensitive transfer layers in yellow, magenta and cyan, and a transferable protective layer laminate in area order by coating. In this way, a heat-sensitive transfer sheet was produced. The solid coating amount in each of the dye layers was set to 0.9 g/m$^2$. Immediately after the coating, the workpiece was dried at 100° C. in an oven for 1 minute.

In the formation of the transferable protective layer laminate, a releasing-layer-coating liquid was applied, and a protective-layer-coating liquid was applied thereon. The resultant was dried, and then an adhesive-layer-coating liquid was applied thereon.

| Dispersion liquid for heat resistant lubricating layer A1 | |
|---|---|
| Polyvinylacetal resin (trade name: S-LEC BX-1, manufactured by Sekisui Chemical Co., Ltd.) | 10.0 mass parts |
| Phosphate having —OH group (Compound represented by formula (P)) (trade name: Phoslex A-18, manufactured by Sakai Chemical Industry Co., Ltd.; the number of carbon atoms in the alcohol moiety: 18) | 1.4 mass parts |
| Zinc stearate | 0.2 mass part |
| Raw talc (average sphere-equivalent diameter of the particles: 2.9 μm; ratio (Y/X) of the largest peak intensity (Y) of X-ray diffraction originated from impurities to the largest peak intensity (X) of X-ray diffraction originated from talc: 0.15; shot-type abrasion degree: 25 mg) | 1.2 mass parts |
| Methyl ethyl ketone/toluene mixture solvent | 87.2 mass parts |

The resin and the solvent for the above-described dispersion liquid for the heat-resistant lubricating layer A1 were previously dissolved. To the resultant solution, other additives were added, and a premixing was conducted. Thereafter, dispersion was performed under any one of the following three conditions.

(Condition 1-1) Dispersion for 120 minutes using a paint shaker
(Condition 1-2) Dispersion at 250 rpm for 40 minutes using a planet type -continued

| | |
|---|---|
| | ball mill P-7. (trade name) manufactured by FRITSCH (Germany) Corporation |
| (Condition 1-3) | Dispersion at 400 rpm for 40 minutes using a planet type ball mill P-7 (trade name) manufactured by FRITSCH (Germany) Corporation |

Heat-resistant-lubricating-layer-coating liquid A1

| | |
|---|---|
| Dispersion liquid for heat resistant lubricating layer A1 | 32.5 mass parts |
| Polyisocyanate (75% solution) (trade name: BURNOCK D-750, manufactured by DIC Corporation) | 7.5 mass parts |
| Methyl ethyl ketone/toluene mixture solvent | 70.0 mass parts |

Yellow-dye-coating liquid

| | |
|---|---|
| Dye compound (Y-1) | 2.0 mass parts |
| Dye compound (Y-2) | 5.1 mass parts |
| Dye compound (Y-3) | 0.8 mass part |
| Polyvinylacetal resin (trade name: DENKA BUTYRAL #5000-D, manufactured by DENKI KAGAKU KOGYOU K. K.) | 6.9 mass parts |
| Fluorine-containing polymer compound (trade name: Megafac F-472SF, manufactured by DIC Corporation) | 0.1 mass part |
| Matting agent (trade name: Flo-thene UF, manufactured by Sumitomo Seika Chemicals Co., Ltd.) | 0.09 mass part |
| Methyl ethyl ketone/toluene mixture solvent | 85 mass parts |

Magenta-dye-coating liquid

| | |
|---|---|
| Dye compound (M-1) | 1.8 mass parts |
| Dye compound (M-2) | 1.3 mass parts |
| Dye compound (M-3) | 5.5 mass parts |
| Polyvinylacetal resin (trade name: S-LEC KS-1, manufactured by Sekisui Chemical Co., Ltd.) | 6.2 mass parts |
| Releasing agent (trade name: X-22-3000T, manufactured by Shin-Etsu Chemical Co., Ltd.) | 0.07 mass part |
| Releasing agent (trade name: TSF4701, manufactured by MOMENTIVE Performance Materials Japan LLC.) | 0.02 mass part |
| Matting agent (trade name: Flo-thene UF, manufactured by Sumitomo Seika Chemicals Co., Ltd.) | 0.11 mass part |
| Methyl ethyl ketone/toluene mixture solvent | 85 mass parts |

Cyan-dye-layer-coating liquid

| | |
|---|---|
| Dye compound (C-1) | 1.4 mass parts |
| Dye compound (C-2) | 7.6 mass parts |
| Dye compound (C-3) | 0.8 mass part |
| Polyvinylacetal resin (trade name: S-LEC KS-1, manufactured by Sekisui Chemical Co., Ltd.) | 5.0 mass parts |
| Fluorine-containing polymer compound (trade name: Megafac F-472SF, manufactured by DIC Corporation) | 0.1 mass part |
| Matting agent (trade name: Flo-thene UF, manufactured by Sumitomo Seika Chemicals Co., Ltd.) | 0.1 mass part |
| Methyl ethyl ketone/toluene mixture solvent | 85 mass parts |

Y-1

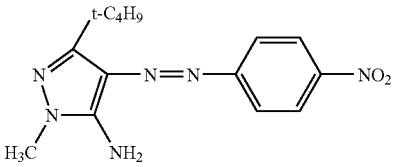

Y-2

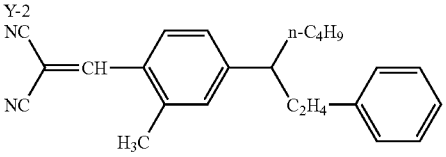

Y-3

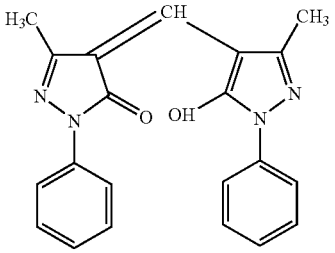

M-1

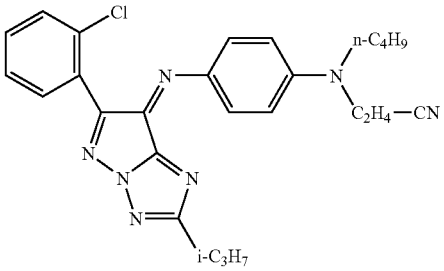

M-2

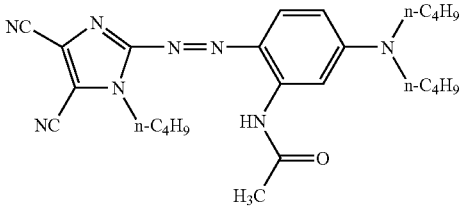

M-3

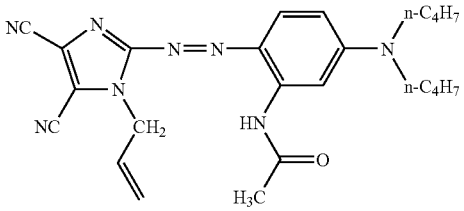

C-1

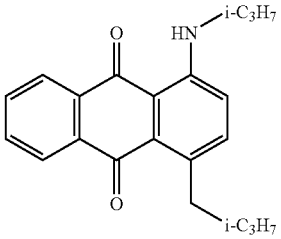

C-2

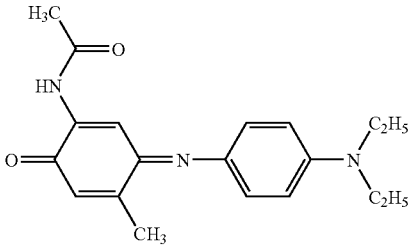

-continued

C-3

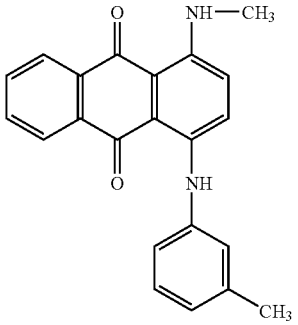

(Transferable Protective Layer Laminate)

On the polyester film coated with the dye layers as described above, coating solutions of a releasing layer, a protective layer and an adhesive layer each having the following composition was coated, to form a transferable protective layer laminate. Coating amounts of the releasing layer, the protective layer and the adhesive layer after drying were 0.2 g/m$^2$, 0.4 g/m$^2$ and 2.0 g/m$^2$, respectively.

| Releasing-layer-coating liquid | |
|---|---|
| Modified cellulose resin (trade name: L-30, manufactured by DAICEL CHEMICAL INDUSTRIES, LTD.) | 5.0 mass parts |
| Methyl ethyl ketone/toluene mixture solvent | 95.0 mass parts |
| **Protective-layer-coating liquid** | |
| Acrylic resin solution (Solid content: 40%) (trade name: UNO-1, manufactured by Gifu Ceramics Limited) | 90 mass parts |
| Methanol/isopropanol mixture solvent | 10 mass parts |
| **Adhesive-layer-coating liquid** | |
| Acrylic resin (trade name: DIANAL BR-77, manufactured by MITSUBISHI RAYON CO., LTD.) | 25 mass parts |
| The following ultraviolet absorber UV-1 | 0.5 mass part |
| The following ultraviolet absorber UV-2 | 2 mass parts |
| The following ultraviolet absorber UV-3 | 0.5 mass part |
| The following ultraviolet absorber UV-4 | 0.5 mass part |
| PMMA fine particles (polymethyl methacrylate fine particles) | 0.4 mass part |
| Methyl ethyl ketone/toluene mixture solvent | 70 mass parts |

(UV-1)

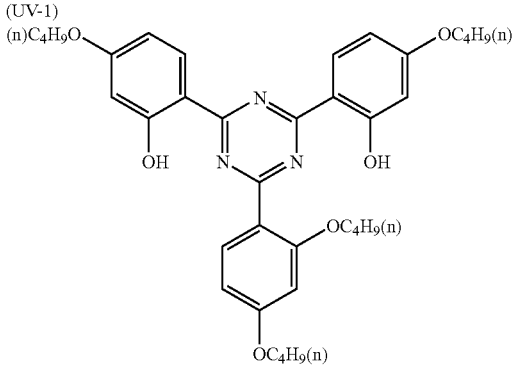

-continued (UV-2)

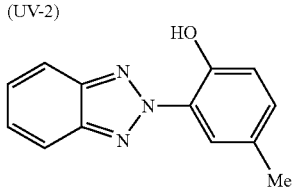

(UV-3)

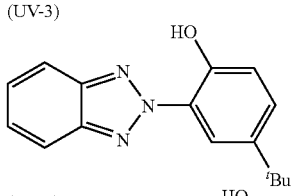

(UV-4)

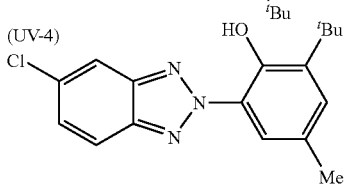

(Preparation of Heat Sensitive Image-receiving Sheet)

A paper support, on both sides of which polyethylene was laminated, was subjected to corona discharge treatment on the surface thereof, and then a gelatin undercoat layer containing sodium dodecylbenzenesulfonate was disposed on the treated surface. The subbing layer, the heat insulation layer, the lower receptor layer and the upper receptor layer each having the following composition were simultaneously multilayer-coated on the gelatin undercoat layer, in the state that the subbing layer, the heat insulation layer, the lower receptor layer and the upper receptor layer were laminated in this order from the side of the support, by a method illustrated in FIG. 9 in U.S. Pat. No. 2,761,791. The coating was performed so that coating amounts of the subbing layer, the heat insulation layer, the lower receptor layer, and the upper receptor layer after drying would be 6.2 g/m$^2$, 8.0 g/m$^2$, 2.8 g/m$^2$ and 2.3 g/m$^2$, respectively. The following compositions are presented by mass parts as solid contents.

| Upper receptor layer | |
|---|---|
| Vinyl chloride-series latex (trade name: Vinybran 900, manufactured by Nisshin Chemicals Co., Ltd.) | 21.0 mass parts |
| Vinyl chloride-series latex (trade name: Vinybran 276, manufactured by Nisshin Chemicals Co., Ltd.) | 1.6 mass parts |
| Gelatin (10% solution) | 2.0 mass parts |
| The following ester-series wax EW-1 | 2.3 mass parts |
| The following surfactant F-1 | 0.09 mass part |
| The following surfactant F-2 | 0.36 mass part |
| **Lower receptor layer** | |
| Vinyl chloride-series latex (trade name: Vinybran 690, manufactured by Nisshin Chemicals Co., Ltd.) | 15.0 mass parts |
| Vinyl chloride-series latex (trade name: Vinybran 900, manufactured by Nisshin Chemicals Co., Ltd.) | 11.0 mass parts |
| Gelatin (10% solution) | 8.0 mass parts |
| The following surfactant F-1 | 0.04 mass part |
| **Heat insulation layer** | |
| Hollow latex polymer particles (trade name: MH5055, manufactured by Nippon Zeon Co., Ltd.) | 66.0 mass parts |
| Gelatin (10% solution) | 24.0 mass parts |

-continued

| Subbing layer | |
|---|---|
| Polyvinyl alcohol (trade name: POVAL PVA 205, manufactured by Kuraray) | 7.0 mass parts |
| Styrene butadiene rubber latex (trade name: SN-307, manufactured by NIPPON A & L INC) | 55.0 mass parts |
| The following surfactant F-1 | 0.03 mass part |

(EW-1)

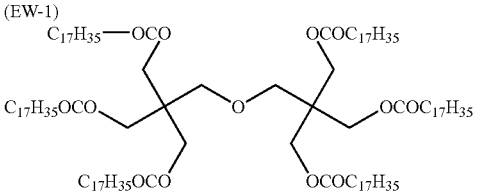

(F-1)

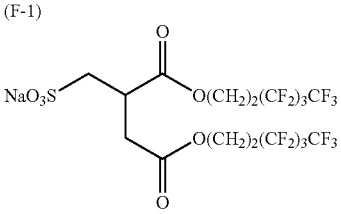

F-2

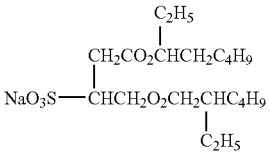

The sample produced by using the dispersion liquid for the heat-resistant lubricating layer A1 prepared under the condition 1-1 was designated as a heat-sensitive transfer sheet (101a), the sample produced by using the dispersion liquid for the heat-resistant lubricating layer A1 prepared under the condition 1-2 was designated as a heat-sensitive transfer sheet (102a), and the sample produced by using the dispersion liquid for the heat-resistant lubricating layer A1 prepared under the condition 1-3 was designated as a heat-sensitive transfer sheet (103a). Heat-sensitive transfer sheets (104a) to (106a) were produced in the same manner as the heat-sensitive transfer sheets (101a) to (103a), except that the phosphate having a OH group in the heat-resistant lubricating layer was changed from a single use of Phoslex-A-18 (manufactured by Sakai Chemical Industry Co., Ltd.) to a 2:8 mixture (mass ratio) of Phoslex-A-18 (trade name, manufactured by Sakai Chemical Industry Co., Ltd.) and PLYSURF A208N, (manufactured by Dai-ichi Kogyo Seiyaku Co., Ltd.: a mixture of mono- and di-polyoxyalkylenealkylether phosphate).

(Projected Area of Talc Particles in Heat-resistant Lubricating Layer)

According to the method described in detail in this specification, a SEM image (electron beam image) of the heat-resistant lubricating layer was obtained by irradiating electron beams accelerated at 20 kV from the heat-resistant lubricating layer side of the heat-sensitive transfer sheet (101a) using a scanning electron microscope. Then, a projected area corresponding to each talc particle in the heat-resistant lubricating layer was obtained from this SEM image. With respect to the projected area corresponding to each talc particle having the projected area of 10 square μm or more, each specific projected area was measured. From the each projected area thus measured, an average projected area of talc particles having the projected area of 10 square μm or more, a standard deviation, and a variation coefficient obtained by dividing a standard deviation of the projected areas of talc particles each having the projected area of 10 square μm or more by the average projected area were calculated according to the above-described equations (1) to (3). With respect to the heat-sensitive transfer sheets (102a) to (106a), these values were also obtained in the same manner as the above. In each sample, the number of talc particles having the projected area of 10 square μm or more in the heat-resistant lubricating layer was from about 50 to 200 per 200,000 square μm. In each sample, each specific projected area of from 200 to 400 particles was measured.

The composition of the heat-resistant lubricating layer and the above-described values are shown in Table 3.

TABLE 3

| Heat-sensitive transfer sheet No. | Phosphate represented by formula (P) | Dispersion condition | Average projected area of talc particles having projected area of 10 square μm or more (square μm) | Variation coefficient of projected area of talc particles having projected area of 10 square μm or more |
|---|---|---|---|---|
| 101a | Phoslex A-18 | Condition 1-1 | 81.2 | 0.77 |
| 102a | | Condition 1-2 | 35.1 | 0.69 |
| 103a | | Condition 1-3 | 24.5 | 0.55 |
| 104a | Phoslex A-18 | Condition 1-1 | 75.4 | 0.83 |
| 105a | and PLYSURF | Condition 1-2 | 21.4 | 0.62 |
| 106a | A208N | Condition 1-3 | 42.0 | 0.84 |

From the Table 3, it is understood that the average value of projected areas of talc particles in the heat-resistant lubricating layer and the variation coefficient each diversely vary depending on the dispersion condition, even though the raw material talc is identical. Provided that the promotion of talc dispersion is effective to the present invention, the average value of projected areas of talc particles and the variation coefficient each should be the smallest value in the dispersion condition 1-3 that is the strongest dispersion condition. However, the results are not entirely true. Accordingly, it is understood that the average value of projected areas of talc particles and the variation coefficient each cannot be controlled to the specific range defined in the present invention simply by strengthening the dispersion condition.

(Formation, Measurement and Evaluation of Images)

Using the heat-sensitive transfer sheet (101a) and the heat-sensitive transfer image-receiving sheet, five sheets of black solid image print were continuously produced on a heat-sensitive transfer image-receiving paper of 152 mm×102 mm size by a thermal transfer printer having a resolution of 300 dpi. Printing was carried out on two line speed conditions of 1.3 msec/line and 0.7 msec/line. Further, printing was carried out while adjusting a heat quantity of the thermal printer head so that the density of black solid print was within the range of from 2.15 to 2.25. With respect to the first sheet and the fifth sheet among five sheets of continuous print, the length of the heat-sensitive transfer sheet was each measured in terms of before and after printing. The length of stretch owing to printing was obtained by deducting the length of sheet before printing from that after printing. Further, a proportion of the stretch was obtained as a value of the length of stretch divided by a print portion. The larger proportion of stretch indicates the more frequent occurrence of image failure. In contrast, the smaller proportion of stretch indicates the less frequent occurrence of image failure.

Further, a low density gray printing was produced in the same manner as the above printing, except that the black solid print density of from 2.15 to 2.25 was changed to the density of from 0.19 to 0.21. Image evaluation of the thus-prepared gray prints was conducted according to the following evaluation criterion.

<Criterion for Image Evaluation of Gray Print>

A: Neither point-like nor streak-like defects were observed, and print quality was very good.

B: There was a slight point-like or streak-like defect, and yet print quality was good.

C: There were point-like or streak-like defects, and yet print quality was allowable.

D: There were point-like or streak-like defects, and print quality was not allowable.

E: There were a lot of point-like or streak-like defects, and print quality was not allowable.

Printing was carried out in the same manner as the above, except that the heat-sensitive transfer sheet (101a) was changed to each of the heat-sensitive transfer sheets (102a) to (106a), and subsequently evaluated in similar manner. When five sheets of black solid print were continuously produced each using a plurality of heat-sensitive transfer sheets, there was set the suspension (printer-waiting) time of 20 minutes or more between each of five sheet-continuous printing.

The evaluation results are shown in Table 4 described below.

| Dispersion liquid for heat resistant lubricating layer B1 | |
|---|---|
| Polyacrylpolyol-series resin (50% solution) (trade name: ACRYDIC A-801-P, manufactured by DIC Corporation; Hydroxyl value relative to resin content: 100 ± 6; Acid value: 2 to 8) | 16.7 mass parts |
| Phosphate having —OH group (trade name: Phoslex A-18, manufactured by Sakai Chemical Industry Co., Ltd.) | 0.17 mass part |
| Phosphate having —OH group (Compound represented by formula (P)) (trade name: PLYSURE A208N, manufactured by Dai-ichi Kogyo Seiyaku Co., Ltd.) | 0.87 mass part |
| Zinc stearate | 0.07 mass part |
| Stearylzinc phosphate | 0.07 mass part |
| Raw talc (trade name: MICRO ACE L-1, manufactured by NIPPON TALC Co., Ltd.) (average sphere-equivalent diameter of the particles: 4.5 μm; ratio (Y/X) of the largest peak intensity (Y) of X-ray diffraction originated from impurities to the largest peak intensity (X) of X-ray diffraction originated from talc: 0.39, shot-type abrasion degree: 22 mg) | 0.62 mass part |
| Methyl ethyl ketone/toluene mixture solvent | 81.5 mass parts |
| Heat-resistant-lubricating-layer-coating liquid B1 | |
| Dispersion liquid for heat resistant lubricating layer B1 | 46.8 mass parts |
| Polyisocyanate (75% solution) (trade name: BURNOCK D-750, manufactured by DIC Corporation) | 2.3 mass parts |
| Methyl ethyl ketone/toluene mixture solvent | 50.9 mass parts |

TABLE 4

| Heat-sensitive transfer sheet Sample No. | Proportion of stretch of heat-sensitive transfer sheet (%) 1.3 ms/line First sheet | 1.3 ms/line Fifth sheet | 0.7 ms/line First sheet | 0.7 ms/line Fifth sheet | Image evaluation 1.3 ms/line | 0.7 ms/line |
|---|---|---|---|---|---|---|
| 101a | 1.8 | 1.5 | 2.8 | 2.1 | C | D |
| 102a | 1.9 | 1.4 | 2.2 | 1.7 | B | C |
| 103a | 1.5 | 1.2 | 2.1 | 1.5 | A | B |
| 104a | 2.2 | 2.0 | 7.1 | 3.9 | B | D |
| 105a | 1.8 | 1.5 | 2.2 | 1.6 | B | B |
| 106a | 2.5 | 1.8 | 5.8 | 2.9 | C | E |

From the Tables 3 and 4, it is understood that, especially with respect to a first sheet of print in the higher-speed printing (a time required per line is shorter), a stretch of the heat-sensitive transfer sheet is conspicuous. Further, it is understood that image quality tends to become worse in case of the higher-speed printing. From these results, it is understood that suppression of the stretch of the heat-sensitive transfer sheet in combination with improvement of image quality such as more reduced image defects can be attained by controlling the average value of projected areas corresponding to talc particles and the variation coefficient to the specific range of the present invention.

Example 1-2

Production of Heat-Sensitive Transfer Sheet (201a)

Heat-sensitive transfer sheet (201a) was produced in the same manner as the heat-sensitive transfer sheet (103a) in Example 1-1, except that the composition of the dispersion liquid A1 for the heat-resistant lubricating layer and the composition of the coating liquid A1 for the heat-resistant lubricating layer were changed respectively as follows.

(Production of Heat-Sensitive Transfer Sheets (202a) to (209a))

Heat-sensitive transfer sheets (202a) and (203a) were produced in the same manner as the heat-sensitive transfer sheet (201a), except that the dispersion condition of the dispersion liquid B1 for the heal-resistant lubricating layer was changed. Heat-sensitive transfer sheets (204a) to (208a) were produced in the same manner as the heat-sensitive transfer sheet (201a), except that the dispersion condition of the dispersion liquid B1 for the heat-resistant lubricating layer was changed and the raw material talc was changed to that as described below. Further, heat-sensitive transfer sheet (209a) was produced in the same manner as the heat-sensitive transfer sheet (206a), except that the polyacrylic polyol resin of the dispersion liquid B1 for the heat-resistant lubricating layer was changed to the same amount (content) of polyvinyl acetal resin (S-LEC BX-1, trade name, manufactured by Sekisui Chemical Co., Ltd.), and further the amount of polyisocyanate was changed so that a ratio (—NCO/OH) of a reactive group of the polyisocyanate to a reactive group of the resin in the coating liquid for the heat-resistant lubricating layer was 1.1.

Heat-Sensitive Transfer Sheet (204a)

The raw material talc was changed to MICRO ACE P-3 (trade name, manufactured by NIPPON TALC Co., Ltd.;

average sphere-equivalent diameter of the particles: 4.9 μm; ratio (Y/X) of X-ray diffraction largest peak intensity (Y) originated from impurities to X-ray diffraction largest peak intensity (X) originated from talc: 0.06; shot-type abrasion degree: 11 mg).

Heat-Sensitive Transfer Sheet (205a)

The raw material talc was changed to Hi-Filler #5000 PJ (trade name, manufactured by Matsumura Sangyo K.K.; average sphere-equivalent diameter of the particles: 1.7 μm; ratio (Y/X) of X-ray diffraction largest peak intensity (Y) originated from impurities to X-ray diffraction largest peak intensity (X) originated from talc: 0.07; shot-type abrasion degree: 7 mg).

Heat-Sensitive Transfer Sheet (206a)

The raw material talc was changed to a mixture having a ratio by mass of 85:15 of Hi-Filler #5000 PJ (trade name, manufactured by Matsumura Sangyo K.K.) to all of the synthetic magnesium oxide (composition: MgO, Mohs hardness: 4, average sphere-equivalent diameter of the particles: 1.2 μm, average ratio of longest width of each particle to sphere-equivalent diameter: 8.5). The ratio (Y/X) of X-ray diffraction largest peak intensity (Y) originated from magnesium oxide to X-ray diffraction largest peak intensity (X) originated from talc as a mixture was 0.23. The shot-type abrasion degree was 23 mg.

Heat-Sensitive Transfer Sheet (207a)

The raw material talc was changed to a mixture having a ratio by mass of 85:15 of Hi-Filler #5000 PJ (trade name, manufactured by Matsumura Sangyo K.K.) to all of the synthetic magnesium hydroxide (composition: $Mg(OH)_2$, Mohs hardness: 2.5, average sphere-equivalent diameter of the particles: 0.8 μm, average ratio of longest width of each particle to sphere-equivalent diameter: 12.5). The ratio (Y/X) of X-ray diffraction largest peak intensity (Y) originated from magnesium hydroxide to X-ray diffraction largest peak intensity (X) originated from talc as a mixture was 0.21. The shot-type abrasion degree was 8 mg.

Heat-Sensitive Transfer Sheet (208a)

The raw material talc was changed to a mixture having a ratio by mass of 85:15 of Hi-Filler #5000 PJ (trade name, manufactured by Matsumura Sangyo K.K.) to all of the synthetic silica (composition: $SiO_2$, Mohs hardness: 7, average sphere-equivalent diameter of the particles: 1.1 μm, average ratio of longest width of each particle to sphere-equivalent diameter: 20.5). The ratio (Y/X) of X-ray diffraction largest peak intensity (Y) originated from silica to X-ray diffraction largest peak intensity (X) originated from talc as a mixture was 0.28. The shot-type abrasion degree was 35 mg.

The projected areas of talc particles in the heat-resistant lubricating layer of the heat-sensitive transfer sheets (201a) to (209a) produced above were measured in the same manner as in Example 1-1. Further, average projected area and variation coefficient were calculated from the above projected areas of talc particles. Further, the number of talc particles having a projected area of 100 square μm or more was counted. From these data, the number of talc particles having projected area of 100 square μm or more present in the heat-resistant lubricating layer per area of 200,000 square μm thereof was calculated. The results are shown in Table 5.

TABLE 5

| The heat-sensitive transfer sheets Sample No. | Average projected area of talc particles having projected area of 10 square μm or more (square μm) | Variation coefficient of projected area of talc particles having projected area of 10 square μm or more | The number of talc particles having projected area of 100 square μm or more (per area of 200,000 square μm of the heat-resistant lubricating layer) |
|---|---|---|---|
| 201a | 31.5 | 0.64 | 0.5 |
| 202a | 41.5 | 0.58 | 1.4 |
| 203a | 24.8 | 0.65 | 2.8 |
| 204a | 28.5 | 0.56 | 0.8 |
| 205a | 22.5 | 0.51 | 0.5 |
| 206a | 23.1 | 0.50 | 0.2 |
| 207a | 22.5 | 0.48 | 0.5 |
| 208a | 23.5 | 0.55 | 0.8 |
| 209a | 26.3 | 0.50 | 0.2 |

From the Table 5, it is understood that the average value of projected areas of talc particle in the heat-resistant lubricating layer and the values of variation coefficient can be controlled to the specific range of the present invention, irrespective of a quantity of impurities of the raw material talc and an abrasion degree of the raw material talc, and talc-excluding inorganic particles that are used together with the talc.

(Formation, Measurement and Evaluation of Images)

Using the hest-sensitive transfer sheets (201a) to (209a), image formation, measurement and evaluation were carried out in the same manner as those in Example 1-1, except that the line speed of the thermal transfer printer was changed from 1.3 msec/line to 0.55 msec/line.

The results are shown in Table 6 described below.

TABLE 6

| Heat-sensitive transfer sheet Sample No. | Proportion of stretch of heat-sensitive transfer sheet (%) 0.7 ms/line First sheet | 0.7 ms/line Fifth sheet | 0.55 ms/line First sheet | 0.55 ms/line Fifth sheet | Image evaluation 0.7 ms/line | 0.55 ms/line |
|---|---|---|---|---|---|---|
| 201a | 2.2 | 1.9 | 3.9 | 2.8 | C | D |
| 202a | 2.2 | 1.8 | 2.7 | 2.1 | B | E |
| 203a | 1.9 | 1.2 | 4.1 | 2.2 | C | E |
| 204a | 2.4 | 2.0 | 2.8 | 2.2 | B | C |
| 205a | 1.8 | 1.5 | 2.5 | 2.2 | B | C |
| 206a | 2.1 | 1.8 | 2.5 | 2.2 | A | B |
| 207a | 2.2 | 1.8 | 2.5 | 2.1 | B | C |
| 208a | 2.3 | 1.9 | 2.7 | 2.1 | B | D |
| 209a | 2.2 | 1.7 | 2.4 | 2.3 | B | C |

From the Table 6, it is understood that the heat-sensitive transfer sheets (201a) to (209a) in which various raw material talc is used and/or inorganic particles other than the talc are used together with the talc are each within the present invention whereby a stretch of the heat-sensitive transfer sheet is small at printing speed of 0.7 ms/line and also image quality is allowable. Further, it is understood that, under the high-speed printing condition of 0.55 ms/line, the heat-sensitive transfer sheets (202a) and (204a) to (209a) each having a more preferable variation coefficient of 0.6 or less each show a high effect of suppressing a stretch of the heat-sensitive transfer sheet especially at a first sheet of print. Further, it is understood that image quality is more improved in sample (206a) in which the talc is used together with magnesium oxide as the inorganic particle other than the talc, the inorganic particles having such characteristic properties that Mohs hardness is from 3 to 6, the average sphere-equivalent diameter of the particles is from 0.3 μm to 5 and an average ratio of the largest width of each particle to a sphere-equivalent diameter thereof is from 1.5 to 50. Further, it is understood that the sample (206a), in which polyacryl polyol as a resin in the heat-resistant lubricating layer is used, provides better image evaluation results than those of the sample (209a) in which polyvinyl acetal is used as the resin.

Example 1-3

Production of Heat-Sensitive Transfer Sheet (301a)

Heat-sensitive transfer sheets (301a) to (304a) were each produced in the same manner as the heat-sensitive transfer sheet (206a) in Example 1-2, except that the heat treatment condition (60° C. and 20 hours) for conducting a crosslinking reaction between the isocyanate and the polyol was changed to the condition of 55° C. and 2.5 days; the condition of 50° C. and 7 days; the condition of 42° C. and 18 days; and the condition of 36° C. and 30 days, respectively. The presence of an unreacted isocyanate group after a heat treatment was confirmed by IR measurement. As a result, it was confirmed that a crosslinking reaction was completed under any heat processing condition.

Each projected area of each talc particle in the heat-resistant lubricating layer of the heat-sensitive transfer sheets (301a) to (304a) produced above was obtained in the same manner as in Example 1-1. Further, average projected area and variation coefficient were obtained from the each projected area of each talc particle. Further, the number of talc particles having a projected area of 100 square μm or more was counted. From these data, the number of such talc particles present in the heat-resistant lubricating layer per area of 200,000 square μm thereof was calculated. The results are shown in Table 7 described below.

TABLE 7

| The heat-sensitive transfer sheets Sample No. | Average projected area of talc particles having projected area of 10 square μm or more (square μm) | Variation coefficient of projected area of talc particles having projected area of 10 square μm or more | The number of talc particles having projected area of 100 square μm or more (per area of 200,000 square μm of the heat-resistant lubricating layer) |
|---|---|---|---|
| 301a | 23.5 | 0.51 | 0.5 |
| 302a | 23.8 | 0.50 | 0.4 |
| 303a | 24.0 | 0.53 | 0.7 |
| 304a | 22.9 | 0.52 | 0.3 |

From the Table 7, it is understood that, with respect to each of the heat-sensitive transfer sheets (301a) to (304a) in which a heat treatment condition for the crosslinking reaction at the time of forming a heat-resistant lubricating layer has been changed, average values of projected areas of talc particles in the heat-resistant lubricating layer and values of variation coefficient are each within the specific range defined in the present invention.

(Formation, Measurement and Evaluation of Images)

Image formation, measurement and evaluation were carried out in the same manner as those in Example 1-2, except for using the heat-sensitive transfer sheets (301a) to (304a).

The results are shown in Table 8 described below.

TABLE 8

| Heat-sensitive transfer sheet Sample No. | Proportion of stretch of heat-sensitive transfer sheet (%) 0.7 ms/line First sheet | 0.7 ms/line Fifth sheet | 0.55 ms/line First sheet | 0.55 ms/line Fifth sheet | Image evaluation 0.7 ms/line | 0.55 ms/line |
|---|---|---|---|---|---|---|
| 301a | 2.2 | 1.9 | 2.5 | 2.2 | A | B |
| 302a | 2.2 | 1.8 | 2.4 | 1.8 | A | A |
| 303a | 2.2 | 1.2 | 2.4 | 1.7 | A | A |
| 304a | 2.4 | 2.0 | 2.8 | 2.2 | A | C |

From the Table 8, it is understood that among samples (301a) to (304a), especially samples (302a) and (303a), in which the heat treatment condition has been set in the range of from 40° C. to 53° C. and from 1 day to 20 days, are each able to reduce a stretch of the heat-sensitive transfer sheet and to improve image quality much even under higher-speed print condition.

Example 2-1

Production of Heat-sensitive Transfer Sheets

As a base film, was used a 4.5 μm thick polyester film on one surface of which an easy adhesion layer was previously formed. On the other surface of the polyester film, the below-described heat-resistant lubricating layer-coating liquid A2 was coated so that the solid coating amount would be 1.1 g/m$^2$ after drying. In the below-described heat-resistant lubricating layer-coating liquid A2, the ratio of reactive groups of polyisocyanate to those of the resin (—NCO/OH) was 1.0. Immediately after coating, the film was dried at 100° C. for 1 minute in an oven, and continuously subjected to a heat treatment at 60° C. for 24 hours so that a crosslinking reaction between the isocyanate and a polyol could be conducted to cure the heat-resistant lubricating layer. After the heat treatment, the presence of unreacted isocyanate group was checked by IR measurement and confirmed that the reaction had been completed.

Coating liquids, which will be detailed later, were used to form, onto the easily-adhesive layer coated surface of the thus-formed polyester film having the heat-resistant lubricating layer, individual dye layers (heat-sensitive transfer layers) in yellow, magenta and cyan, and a transferable protective layer laminate in area order by coating. In this way, a heat-sensitive transfer sheet was produced. The solid coating amount in each of the dye layers was set to 0.9 g/m$^2$. Immediately after the coating, the workpiece was dried at 100° C. in an oven for 1 minute.

In the formation of the transferable protective layer laminate, a releasing-layer-coating liquid was applied, and a protective-layer-coating liquid was applied thereon. The resultant was dried, and then an adhesive-layer-coating liquid was applied thereon.

| Dispersion liquid for heat resistant lubricating layer A2 | |
|---|---|
| Polyvinylacetal resin (trade name: S-LEC BX-1, manufactured by Sekisui Chemical Co., Ltd.) | 10.0 mass parts |
| Phosphate having —OH group (Compound represented by formula (P)) (trade name: Phoslex A-18, manufactured by Sakai Chemical Industry Co., Ltd., the number of carbon atoms in the alcohol moiety: 18) | 1.5 mass parts |
| Zinc stearate | 0.2 mass part |
| Raw talc (average sphere-equivalent diameter of the particles: 2.9 μm; ratio (Y/X) of the largest peak intensity (Y) of X-ray diffraction originated from impurities to the largest peak intensity (X) of X-ray diffraction originated from talc: 0.15; shot-type abrasion degree: 25 mg) | 1.1 mass parts |
| Methyl ethyl ketone/toluene mixture solvent | 87.0 mass parts |

The resin and the solvent for the above-described dispersion liquid for heat-resistant lubricating layer were previously dissolved. To the resultant solution, other additives were added, and a premixing was conducted. Thereafter, dispersion was performed under any one of the following three conditions.

| | |
|---|---|
| (Condition 2-1) | Dispersion for 130 minutes using a paint shaker |
| (Condition 2-2) | Dispersion at 250 rpm for 45 minutes using a planet type ball mill P-7 (trade name) manufactured by FRITSCH (Germany) Corporation |
| (Condition 2-3) | Dispersion at 400 rpm for 50 minutes using a planet type ball mill P-7 (trade name) manufactured by FRITSCH (Germany) Corporation. |

-continued

| Heat-resistant-lubricating-layer-coating liquid A2 | |
|---|---|
| Dispersion liquid for heat resistant lubricating layer A2 | 32.0 mass parts |
| Polyisocyanate (75% solution) (trade name: BURNOCK D-750, manufactured by DIC Corporation) | 8.0 mass parts |
| Methyl ethyl ketone/toluene mixture solvent | 75.0 mass parts |
| **Yellow-dye-coating liquid** | |
| Yellow-dye described in Table 11 | 5.1 mass parts |
| Dye compound (YC) | 0.8 mass part |
| Polyvinylacetal resin (trade name: DENKA BUTYRAL #5000-D, manufactured by DENKI KAGAKU KOGYOU K. K.) | 6.9 mass parts |
| Fluorine-containing polymer compound (trade name: Megafac F-472SF, manufactured by DIC Corporation) | 0.1 mass part |
| Matting agent (trade name: Flo-thene UF, manufactured by Sumitomo Seika Chemicals Co., Ltd.) | 0.09 mass part |
| Methyl ethyl ketone/toluene mixture solvent | 85 mass parts |
| **Magenta-dye-coating liquid** | |
| The same liquid as that used in Example 1-1 was used. | |
| **Cyan-dye-layer-coating liquid** | |
| The same liquid as that used in Example 1-1 was used. | |

YC

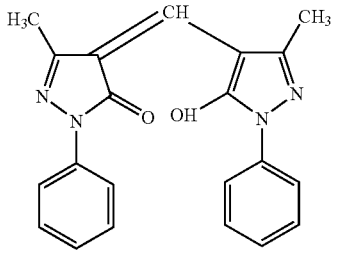

(Transferable Protective Layer Laminate)

On the polyester film coated with the dye layers as described above, a releasing layer-coating liquid, a protective layer-coating liquid, and an adhesive layer-coating liquid each having the same compositions as those described in Example 1-1 were each coated, to prepare a transferable protective layer laminate. The coating amount of each layer in the form of dried film was also the same as that in Example 1-1.

(Preparation of Heat-transfer Image-receiving Sheet (Z-1))

A synthetic paper (trade name: Yupo PPG 200, manufactured by Yupo Corporation, thickness: 200 μm) was used as the support; and, on one surface of the support, a white intermediate layer and a receptor layer, having the following compositions, were coated in this order by a bar coater. The coating was carried out such that the amount of the white intermediate layer and the amount of the receptor layer after each layer was dried would be 1.0 g/m$^2$ and 4.0 g/m$^2$, respectively, and the resulting film was dried after coating, processed into a shape suitable for the settings of a printer described below, to give a heat-sensitive transfer image-receiving sheet (Z-1).

| White intermediate layer | |
|---|---|
| Polyester resin (trade name: Vylon 200, manufactured by Toyobo Co., Ltd.) | 10 mass parts |
| Fluorescent whitening agent (trade name: Uvitex OB, manufactured by Ciba-Geigy) | 1 mass part |
| Titanium oxide | 30 mass parts |
| Methyl ethyl ketone/toluene (1/1, at mass ratio) | 90 mass parts |
| Receptor layer | |
| Vinyl chloride/vinyl acetate copolymer (trade name: Solbin A, manufactured by Nisshin Chemicals Co., Ltd.) | 100 mass parts |
| Amino-modified silicone (trade name: X22-3050C, manufactured by Shin-Etsu Chemical Co., Ltd.) | 5 mass parts |
| Epoxy-modified silicone (trade name: X22-3000E, manufactured by Shin-Etsu Chemical Co., Ltd.) | 5 mass parts |
| Methyl ethyl ketone/toluene (1/1, at mass ratio) | 400 mass parts |

(Preparation of Heat-sensitive Transfer Image-receiving Sheet (Z-2))

A paper support, on both sides of which polyethylene was laminated, was subjected to corona discharge treatment on the surface thereof, and then a gelatin undercoat layer containing sodium dodecylbenzenesulfonate was disposed on the treated surface. The subbing layer, the heat insulation layer, the lower receptor layer and the upper receptor layer each having the following composition were multilayer-coated on the gelatin undercoat layer, in the state that the subbing layer, the heat insulation layer, the lower receptor layer and the upper receptor layer were laminated in this order from the side of the support, by a method illustrated in FIG. 9 in U.S. Pat. No. 2,761,791. The coating was performed so that coating amounts of the subbing layer, the heat insulation layer, the lower receptor layer and the upper receptor layer after drying would be 6.0 g/m$^2$, 8.5 g/m$^2$, 2.4 g/m$^2$ and 3.0 g/m$^2$, respectively. The resulting composite was dried and then heat-treated at 30° C. for 5 days, subjected to crosslinking reaction with a crosslinking agent and gelatin, and processed into a shape suitable for the settings of a printer described below, to give Heat-sensitive transfer image-receiving sheet (Z-2).

| Upper receptor layer | |
|---|---|
| Vinyl chloride-series latex (trade name: Vinybran 900, manufactured by Nisshin Chemicals Co., Ltd.) | 21.0 mass parts |
| Vinyl chloride-series latex (trade name: Vinybran 276, manufactured by Nisshin Chemicals Co., Ltd.) | 1.6 mass parts |
| Gelatin (10% solution) | 2.5 mass parts |
| Ester-series wax EW-1 | 1.8 mass parts |
| Surfactant F-1 | 0.1 mass part |
| Surfactant F-2 | 0.4 mass part |
| Lower receptor layer | |
| Vinyl chloride-series latex (Tg = 46° C.) (trade name: Vinybran 690, manufactured by Nisshin Chemicals Co., Ltd.) | 18.0 mass parts |
| Vinyl chloride-series latex (Tg = 73° C.) (trade name: Vinybran 900, manufactured by Nisshin Chemicals Co., Ltd.) | 8.0 mass parts |
| Gelatin (10% solution) | 8.0 mass parts |
| Surfactant F-1 | 0.03 mass part |
| Heat insulation layer | |
| Acrylic styrene based hollow polymer particles (average particle size: 0.5 μm, trade name: MH5055, manufactured by Nippon Zeon Co., Ltd.) | 66.0 mass parts |

-continued

| | |
|---|---|
| Gelatin (10% solution) | 24.0 mass parts |
| Sodium salt of 2,4-dichloro-6-hydroxy-s-triazine (Crosslinking agent) | 0.1 mass part |
| Subbing layer | |
| Polyvinyl alcohol (trade name: POVAL PVA 205, manufactured by Kuraray) | 7.0 mass parts |
| Styrene butadiene rubber latex (trade name: SN-307, manufactured by NIPPON A & L INC) | 55.0 mass parts |
| Surfactant F-1 | 0.02 mass part |

The sample produced by using the dispersion liquid for the heat-resistant lubricating layer A2 prepared under the condition 2-1 was designated as a heat-resistant lubricating layer (101b), the sample produced by using the dispersion liquid for the heat-resistant lubricating layer A2 prepared under the condition 2-2 was designated as a heat-resistant lubricating layer (102b), and the sample produced by using the dispersion liquid for the heat-resistant lubricating layer A2 prepared under the condition 2-3 was designated as a heat-resistant lubricating layer (103b). Heat-resistant lubricating layers (104b) to (106b) were produced in the same manner as the heat-resistant lubricating layers (101b) to (103b), except that the phosphate having a OH group in the heat-resistant lubricating layer was changed from a single use of Phoslex-A-18 (manufactured by Sakai Chemical Industry Co., Ltd.) to a 2:8 mixture (mass ratio) of Phoslex-A-18 (trade name, manufactured by Sakai Chemical Industry Co., Ltd.) and PLYSURF A208N, (manufactured by Dai-ichi Kogyo Seiyaku Co., Ltd.: a mixture of mono- and di-polyoxyalkylenealkylether phosphate).

(Projected Area of Talc Particles in Heat-resistant Lubricating Layer)

With respect to the heat-resistant lubricating layers (101b) to (106b), the projected area of talc particles was calculated in the same manner as in Example 1-1.

The composition of the heat-resistant lubricating layer and the above-described values are shown in Table 9.

TABLE 9

| Heat-resistant lubricating layer No. | The kind of phosphate represented by formula (P) | Dispersion condition | Average projected area of talc particles having projected area of 10 square μm or more (square μm) | Variation coefficient of projected area of talc particles having projected area of 10 square μm or more |
|---|---|---|---|---|
| 101b | Phoslex A-18 | Condition 2-1 | 80.2 | 0.78 |
| 102b | | Condition 2-2 | 36.1 | 0.65 |
| 103b | | Condition 2-3 | 25.2 | 0.57 |
| 104b | Phoslex A-18 | Condition 2-1 | 73.3 | 0.81 |
| 105b | and PLYSURF | Condition 2-2 | 22.4 | 0.65 |
| 106b | A208N | Condition 2-3 | 41.2 | 0.83 |

From the Table 9, it is understood that the average value of projected areas of talc particles in the heat-resistant lubricating layer and the variation coefficient each diversely vary depending on the dispersion condition, even though the raw material talc is identical. Provided that the promotion of talc dispersion is effective to the present invention, the average value of projected areas of talc particles and the variation coefficient each should be the smallest value in the dispersion condition 2-3 that is the strongest dispersion condition. However, the results are not entirely true. Accordingly, it is understood that the average value of projected areas of talc particles and the variation coefficient each cannot be controlled to the specific range defined in the present invention simply by strengthening the dispersion condition.

Production of Heat-Resistant Lubricating Layer (201b)

Heat-resistant lubricating layer (201b) was produced in the same manner as the heat-resistant lubricating layer (103b) in Example 2-1, except that the composition of the dispersion liquid for heat-resistant lubricating layer and the composition of the coating liquid for the heat-resistant lubricating layer were changed respectively as follows.

| Dispersion liquid for heat resistant lubricating layer B2 | |
|---|---|
| Polyacrylpolyol-series resin (50% solution) (trade name: ACRYDIC A-801-P, manufactured by DIC Corporation; Hydroxyl value relative to resin content: 100 ± 6; Acid value: 2 to 8) | 16.5 mass parts |
| Phosphate having —OH group (Compound represented by formula (P)) (trade name: Phoslex A-18, manufactured by Sakai Chemical Industry Co., Ltd.) | 0.15 mass part |
| Phosphate having —OH group (compound represented by formula (P)) (trade name: PLYSURF A208N, manufactured by Dai-ichi Kogyo Seiyaku Co., Ltd.) | 0.87 mass part |
| Zinc stearate | 0.07 mass part |
| Stearylzinc phosphate | 0.07 mass part |
| Raw talc (trade name: MICRO ACE L-1, manufactured by NIPPON TALC Co., Ltd.) (average sphere-equivalent diameter of the particles: 4.5 μm; ratio (Y/X) of the largest peak intensity (Y) of X-ray diffraction originated from impurities to the largest peak intensity (X) of X-ray diffraction originated from talc: 0.38; shot-type abrasion degree: 21 mg) | 0.60 mass part |
| Methyl ethyl ketone/toluene mixture solvent | 81.5 mass parts |
| Heat-resistant-lubricating-layer-coating liquid B2 | |
| Dispersion liquid for heat resistant lubricating layer B2 | 46.6 mass parts |
| Polyisocyanate (75% solution) (trade name: BURNOCK D-750, manufactured by DIC Corporation) | 2.2 mass parts |
| Methyl ethyl ketone/toluene mixture solvent | 51.0 mass parts |

Production of Heat-Resistant Lubricating Layers (202b) to (209b)

Heat-resistant lubricating layers (202b) and (203b) were produced in the same manner as the heat-resistant lubricating layer (201b), except that the dispersion condition of the dispersion liquid for the heat-resistant lubricating layer was each changed. Further, heat-resistant lubricating layers (204b) to (208b) were produced in the same manner as the heat-resistant lubricating layers (201b), except that the dispersion condition of the dispersion liquid for the heat-resistant lubricating layer was each changed and the raw material talc was changed to the following material.

Heat-Resistant Lubricating Layer (204b)

The raw material talc was changed to MICRO ACE P-3 (trade name, manufactured by NIPPON TALC Co., Ltd.; average sphere-equivalent diameter of the particles: 4.9 μm; ratio (Y/X) of X-ray diffraction largest peak intensity (Y) originated from impurities to X-ray diffraction largest peak intensity (X) originated from talc: 0.05; shot-type abrasion degree: 11 mg).

Heat-Resistant Lubricating Layer (205b)

The raw material talc was changed to Hi-Filler #5000 PJ (trade name, manufactured by Matsumura Sangyo K.K.; average sphere-equivalent diameter of the particles: 1.7 μm; ratio (Y/X) of X-ray diffraction largest peak intensity (Y) originated from impurities to X-ray diffraction largest peak intensity (X) originated from talc: 0.06; shot-type abrasion degree: 7 mg).

Heat-Resistant Lubricating Layer (206b)

The raw material talc was changed to a mixture having a ratio by mass of 85:15 of Hi-Filler #5000 PJ (trade name, manufactured by Matsumura Sangyo K.K.) to all of the synthetic magnesium oxide (composition: MgO, Mohs hardness: 4, average sphere-equivalent diameter of the particles: 1.2 μm, average ratio of longest width of each particle to sphere-equivalent diameter: 8.5). The ratio (Y/X) of X-ray diffraction largest peak intensity (Y) originated from magnesium oxide to X-ray diffraction largest peak intensity (X) originated from talc as a mixture was 0.22. The shot-type abrasion degree was 23 mg.

Heat-Resistant Lubricating Layer (207b)

The raw material talc was changed to a mixture having a ratio by mass of 85:15 of Hi-Filler #5000 PJ (trade name, manufactured by Matsumura Sangyo K.K.) to all of the synthetic magnesium hydroxide (composition: $Mg(OH)_2$, Mohs hardness: 2.5, average sphere-equivalent diameter of the particles: 0.8 μm, average ratio of longest width of each particle to sphere-equivalent diameter: 12.3). The ratio (Y/X) of X-ray diffraction largest peak intensity (Y) originated from magnesium hydroxide to X-ray diffraction largest peak intensity (X) originated from talc as a mixture was 0.20. The shot-type abrasion degree was 8 mg.

Heat-Resistant Lubricating Layer (208b)

The raw material talc was changed to a mixture having a ratio by mass of 85:15 of Hi-Filler #5000 PJ (trade name, manufactured by Matsumura Sangyo K.K.) to all of the synthetic silica (composition: $SiO_2$, Mohs hardness: 7, average sphere-equivalent diameter of the particles: 1.1 μm, average ratio of longest width of each particle to sphere-equivalent diameter: 20.5). The ratio (Y/X) of X-ray diffraction largest peak intensity (Y) originated from silica to X-ray diffraction largest peak intensity (X) originated from talc as a mixture was 0.29. The shot-type abrasion degree was 36 mg.

Heat-Resistant Lubricating Layer (209b)

A heat-resistant lubricating layer (209b) was prepared in the same manner as the heat-resistant lubricating layer (206b), except that the polyacryl polyol-series resin of the dispersion liquid for heat-resistant lubricating layer B2 was changed to the same amount (solid content) of polyvinyl acetal resin (trade name: S-LEC BX-1, manufactured by Sekisui Chemical Co., Ltd.), and further the amount of polyisocyanate was changed so that a ratio (—NCO/OH) of a reactive group of the polyisocyanate to a reactive group of the resin in the coating liquid for heat-resistant lubricating layer B2 was 1.0.

The projected areas of talc particles in the heat-resistant lubricating layers (201b) to (209b) produced above were measured in the same manner as in Example 1-1. Further, average projected area and variation coefficient were calculated from the above projected areas of talc particles. Further, the number of talc particles having a projected area of 100 square μm or more was counted. From these data, the number of talc particles having projected area of 100 square μm or more present in the heat-resistant lubricating layer per area of 200,000 square μm thereof was calculated. The results are shown in Table 10 described below.

TABLE 10

| Heat-Resistant Lubricating Layer No. | Average projected area of talc particles having projected area of 10 square μm or more (square μm) | Variation coefficient of projected area of talc particles having projected area of 10 square μm or more | The number of talc particles having projected area of 100 square μm or more (per area of 200,000 square μm of the heat-resistant lubricating layer) |
|---|---|---|---|
| 201b | 30.4 | 0.62 | 0.4 |
| 202b | 40.6 | 0.59 | 1.2 |
| 203b | 23.4 | 0.66 | 2.9 |
| 204b | 27.2 | 0.54 | 0.7 |
| 205b | 23.7 | 0.50 | 0.5 |
| 206b | 24.2 | 0.51 | 0.3 |
| 207b | 23.4 | 0.46 | 0.5 |
| 208b | 24.6 | 0.53 | 0.8 |
| 209b | 26.1 | 0.51 | 0.3 |

From the Table 10, it is understood that the average value of projected areas of talc particles in the heat-resistant lubricating layer and the values of variation coefficient can be controlled to the specific range of the present invention, irrespective of a quantity of impurities of the raw material talc and an abrasion degree of the raw material talc, and talc-excluding inorganic particles that are used together with the talc.

Heat-sensitive transfer sheets shown in Tables 11 and 12 set forth below were each produced by combining any one of the heat-resistant lubricating layers (101b) to (106b) and (201b) to (209b) with one of various yellow dyes.

(Measurement Evaluation of Yellow Transfer Density)

Using the heat-sensitive transfer image-receiving sheet (Z-1) in combination, yellow solid images were output under the environment of 25° C. and 50% RH using a Fujifilm Thermal Photo Printer ASK-2000 (trade name) manufactured by FUJIFILM Corporation. Reflection densities of the images were measured using X-rite 310 (trade name, manufacture by X-rite Corporation). The Y density obtained by measurement under the above-described condition was defined as the yellow transfer density.

(Transfer Evaluation of Dye to Heat-Resistant Lubricating Layer)

With respect to each sample, a sample having both a yellow dye layer and a heat-resistant lubricating layer, and a sample having only the same heat-resistant lubricating layer were prepared separately. A yellow transmission density of each of the samples having only the heat-resistant lubricating layer was measured in advance using the above-described X-rite 310. This density is designated as Fr density. The yellow dye layer of the sample having both a yellow dye layer and a heat-resistant lubricating layer was brought to contact the heat-resistant lubricating layer of the sample having only the heat-resistant lubricating layer. Then, from above direction to the sample, average 10 g/cm$^2$ of load was applied, and further the sample was left to stand for 14 days in a thereto-hygrostat of 40° C. and 60% RH. Thereafter, a yellow transmission density of each of the samples having only the heat-resistant lubricating layer was measured using the X-rite 310 in the same manner as the Fr density. A difference between the transmission density after over time and the Fr density was calculated. An increase in the density was used as an index of dye transfer to the heat-resistant lubricating layer (transfer evaluation (ΔD). When this value ΔD is 0.010 or less, it indicates that there is almost no decomposed matter of dye due to the thermal head. When this value ΔD is more than 0.010 and less than 0.030, it indicates that there is a little decomposed matter of dye which does not cause any significant image-face defect in practical use. Further, when this value ΔD is 0.030 or more, it indicates that the decomposed matter of dye is accumulated, which results in image-face defects such as streak. In view of the above, determination was made according to the following criterion:

The value of 0.3 or more is problematic,

The value of more than 0.010 and less than 0.30 is allowable, and

The value of 0.010 or less is good.

The results are summarized in Tables 11 and 12.

TABLE 11

| Heat-Sensitive Transfer Sheet No. | Heat-resistant lubricating layer No. | Yellow dye | Print Dmax density of yellow | Transfer evaluation (ΔD) |
|---|---|---|---|---|
| Sample 1 | 101b | YA | 1.54 | 0.050 |
| Sample 2 | 102b | YA | 1.52 | 0.032 |
| Sample 3 | 103b | YA | 1.51 | 0.030 |
| Sample 4 | 104b | YA | 1.56 | 0.052 |
| Sample 5 | 105b | YA | 1.53 | 0.032 |
| Sample 6 | 106b | YA | 1.55 | 0.052 |
| Sample 7 | 201b | YA | 1.52 | 0.030 |
| Sample 8 | 202b | YA | 1.59 | 0.035 |
| Sample 9 | 203b | YA | 1.58 | 0.034 |
| Sample 10 | 204b | YA | 1.55 | 0.032 |
| Sample 11 | 205b | YA | 1.53 | 0.031 |
| Sample 12 | 206b | YA | 1.53 | 0.031 |
| Sample 13 | 207b | YA | 1.58 | 0.035 |
| Sample 14 | 208b | YA | 1.59 | 0.037 |
| Sample 15 | 209b | YA | 1.59 | 0.035 |
| Sample 16 | 101b | YB | 2.3 | 0.053 |
| Sample 17 | 102b | YB | 2.32 | 0.034 |
| Sample 18 | 103b | YB | 2.36 | 0.036 |
| Sample 19 | 104b | YB | 2.38 | 0.059 |
| Sample 20 | 105b | YB | 2.38 | 0.038 |
| Sample 22 | 201b | YB | 2.35 | 0.034 |
| Sample 23 | 202b | YB | 2.31 | 0.031 |
| Sample 24 | 203b | YB | 2.32 | 0.032 |
| Sample 25 | 204b | YB | 2.38 | 0.036 |
| Sample 26 | 205b | YB | 2.35 | 0.034 |
| Sample 27 | 206b | YB | 2.32 | 0.032 |
| Sample 28 | 207b | YB | 2.31 | 0.031 |
| Sample 29 | 208b | YB | 2.37 | 0.038 |
| Sample 30 | 209b | YB | 2.37 | 0.036 |

TABLE 12

| Heat-Sensitive Transfer Sheet No. | Heat-resistant lubricating layer No. | Yellow dye | Print Dmax density of yellow | Transfer evaluation (ΔD) |
|---|---|---|---|---|
| Sample 31 | 101b | Y3 | 2.51 | 0.039 |
| Sample 32 | 102b | Y3 | 2.59 | 0.004 |

TABLE 12-continued

| Heat-Sensitive Transfer Sheet No. | Heat-resistant lubricating layer No. | Yellow dye | Print Dmax density of yellow | Transfer evaluation (ΔD) |
|---|---|---|---|---|
| Sample 33 | 103b | Y3 | 2.52 | 0.009 |
| Sample 34 | 104b | Y3 | 2.6 | 0.045 |
| Sample 35 | 105b | Y3 | 2.56 | 0.006 |
| Sample 36 | 106b | Y3 | 2.58 | 0.044 |
| Sample 37 | 201b | Y3 | 2.56 | 0.005 |
| Sample 38 | 202b | Y3 | 2.54 | 0.006 |
| Sample 39 | 203b | Y3 | 2.57 | 0.004 |
| Sample 40 | 204b | Y3 | 2.56 | 0.005 |
| Sample 42 | 206b | Y3 | 2.51 | 0.009 |
| Sample 43 | 207b | Y3 | 2.54 | 0.006 |
| Sample 44 | 208b | Y3 | 2.5 | 0.010 |
| Sample 45 | 209b | Y3 | 2.5 | 0.009 |
| Sample 46 | 101b | Y4 | 2.55 | 0.040 |
| Sample 47 | 102b | Y4 | 2.51 | 0.009 |
| Sample 48 | 103b | Y4 | 2.5 | 0.009 |
| Sample 49 | 104b | Y4 | 2.55 | 0.040 |
| Sample 50 | 105b | Y4 | 2.56 | 0.006 |
| Sample 51 | 106b | Y4 | 2.55 | 0.040 |
| Sample 52 | 201b | Y4 | 2.52 | 0.007 |
| Sample 53 | 202b | Y4 | 2.55 | 0.005 |
| Sample 54 | 203b | Y4 | 2.51 | 0.008 |
| Sample 55 | 204b | Y4 | 2.54 | 0.006 |
| Sample 56 | 205b | Y4 | 2.53 | 0.007 |
| Sample 57 | 206b | Y4 | 2.57 | 0.003 |
| Sample 58 | 207b | Y4 | 2.59 | 0.002 |
| Sample 59 | 208b | Y4 | 2.54 | 0.007 |
| Sample 60 | 209b | Y4 | 2.54 | 0.006 |

Here, the yellow dyes YA and YB each represent the following yellow dyes.

YA

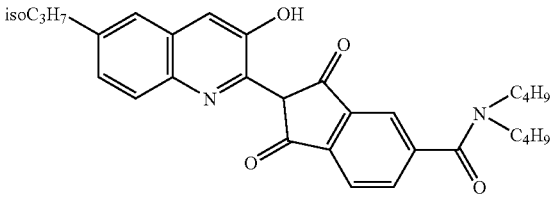

YB

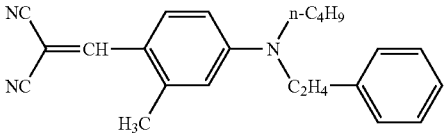

From the above Tables 11 and 12, it is understood that high yellow density can be obtained and also transfer of the dye to the heat-resistant lubricating layer can be conspicuously suppressed by each sample prepared by using the dye represented by formula (1) and the heat-resistant lubricating layer defined in the present invention.

Example 2-2

The same experimental test and evaluation as those in Example 2-1 were carried out except that the heat-sensitive transfer image-receiving sheet (Z-1) was replaced by the heat-sensitive transfer image-receiving sheet (Z-2). As a result, superior results than those of Example 2-1 were obtained.

Example 2-3

Production of Heat-Sensitive Transfer Sheets 61 to 68

Heat-resistant lubricating layers (301b) to (304b) were each prepared in the same manner as the heat-resistant lubricating layer (206a) in Example 2-2, except that the heat treatment condition for conducting a crosslinking reaction between isocyanate and polyol was changed to the condition of 56° C. and 2.5 days; the condition of 51° C. and 7 days; the condition of 40° C. and 18 days; and the condition of 35° C. and 30 days, respectively. The presence of an unreacted isocyanate group after a heat treatment was confirmed by IR measurement. As a result, it was confirmed that a crosslinking reaction was completed under any heat processing condition.

The projected areas of talc particles in the heat-resistant lubricating layer (301b) to (304b) of the heat-sensitive transfer sheets produced above were measured in the same manner as those in Example 2-1. Further, average projected area and variation coefficient were calculated from the above projected areas of talc particles. Further, the number of talc particles having a projected area of 100 square μm or more was counted. From these data, the number of talc particles having a projected area of 100 square μm or more present in the heat-resistant lubricating layer per area of 200,000 square μm thereof was calculated. The results are shown in Table 13 described below.

TABLE 13

| Heat-Resistant Lubricating Layer No. | Average projected area of talc particles having projected area of 10 square μm or more (square μm) | Variation coefficient of projected area of talc particles having projected area of 10 square μm or more | The number of talc particles having projected area of 100 square μm or more (per area of 200,000 square μm of the heat-resistant lubricating layer) |
|---|---|---|---|
| 301b | 23.5 | 0.50 | 0.4 |
| 302b | 23.8 | 0.51 | 0.5 |
| 303b | 24.0 | 0.52 | 0.6 |
| 304b | 22.9 | 0.53 | 0.4 |

Heat-sensitive transfer sheet Nos. 61 to 68 were produced in the same manner as the heat-sensitive transfer sheet sample No. 42, except that the heat-resistant lubricating layer and the yellow dye were changed to those shown in the following Table 14, respectively, and further evaluated in the same manner as in Example 2-1.

The results are shown in Table 14 described below.

TABLE 14

| Heat-Sensitive Transfer Sheet No. | Heat-resistant lubricating layer No. | Yellow dye | Print Dmax density of yellow | Transfer evaluation (ΔD) |
|---|---|---|---|---|
| Sample 61 | 301b | Y3 | 2.51 | 0.007 |
| Sample 62 | 302b | Y3 | 2.59 | 0.002 |
| Sample 63 | 303b | Y3 | 2.59 | 0.002 |
| Sample 64 | 304b | Y3 | 2.60 | 0.003 |
| Sample 65 | 301b | Y4 | 2.51 | 0.008 |
| Sample 66 | 302b | Y4 | 2.59 | 0.002 |
| Sample 67 | 303b | Y4 | 2.60 | 0.001 |
| Sample 68 | 304b | Y4 | 2.51 | 0.008 |

From the above Table 14, it is understood that more preferable results can be attained by controlling the heat treatment condition in the range of from 40° C. to 53° C. and from 1 day to 20 days.

Example 3-1

Production of Heat-sensitive Transfer Sheet

As a base film, was used a 4.5 μm thick polyester film on one surface of which an easy adhesion layer was previously formed. On the other surface of the polyester film, the below-described heat-resistant lubricating layer-coating liquid A3 was coated so that the solid coating amount would be 1.1 g/m$^2$ after drying. In the below-described heat-resistant lubricating layer-coating liquid A3, the ratio of reactive groups of polyisocyanate to those of the resin (—NCO/OH) was 1.1. Immediately after coating, the film was dried at 100° C. for 1 minute in an oven, and continuously subjected to a heat treatment at 65° C. for 15 hours so that a crosslinking reaction between the isocyanate and a polyol could be conducted to cure the heat-resistant lubricating layer. After the heat treatment, the presence of unreacted isocyanate group was checked by IR measurement and confirmed that the reaction had been completed.

Coating liquids, which will be detailed later, were used to form, onto the easily-adhesive layer coated surface of the thus-formed polyester films each on which heat-resistant lubricating layer was formed, individual dye layers (heat-sensitive transfer layers) in yellow, magenta and cyan, and a transferable protective layer laminate in area order by coating. In this way, a heat-sensitive transfer sheet was produced. The solid coating amount in each of the dye layers was set to 0.9 g/m$^2$. Immediately after the coating, the workpiece was dried at 100° C. in an oven for 1 minute.

In the formation of the transferable protective layer laminate, a releasing-layer-coating liquid was applied, and a protective-layer-coating liquid was applied thereon. The resultant was dried, and then an adhesive-layer-coating liquid was applied thereon. The resultant was then dried. In this way, a heat-sensitive transfer sheet was formed.

| Dispersion liquid for heat resistant lubricating layer A3 | |
|---|---|
| Polyvinylacetal resin (trade name: S-LEC BX-1, manufactured by Sekisui Chemical Co., Ltd.) | 10.0 mass parts |
| Phosphate having —OH group (compound represented by formula (P)) (trade name: Phoslex A-18, manufactured by Sakai Chemical Industry Co., Ltd.; the number of carbon atoms in the alcohol moiety: 18) | 1.8 mass parts |
| Zinc stearate | 0.3 mass part |
| Raw talc (average sphere-equivalent diameter of the particles: 2.9 μm; ratio (Y/X) of the largest peak intensity (Y) of X-ray diffraction originated from impurities to the largest peak intensity (X) of X-ray diffraction originated from talc: 0.15; shot-type abrasion degree: 25 mg) | 1.5 mass parts |
| Methyl ethyl ketone/toluene mixture solvent | 86.4 mass parts |

The resin and the solvent for the above-described dispersion liquid for heat-resistant lubricating layer A3 were previously dissolved. To the resultant solution, other additives were added, and a premixing was conducted. Thereafter, dispersion was performed under any one of the three conditions 1-1, 1-2 and 1-3 in Example 1-1.

| Heat-resistant-lubricating-layer-coating liquid A3 | |
|---|---|
| Dispersion liquid for heat resistant lubricating layer A3 | 35.0 mass parts |
| Polyisocyanate (75% solution) (trade name: BURNOCK D-750, manufactured by DIC Corporation) | 5.0 mass parts |
| Methyl ethyl ketone/toluene mixture solvent | 60.0 mass parts |
| **Yellow-dye-coating liquid** | |
| Dye (Y-1) | 0.6 mass part |
| Dye (Y-2) | 0.6 mass part |
| Dye (Y-3) | 1.9 mass parts |
| Dye (Y-4) | 4.0 mass parts |
| Polyvinylacetal resin (trade name: DENKA BUTYRAL #5000-D, manufactured by DENKI KAGAKU KOGYOU K. K.) | 6.0 mass parts |
| Fluorine-based polymer (trade name: Megafac F-472SF, manufactured by DIC Corporation) | 0.1 mass part |
| Lithium salt of fluorocarboxylic acid (anionic and water-soluble) (trade name: Zonyl FSA manufactured by DuPont) | 0.01 mass parts |
| Matting agent (trade name: Flo-thene UF, manufactured by Sumitomo Seika Chemicals Co., Ltd.) | 0.12 mass part |
| Methyl ethyl ketone/Toluene (2/1, at mass ratio) | 85 mass parts |
| **Magenta-dye-coating liquid** | |
| Dye (M-2) | 3.9 mass parts |
| Dye (M-3) | 3.9 mass parts |
| Polyvinylacetal resin (trade name: DENKA BUTYRAL #5000-D, manufactured by DENKI KAGAKU KOGYOU K. K.) | 5.5 mass parts |
| Fluorine-based polymer (trade name: Megafac F-472 SF, manufactured by DIC Corporation) | 0.1 mass part |
| Anionic and water-soluble lithium salt of fluoro-carboxylic acid (trade name: Zonyl FSA, manufactured by DuPont) | 0.01 mass parts |
| Matting agent (trade name: Flo-thene UF, manufactured by Sumitomo Seika Chemicals Co., Ltd.) | 0.12 mass part |
| Methyl ethyl ketone/Toluene (2/1, at mass ratio) | 85 mass parts |
| **Cyan-dye-layer-coating liquid** | |
| Dye (C-1) | 0.7 mass part |
| Dye (C-2) | 5.7 mass parts |
| Dye (C-3) | 0.8 mass part |

-continued

| | |
|---|---|
| Polyvinylacetal resin (trade name: DENKA BUTYRAL #5000-D, manufactured by DENKI KAGAKU KOGYOU K. K.) | 5.8 mass parts |
| Fluorine-based polymer (trade name: Megafac F-472 SF, manufactured by DIC Corporation) | 0.1 mass part |
| Anionic and water-soluble lithium salt of fluoro-carboxylic acid (trade name: Zonyl FSA manufactured by DuPont) | 0.01 mass part |
| Matting agent (trade name: Flo-thene UF, manufactured by Sumitomo Seika Chemicals Co., Ltd.) | 0.12 mass part |
| Methyl ethyl ketone/Toluene (2/1, at mass ratio) | 85 mass parts |

Y-4

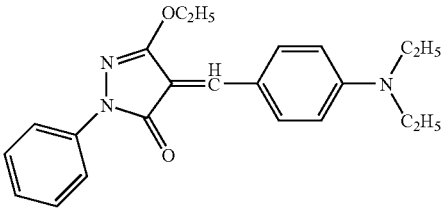

Transferable Protective Layer Laminate

On the polyester film coated with the dye layers as described above, coating solutions of a releasing layer, a protective layer and an adhesive layer each having the following composition was coated, to form a transferable protective layer laminate. Coating amounts of the releasing layer, the protective layer and the adhesive layer after drying were 0.5 g/m$^2$, 1.0 g/m$^2$ and 1.8 g/m$^2$, respectively.

| Releasing-layer-coating liquid | |
|---|---|
| Modified cellulose resin (trade name: L-30, manufactured by DAICEL CHEMICAL INDUSTRIES, LTD.) | 5.0 mass parts |
| Methyl ethyl ketone | 95.0 mass parts |
| **Protective-layer-coating liquid** | |
| Acrylic resin (trade name: DIANAL BR-100, manufactured by MITSUBISHI RAYON CO., LTD.) | 35 mass parts |
| Isopropanol | 75 mass parts |
| **Adhesive-layer-coating liquid** | |
| Acrylic resin (trade name: DIANAL BR-77, manufactured by MITSUBISHI RAYON CO., LTD.) | 25 mass parts |
| Ultraviolet absorber UV-1 | 1.5 mass parts |
| Ultraviolet absorber UV-2 | 1.5 mass parts |
| Ultraviolet absorber UV-3 | 1.2 mass parts |
| Ultraviolet absorber UV-4 | 0.8 mass part |
| Silicone resin fine particles (trade name: TOSPEARL 120, manufactured by MOMENTIVE Performance Materials Japan LLC.) | 0.06 mass part |
| Methyl ethyl ketone/Toluene (2/1, at mass ratio) | 70 mass parts |

(Preparation of Heat-transfer Image-receiving Sheet (Z-3))

A synthetic paper (trade name: Yupo FPG 200, manufactured by Yupo Corporation, thickness: 200 μm) was used as the support; and, on one surface of the support, a white intermediate layer and a receptor layer, having the following compositions, were coated in this order by a bar coater. The coating was carried out such that the amount of the white intermediate layer and the amount of the receptor layer after each layer was dried would be 1.0 g/m$^2$ and 4.0 g/m$^2$, respectively, and the resulting film was dried after coating, processed into a shape suitable for the settings of a printer described below, to give a heat-sensitive transfer image-receiving sheet (Z-3).

| White intermediate layer | |
|---|---|
| Polyester resin (trade name: Vylon 200, manufactured by Toyobo Co., Ltd.) | 14 mass parts |
| Fluorescent whitening agent (trade name: Uvitex OB, manufactured by Ciba-Geigy) | 2 mass parts |
| Titanium oxide | 32 mass parts |
| Methyl ethyl ketone/toluene (1/1, at mass ratio) | 82 mass parts |
| **Receptor layer** | |
| Vinyl chloride/vinyl acetate copolymer (trade name: Solbin A, manufactured by Nisshin Chemicals Co., Ltd.) | 100 mass parts |
| Amino-modified silicone (trade name: X22-3050C, manufactured by Shin-Etsu Chemical Co., Ltd.) | 12 mass parts |
| Epoxy-modified silicone (trade name: X22-3000E, manufactured by Shin-Etsu Chemical Co., Ltd.) | 10 mass parts |
| Methyl ethyl ketone/toluene (1/1, at mass ratio) | 350 mass parts |

(Preparation of heat-sensitive Transfer Image-receiving Sheet (Z-4))

A paper support, on both sides of which polyethylene was laminated, was subjected to corona discharge treatment on the surface thereof, and then a gelatin undercoat layer containing sodium dodecylbenzenesulfonate was disposed on the treated surface. The subbing layer, the heat insulation layer, the lower receptor layer and the upper receptor layer each having the following composition were multilayer-coated on the gelatin undercoat layer, in the state that the subbing layer, the heat insulation layer, the lower receptor layer and the upper receptor layer were laminated in this order from the side of the support, by a method illustrated in FIG. 9 in U.S. Pat. No. 2,761,791. The coating was performed so that coating amounts of the subbing layer, the heat insulation layer, the lower receptor layer and the upper receptor layer after drying would be 5.6 g/m$^2$, 9.2 g/m$^2$, 2.0 g/m$^2$ and 3.4 g/m$^2$, respectively. The resulting composite was dried and then heat-treated at 30° C. for 5 days, subjected to crosslinking reaction with a crosslinking agent and gelatin, and processed into a shape suitable for the settings of a printer described below, to give Heat-sensitive transfer image-receiving sheet (Z-4).

| Upper receptor layer | |
|---|---|
| Vinyl chloride-series latex (trade name: Vinybran 900, manufactured by Nisshin Chemicals Co., Ltd.) | 25.0 mass parts |
| Vinyl chloride-series latex (trade name: Vinybran 276, manufactured by Nisshin Chemicals Co., Ltd.) | 2.5 mass parts |
| Gelatin (10% solution) | 2.1 mass parts |
| Ester-series wax EW-1 | 1.0 mass part |
| Surfactant F-1 | 0.2 mass part |
| Surfactant F-2 | 0.2 mass part |
| **Lower receptor layer** | |
| Vinyl chloride-series latex (Tg = 46° C.) (trade name: Vinybran 690, manufactured by Nisshin Chemicals Co., Ltd.) | 17.0 mass parts |
| Vinyl chloride-series latex (Tg = 73° C.) (trade name: Vinybran 900, manufactured by Nisshin Chemicals Co., Ltd.) | 8.5 mass parts |

-continued

| | |
|---|---|
| Gelatin (10% solution) | 5.0 mass parts |
| Surfactant F-1 | 0.10 mass part |
| Heat insulation layer | |
| Acrylic styrene based hollow polymer particles (average particle size: 0.5 μm, trade name: MH5055, manufactured by Nippon Zeon Co., Ltd.) | 65.0 mass parts |
| Gelatin (10% solution) | 25.0 mass parts |
| Sodium salt of 2,4-dichloro-6-hydroxy-s-triazine (Crosslinking agent) | 0.2 mass part |
| Subbing layer | |
| Polyvinyl alcohol (trade name: POVAL PVA 205, manufactured by Kuraray) | 9.0 mass parts |
| Styrene butadiene rubber latex (trade name: SN-307, manufactured by NIPPON A & L INC) | 48.0 mass parts |
| Surfactant F-1 | 0.04 mass part |

The sample produced by using the dispersion liquid for the heat-resistant lubricating layer A3 prepared under the condition 1-1 was designated as a heat-resistant lubricating layer (101c), the sample produced by using the dispersion liquid for the heat-resistant lubricating layer A3 prepared under the condition 1-2 was designated as a heat-resistant lubricating layer (102c), and the sample produced by using the dispersion liquid for the heat-resistant lubricating layer A3 prepared under the condition 1-3 was designated as a heat-resistant lubricating layer (103c). Heat-resistant lubricating layers (104c) to (106c) were produced in the same manner as the heat-resistant lubricating layers (101c) to (103c), except that the phosphate having a OH group in the heat-resistant lubricating layer was changed from a single use of Phoslex-A-18 (manufactured by Sakai Chemical Industry Co., Ltd.) to a 2:8 mixture (mass ratio) of Phoslex-A-18 (trade name, manufactured by Sakai Chemical Industry Co., Ltd.) and PLYSURF A208N, (manufactured by Dai-ichi Kogyo Seiyaku Co., Ltd.: a mixture of mono- and di-polyoxyalkylenealkylether phosphate).

(Projected Area of Talc Particles in Heat-resistant Lubricating Layer)

With respect to the heat-resistant lubricating layers (101c) to (106c), the projected area of talc particles was calculated in the same manner as in Example 1-1.

The composition of the heat-resistant lubricating layer and the above-described values are shown in Table 15.

TABLE 15

| Heat-Resistant Lubricating Layer No. | The kind of phosphate represented by formula (P) | Dispersion condition | Average projected area of talc particles having projected area of 10 square μm or more (square μm) | Variation coefficient of projected area of talc particles having projected area of 10 square μm or more |
|---|---|---|---|---|
| 101c | Phoslex A-18 | Condition 1-1 | 82.7 | 0.83 |
| 102c | | Condition 1-2 | 35.5 | 0.68 |
| 103c | | Condition 1-3 | 24.0 | 0.55 |
| 104c | Phoslex A-18 | Condition 1-1 | 75.0 | 0.78 |
| 105c | and PLYSURF | Condition 1-2 | 22.5 | 0.66 |
| 106c | A208N | Condition 1-3 | 43.1 | 0.87 |

From the Table 15, it is understood that the average value of projected areas of talc particles in the heat-resistant lubricating layer and the variation coefficient each diversely vary depending on the dispersion condition, even though the raw material talc is identical. Provided that the promotion of talc dispersion is effective to the present invention, the average value of projected areas of talc particles and the variation coefficient each should be the smallest value in the dispersion condition 1-3 that is the strongest dispersion condition. However, the results are not entirely true. Accordingly, it is understood that the average value of projected areas of talc particles and the variation coefficient each cannot be controlled to the specific range defined in the present invention simply by strengthening the dispersion condition.

Production of Heat-Resistant Lubricating Layer (201c)

Heat-resistant lubricating layer (201c) was produced in the same manner as the heat-resistant lubricating layer (103c), except that the composition of the dispersion liquid for heat-resistant lubricating layer and the composition of the coating liquid for heat-resistant lubricating layer were changed respectively as follows.

| Dispersion liquid for heat resistant lubricating layer B3 | |
|---|---|
| Polyacrylpolyol-series resin (50% solution) (trade name: ACRYDIC A-801-P, manufactured by DIC Corporation; Hydroxyl value relative to resin content: 100 ± 6; Acid value: 2 to 8) | 18.0 mass parts |
| Phosphate having —OH group (compound represented by formula (P)) (trade name: Phoslex A-18, manufactured by Sakai Chemical Industry Co., Ltd.) | 0.15 mass part |
| Phosphate having —OH group (compound represented by formula (P)) (trade name: PLYSURF A208N, manufactured by Dai-ichi Kogyo Seiyaku Co., Ltd.) | 0.80 mass part |
| Zinc stearate | 0.07 mass part |
| Stearylzinc phosphate | 0.07 mass part |
| Raw talc (trade name: MICRO ACE L-1, manufactured by NIPPON TALC Co., Ltd.) (average sphere-equivalent diameter of the particles: 4.5 μm; ratio (Y/X) of the largest peak intensity (Y) of X-ray diffraction originated from impurities to the largest peak intensity (X) of X-ray diffraction originated from talc: 0.39; shot-type abrasion degree: 22 mg) | 0.70 mass part |
| Methyl ethyl ketone/toluene mixture solvent | 80.2 mass parts |

-continued

| Heat-resistant-lubricating-layer-coating liquid B3 | |
|---|---|
| Dispersion liquid for heat resistant lubricating layer B3 | 48.5 mass parts |
| Polyisocyanate (75% solution) (trade name: BURNOCK D-750, manufactured by DIC Corporation) | 2.0 mass parts |
| Methyl ethyl ketone/toluene mixture solvent | 49.5 mass parts |

Production of Heat-Resistant Lubricating Layers (202c) to (208c)

Heat-resistant lubricating layers (202c) and (203c) were produced in the same manner as the heat-resistant lubricating layer (201c), except that the dispersion condition of the dispersion liquid for the heat-resistant lubricating layer was each changed. Further, heat-resistant lubricating layers (204c) to (208c) were produced in the same manner as the heat-resistant lubricating layers (201c), except that the dispersion condition of the dispersion liquid for the heat-resistant lubricating layer was each changed and the raw material talc was changed to the following material.

Heat-Resistant Lubricating Layer (204c)

The raw material talc was changed to MICRO ACE P-3 (trade name, manufactured by NIPPON TALC Co., Ltd.; average sphere-equivalent diameter of the particles: 4.9 μm; ratio (Y/X) of X-ray diffraction largest peak intensity (Y) originated from impurities to X-ray diffraction largest peak intensity (X) originated from talc: 0.06; shot-type abrasion degree: 11 mg).

Heat-Resistant Lubricating Layer (205c)

The raw material talc was changed to Hi-Filler #5000 PJ (trade name, manufactured by Matsumura Sangyo K.K.; average sphere-equivalent diameter of the particles: 1.7 μm; ratio (Y/X) of X-ray diffraction largest peak intensity (Y) originated from impurities to X-ray diffraction largest peak intensity (X) originated from talc: 0.07; shot-type abrasion degree: 7 mg).

Heat-Resistant Lubricating Layer (206c)

The raw material talc was changed to a mixture having a ratio by mass of 85:15 of Hi-Filler #5000 PJ (trade name, manufactured by Matsumura Sangyo K.K.) to all of the synthetic magnesium oxide (composition: MgO, Mohs hardness: 4, average sphere-equivalent diameter of the particles: 1.2 μm, average ratio of longest width of each particle to sphere-equivalent diameter: 8.5). The ratio (Y/X) of X-ray diffraction largest peak intensity (Y) originated from magnesium oxide to X-ray diffraction largest peak intensity (X) originated from talc as a mixture was 0.23. The shot-type abrasion degree was 23 mg.

Heat-Resistant Lubricating Layer (207c)

The raw material talc was changed to a mixture having a ratio by mass of 85:15 of Hi-Filler #5000 PJ (trade name, manufactured by Matsumura Sangyo K.K.) to all of the synthetic magnesium hydroxide (composition: $Mg(OH)_2$, Mohs hardness: 2.5, average sphere-equivalent diameter of the particles: 0.8 μm, average ratio of longest width of each particle to sphere-equivalent diameter: 12.5). The ratio (Y/X) of X-ray diffraction largest peak intensity (Y) originated from magnesium hydroxide to X-ray diffraction largest peak intensity (X) originated from talc as a mixture was 0.21. The shot-type abrasion degree was 8 mg.

Heat-Resistant Lubricating Layer (208c)

The raw material talc was changed to a mixture having a ratio by mass of 85:15 of Hi-Filler #5000 PJ (trade name, manufactured by Matsumura Sangyo K.K.) to all of the synthetic silica (composition: $SiO_2$, Mohs hardness: 7, average sphere-equivalent diameter of the particles: 1.1 μm, average ratio of longest width of each particle to sphere-equivalent diameter: 20.5). The ratio (Y/X) of X-ray diffraction largest peak intensity (Y) originated from silica to X-ray diffraction largest peak intensity (X) originated from talc as a mixture was 0.28. The shot-type abrasion degree was 36 mg.

Heat-Resistant Lubricating Layer (209c)

A heat-resistant lubricating layer (209c) was prepared in the same manner as the heat-resistant lubricating layer (206c), except that the polyacrylic polyol resin of the dispersion liquid B3 for the heat-resistant lubricating layer was changed to the same amount (solid content) of polyvinyl acetal resin (trade name: S-LEC BX-1, manufactured by Sekisui Chemical Co., Ltd.), and further the amount of polyisocyanate was changed so that a ratio (—NCO/OH) of a reactive group of the polyisocyanate to a reactive group of the resin in the coating liquid B3 for the heat-resistant lubricating layer was 1.1.

The projected areas of talc particles in the heat-resistant lubricating layers (201c) to (209c) produced above were measured in the same manner as in Example 1-1. Further, average projected area and variation coefficient were calculated from the above projected areas of talc particles. Further, the number of talc particles having a projected area of 100 square μm, or more was counted. From these data, the number of talc particles having projected area of 100 square μm or more present in the heat-resistant lubricating layer per area of 200,000 square μm thereof was calculated.

The results are shown in Table 16 described below.

TABLE 16

| Heat-Resistant Lubricating Layer No. | Average projected area of talc particles having projected area of 10 square μm or more (square μm) | Variation coefficient of projected area of talc particles having projected area of 10 square μm or more | The number of talc particles having projected area of 100 square μm or more (per area of 200,000 square μm of the heat-resistant lubricating layer) |
|---|---|---|---|
| 201c | 31.4 | 0.58 | 0.4 |
| 202c | 39.1 | 0.59 | 1.3 |
| 203c | 26.5 | 0.70 | 2.4 |
| 204c | 26.5 | 0.55 | 0.6 |
| 205c | 23.0 | 0.52 | 0.5 |
| 206c | 23.8 | 0.50 | 0.3 |
| 207c | 23.7 | 0.43 | 0.6 |
| 208c | 25.0 | 0.58 | 0.8 |
| 209c | 26.6 | 0.50 | 0.3 |

From the above Table 16, it is understood that the average value of projected areas of talc particles in the heat-resistant lubricating layer and the values of variation coefficient can be controlled to the specific range of the present invention, irrespective of a quantity of impurities of the raw material talc and an abrasion degree of the raw material talc, and talc-excluding inorganic particles that are used together with the talc.

Heat-sensitive transfer sheet Nos. 101 to 132 were each produced using a heat-resistant lubricating layer selected from the group consisting of the above-described heat-resistant lubricating layers (101c) to (106c) and (201c) to (209c), and a magenta dye in combination as shown in Table 17 set forth below.

(Densitometry of Magenta DMax)

Heat-sensitive transfer sheet Nos. 101 to 132 were each produced in the same manner as the above heat-sensitive transfer sheets, except that coating liquids for each of a cyan dye layer, a magenta dye layer and a yellow dye layer were each used within 6 hours after production of the coating liquids. With combination of each heat-sensitive transfer sheet thus produced and the heat-sensitive transfer image-receiving sheet (Z-3), a magenta solid image print was output under the circumstance of 25° C. and 50% RH using Fujifilm Thermal Photo Printer ASK-2000 (trade name, manufactured by FUJIFILM Corporation). A reflection density of the print was measured using Xrite 300 (trade name, manufactured by Xrite Corporation). The M value obtained by measurement under the above conditions was used as a magenta maximum color density (Dmax density).

As a result, no jamming trouble occurred with any one of the heat-sensitive transfer sheets.

(Evaluation of Jamming)

Heat-sensitive transfer sheet Nos. 101 to 132 were each produced in the same manner as the above heat-sensitive transfer sheets, except that a coating liquid for the magenta dye layer was coated after the storing under the condition of 30° C. for 72 hours from the production of the coating liquid. With combination of each heat-sensitive transfer sheet thus produced and the heat-sensitive transfer image-receiving sheet (Z-3), 10 sheets of black solid image print were continuously output under the circumstance of 10° C. and 10% RH using Fujifilm Thermal Photo Printer ASK-2000 (trade name, manufactured by FUJIFILM Corporation). Jamming occurrence was determined according to the following criterion for evaluation. This evaluation was repeated 10 times with respect to each sample. An average of values obtained by five testers was calculated.

(Criterion for Jamming Evaluation)

5. There was completely no occurrence of jamming.
4. There was a very slight trace of jamming, which was unnoticeable defect in ordinary image appreciation.
3. A trace of jamming was confirmed, and yet there was no problem in image appreciation.
2. A trace of jamming was problematic in image appreciation.
1. Jamming occurred, but printing itself was barely possible.
0. Jamming occurred very often thereby print stopped.

TABLE 17

| Heat-sensitive Transfer Sheet No. | Heat-Resistant Lubricating Layer No. | Magenta dye composition (mass parts) | Magenta Dmax density | Jamming evaluation |
|---|---|---|---|---|
| 101 | 101c | M-2 (3.9), M-3 (3.9) | 1.98 | 4.2 |
| 102 | 102c | M-2 (3.9), M-3 (3.9) | 1.97 | 4.2 |
| 103 | 103c | M-2 (3.9), M-3 (3.9) | 1.97 | 4.3 |
| 104 | 104c | M-2 (3.9), M-3 (3.9) | 1.99 | 4.1 |
| 105 | 105c | M-2 (3.9), M-3 (3.9) | 1.98 | 4.3 |

TABLE 17-continued

| Heat-sensitive Transfer Sheet No. | Heat-Resistant Lubricating Layer No. | Magenta dye composition (mass parts) | Magenta Dmax density | Jamming evaluation |
|---|---|---|---|---|
| 106 | 106c | M-2 (3.9), M-3 (3.9) | 1.98 | 4.2 |
| 107 | 201c | M-2 (3.9), M-3 (3.9) | 1.96 | 4.1 |
| 108 | 202c | M-2 (3.9), M-3 (3.9) | 1.97 | 4.3 |
| 109 | 203c | M-2 (3.9), M-3 (3.9) | 1.98 | 4.3 |
| 110 | 204c | M-2 (3.9), M-3 (3.9) | 1.97 | 4.2 |
| 111 | 205c | M-2 (3.9), M-3 (3.9) | 1.98 | 4.2 |
| 112 | 206c | M-2 (3.9), M-3 (3.9) | 1.98 | 4.1 |
| 113 | 207c | M-2 (3.9), M-3 (3.9) | 1.98 | 4.1 |
| 114 | 208c | M-2 (3.9), M-3 (3.9) | 1.97 | 4.3 |
| 115 | 209c | M-2 (3.9), M-3 (3.9) | 1.97 | 3.9 |
| 116 | 101c | 1-3 (3.9), M-3 (3.9) | 2.30 | 3.6 |
| 117 | 102c | 1-3 (3.9), M-3 (3.9) | 2.31 | 4.6 |
| 118 | 103c | 1-3 (3.9), M-3 (3.9) | 2.32 | 4.9 |
| 119 | 104c | 1-3 (3.9), M-3 (3.9) | 2.31 | 4.5 |
| 120 | 105c | 1-3 (3.9), M-3 (3.9) | 2.32 | 4.5 |
| 121 | 106c | 1-3 (3.9), M-3 (3.9) | 2.31 | 3.9 |
| 122 | 201c | 1-3 (3.9), M-3 (3.9) | 2.32 | 4.9 |
| 123 | 202c | 1-3 (3.9), M-3 (3.9) | 2.31 | 4.8 |
| 124 | 203c | 1-3 (3.9), M-3 (3.9) | 2.31 | 4.7 |
| 125 | 204c | 1-3 (3.9), M-3 (3.9) | 2.32 | 4.9 |
| 126 | 205c | 1-3 (3.9), M-3 (3.9) | 2.32 | 4.8 |
| 127 | 206c | 1-3 (3.9), M-3 (3.9) | 2.31 | 4.9 |
| 128 | 207c | 1-3 (3.9), M-3 (3.9) | 2.32 | 4.8 |
| 129 | 208c | 1-3 (3.9), M-3 (3.9) | 2.31 | 4.7 |
| 130 | 209c | 1-4 (3.9), M-3 (3.9) | 2.25 | 4.5 |
| 131 | 103c | 1-2 (3.9), M-3 (3.9) | 2.26 | 4.8 |
| 132 | 103c | 1-4 (3.9), M-3 (3.9) | 2.25 | 4.8 |

From the above Table 17, it is apparent that the heat-sensitive transfer sheets prepared by using the specific heat-resistant lubricating layer and the dye represented by formula (2) each show such excellent properties that high Dmax is obtained and occurrence of jumming is suppressed.

Further, it is understood that the heat-resistant lubricating layer (206c) in which polyacryl polyol was used as a resin of the heat-resistant lubricating layer is better, in terms of less occurrence of jumming, than the heat-resistant lubricating layer (209c) in which polyvinylacetal resin was used.

Example 3-2

Evaluation was conducted in the same manner as that of Example 3-1, except that the heat-sensitive transfer image-receiving sheet (Z-3) was changed to a heat-sensitive transfer image-receiving sheet (Z-4). Consequently, similar results to those of Example 3-1 were obtained. Further, it has been confirmed that samples in which the heat-sensitive transfer image-receiving sheet (Z-4) was used were superior in terms of improved gloss printed matter to samples in which the heat-sensitive transfer image-receiving sheet (Z-3) was used.

Example 3-3

Heat-resistant lubricating layers (301c) to (304c) were each produced in the same manner as the heat-resistant lubricating layer (206c) in Example 3-1, except that the heat treatment condition for performing a crosslinking reacting between isocyanates and polyols was changed as follows:

Heat-Resistant Lubricating Layer (301c) Heat Treatment Condition: 58° C. 2 days

Heat-Resistant Lubricating Layer (302c) Heat Treatment Condition: 50° C. 8 days

Heat-Resistant Lubricating Layer (303c) Heat Treatment Condition: 45° C. 15 days Heat-Resistant Lubricating Layer (304c) Heat Treatment Condition: 35° C. 35 days After the heat treatment, the presence of unreacted isocyanate group was checked by IR measurement and confirmed that the reaction had been completed.

The projected areas of talc particles in the heat-resistant lubricating layer of the heat-sensitive transfer sheets (301c) to (304c) produced above were measured in the same manner as those in Example 3-1. Further, average projected area and variation coefficient were calculated from the above projected areas of talc particles. Further, the number of talc particles having a projected area of 100 square μm or more was counted. From these data, the number of talc particles having a projected area of 100 square μm or more present in the heat-resistant lubricating layer per area of 200,000 square μm thereof was calculated.

The results are shown in Table 18 described below.

TABLE 18

| Heat-Resistant Lubricating Layer No. | Average projected area of talc particles having projected area of 10 square μm or more (square μm) | Variation coefficient of projected area of talc particles having projected area of 10 square μm or more | The number of talc particles having projected area of 100 square μm or more (per area of 200,000 square μm of the heat-resistant lubricating layer) |
|---|---|---|---|
| 301c | 23.9 | 0.52 | 0.6 |
| 302c | 23.9 | 0.50 | 0.5 |
| 303c | 24.2 | 0.51 | 0.6 |
| 304c | 22.6 | 0.52 | 0.4 |

Heat-sensitive transfer sheet Nos. 301 to 304 were each produced in the same manner as the heat-sensitive transfer sheet No. 127, except that the heat-resistant lubricating layer (206c) of the heat-sensitive transfer sheet No. 127 in Example 3-1 was changed to each of the above-described heat-resistant lubricating layers (301c) to (304c).

(Evaluation of Jamming)

Jamming was evaluated in the same manner as that of Example 3-1, except that the condition of storing over time a coating liquid for the magenta dye layer was changed to the condition of 40° C. and 90 hours, and also the printing condition was changed to the condition of 5° C. and 10% RH. The evaluation results are shown in Table 19 described below.

TABLE 19

| Heat-sensitive transfer sheet No. | Heat-resistant lubricating layer No. | Jamming evaluation |
|---|---|---|
| No. 301 | 301c | 4.5 |
| No. 302 | 302c | 4.8 |
| No. 303 | 303c | 4.8 |
| No. 304 | 304c | 4.3 |

From the results of the above Table 19, it is understood that the heat-sensitive transfer sheet Nos. 302 and 303, in which the heat treatment condition was adjusted to the temperature range of from 40° C. to 53° C. and to the period of time ranging from 1 day to 20 days, are each enable to more effectively suppress occurrence of jamming whereby these samples are each more preferable than other samples.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2008-254802 filed in Japan on Sep. 30, 2008, Patent Application No. 2008-254804 filed in Japan on Sep. 30, 2008, and Patent Application No. 2008-254805 filed in Japan on Sep. 30, 2008, which are entirely herein incorporated by reference.

What we claim is:

1. A heat-sensitive transfer sheet, comprising:

a base film;

a dye layer containing a heat-transferable dye and a resin formed on one side of the base film; and a heat-resistant lubricating layer containing talc particles as one kind of inorganic particle and a resin formed on the other side of the base film;

wherein, when a projected area corresponding to each of the talc particles in the heat-resistant lubricating layer is obtained from an electron beam image that is obtained by irradiating electron beams accelerated at 20 kV from a side of the heat-resistant lubricating layer of the heat-sensitive transfer sheet using a scanning electronic microscope, an average projected area of talc particles each having the projected area of 10 square μm or more is 80 square μm or less, and a variation coefficient that is obtained by dividing a standard deviation of the projected areas of talc particles each having the projected area of 10 square μm or more by the average projected area is 0.80 or less.

2. The heat-sensitive transfer sheet according to claim 1, wherein the heat-transferable dye is a yellow dye represented by formula (1):

Formula (1)

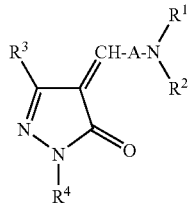

wherein A represents a substituted or unsubstituted arylene group; $R^1$ and $R^2$ each independently represent a hydrogen atom, a substituted or unsubstituted alkyl group, a substituted or unsubstituted alkenyl group or a substituted or unsubstituted aryl group; $R^3$ represents a hydrogen atom, a substituted or unsubstituted alkyl group, a substituted or unsubstituted aryl group, a substituted or unsubstituted amino group, a substituted or unsubstituted alkoxy group, a substituted or unsubstituted aryloxy group, a substituted or unsubstituted alkoxycarbonyl group, a substituted or unsubstituted aryloxycarbonyl group, or a substituted or unsubstituted carbamoyl group; and $R^4$ represents a substituted or unsubstituted alkyl group or a substituted or unsubstituted aryl group.

3. The heat-sensitive transfer sheet according to claim 1, wherein the heat-transferable dye is a magenta dye represented by formula (2):

Formula (2)

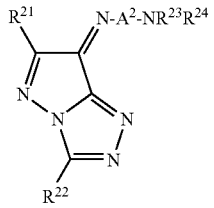

wherein $A^2$ represents a substituted or unsubstituted arylene group or a substituted or unsubstituted divalent pyridine ring group; and $R^{21}$, $R^{22}$, $R^{23}$ and $R^{24}$ each independently represent a substituted or unsubstituted alkyl group, a substituted or unsubstituted alkenyl group or a substituted or unsubstituted aryl group.

4. The heat-sensitive transfer sheet according to claim 1, wherein the average projected area of talc particles each having the projected area of 10 square μm or more is 40 square μm or less, and the variation coefficient that is obtained by dividing a standard deviation of the projected areas of talc particles each having the projected area of 10 square μm or more by the average projected area is 0.60 or less.

5. The heat-sensitive transfer sheet according to claim 1, wherein the number of talc particles having the projected area of 100 square μm or more in the heat-resistant lubricating layer is 1 or less per unit area 200,000 square μm of the heat-resistant lubricating layer.

6. The heat-sensitive transfer sheet according to claim 1, wherein the heat-resistant lubricating layer comprises at least one kind of inorganic particle other than the talc particles, and wherein the inorganic particle has Mohs hardness of from 3 to 6, an average sphere-equivalent diameter of the particle is from 0.3 μm to 5 μm, and the ratio of the longest width of the particle to the average sphere-equivalent diameter of the particle is from 1.5 to 50.

7. The heat-sensitive transfer sheet according to claim 1, wherein the heat-resistant lubricating layer further comprises a compound represented by formula (P):

$$\{(R^{1a}O)(R^{2a}O)P(=O)O\}_m M \qquad \text{Formula (P)}$$

wherein $R^{1a}$ represents a substituted or unsubstituted aliphatic group or a substituted or unsubstituted aryl group; $R^{2a}$ represents a hydrogen atom, a metal ion, a substituted or unsubstituted aliphatic group, or a substituted or unsubstituted aryl group; M represents a hydrogen atom, a metal ion, or an ammonium ion; and m has the same valence as that of M and represents a number of from 1 to 6.

8. The heat-sensitive transfer sheet according to claim 7, wherein when the content of the compound represented by formula (P) contained in the heat-resistant lubricating layer is 100 parts by mass, the content of the talc particles contained in the heat-resistant lubricating layer is 30 parts by mass or more.

9. The heat-sensitive transfer sheet according to claim 1, wherein the heat-resistant lubricating layer further comprises a multivalent metal salt of an alkyl carboxylic acid.

10. The heat-sensitive transfer sheet according to claim 1, wherein the base film further comprises an easy adhesion layer on or above at least one surface thereof.

11. The heat-sensitive transfer sheet according to claim 1, wherein the resin of the heat-resistant lubricating layer has two or more hydroxyl groups at the end of polymer chain of the resin or in a polymer structure of the resin.

12. The heat-sensitive transfer sheet according to claim 11, wherein the resin is a polyacrylpolyol resin.

13. The heat-sensitive transfer sheet according to claim 11, wherein the resin of the heat-resistant lubricating layer is a cross-linked resin.

14. The heat-sensitive transfer sheet according to claim 13, wherein a crosslinking reaction of the resin is carried out in the temperature range of 40° C. to 53° C. and for a period of 1 day to 20 days.

15. The heat-sensitive transfer sheet according to claim 1, which is used in combination with a heat-sensitive transfer image-receiving sheet having a support, and a heat insulation layer containing latex hollow polymeric particles and a receptor layer containing a latex polymer disposed on or above the support.

16. A method of forming an image, comprising the steps of:

superposing a heat-sensitive transfer sheet on a heat-sensitive transfer image-receiving sheet, and applying thermal energy from a side of a heat-resistant lubricating layer described below of the heat-sensitive transfer sheet in accordance with an image signal, to form an image, wherein the heat-sensitive transfer sheet comprises a base film, a dye layer containing a heat-transferable dye and a resin formed on one side of the base film, and a heat-resistant lubricating layer containing talc particles as one kind of inorganic particle and a resin formed on the other side of the base film, wherein the heat-sensitive transfer image-receiving sheet comprise a support, and a heat insulation layer containing latex hollow polymeric particles and a receptor layer containing a latex polymer on the support, wherein, in the superposing step, said dye layer of the heat-sensitive transfer sheet is contact with the receptor layer of the heat-sensitive transfer image-receiving sheet, and wherein, when a projected area corresponding to each of the talc particles in the heat-resistant lubricating layer is obtained from an electron beam image that is obtained by irradiating electron beams accelerated at 20 kV from a side of the heat-resistant lubricating layer of the heat-sensitive transfer sheet using a scanning electronic microscope, an average projected area of talc particles each having the projected area of 10 square μm or more is 80 square μm or less, and a variation coefficient that is obtained by dividing a standard deviation of the projected areas of talc particles each having the projected area of 10 square μm or more by the average projected area is 0.80 or less.

17. The method of forming an image according to claim 16, wherein the heat-transferable dye is a yellow dye represented by formula (1):

Formula (1)

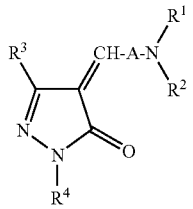

wherein A represents a substituted or unsubstituted arylene group; $R^1$ and $R^2$ each independently represent a hydrogen atom, a substituted or unsubstituted alkyl group, a substituted or unsubstituted alkenyl group or a substituted or unsubstituted aryl group; $R^3$ represents a hydrogen atom, a substituted or unsubstituted alkyl group, a substituted or unsubstituted aryl group, a substituted or unsubstituted amino group, a substituted or unsubstituted alkoxy group, a substituted or unsubstituted aryloxy group, a substituted or unsubstituted alkoxycarbonyl group, a substituted or unsubstituted aryloxycarbonyl group, or a substituted or unsubstituted carbamoyl group; and $R^4$ represents a substituted or unsubstituted alkyl group or a substituted or unsubstituted aryl group.

18. The method of forming an image according to claim 16, wherein the heat-transferable dye is a magenta dye represented by formula (2):

Formula (2)

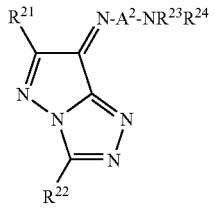

wherein $A^2$ represents a substituted or unsubstituted arylene group or a substituted or unsubstituted divalent pyridine ring group; and $R^{21}$, $R^{22}$, $R^{23}$ and $R^{24}$ each independently represent a substituted or unsubstituted alkyl group, a substituted or unsubstituted alkenyl group or a substituted or unsubstituted aryl group.

* * * * *